US005391470A

United States Patent [19]

Yasuda et al.

[11] Patent Number: 5,391,470

[45] Date of Patent: Feb. 21, 1995

[54] SILVER HALIDE PHOTOGRAPHIC MATERIAL

[75] Inventors: Tomokazu Yasuda; Junichi Yamanouchi; Koji Tamoto, all of Kanagawa, Japan

[73] Assignee: Fuji Photo Film Co., Ltd., Kanagawa, Japan

[21] Appl. No.: 104,649

[22] Filed: Aug. 11, 1993

[30] Foreign Application Priority Data

Aug. 13, 1992 [JP] Japan ..... 4-236305

[51] Int. Cl.[6] ..... G03C 1/06

[52] U.S. Cl. ..... 430/517; 430/510; 430/513; 430/516; 430/529; 430/634; 430/635

[58] Field of Search ..... 430/634, 635, 513, 529, 430/516, 510, 517, 522

[56] References Cited

U.S. PATENT DOCUMENTS 4,916,050 4/1990 Nishijima et al. ..... 430/635
5,264,333 11/1993 Yamanouchi et al. ..... 430/510

*Primary Examiner*—Thorl Chea
*Attorney, Agent, or Firm*—Sughrue, Mion, Zinn, Macpeak & Seas

[57] ABSTRACT

There is disclosed a silver halide photographic material containing a dispersion of a hydrophobic compound and a water-insoluble and organic solvent-soluble polymer as defined herein. The hydrophobic compound may be a dye which is photochemically inactive during storage but readily decolored and eluted in photographic processing.

15 Claims, No Drawings

SILVER HALIDE PHOTOGRAPHIC MATERIAL

FIELD OF THE INVENTION

The present invention relates to a silver halide photographic material comprising an emulsion of a specific photographically useful material in a specific layer, that is, to a silver halide photographic material having a hydrophilic colloid layer containing a photographically useful material which is photochemically inactive during storage but readily provides a needed reactivity in photographic processing. Particularly, where a dye is used as the photographic material, the present invention relates specifically to a silver halide photographic material having a hydrophilic colloid layer comprising the dye which is photochemically inactive and readily decolored and eluted during photographic processing.

BACKGROUND OF THE INVENTION

It is known that in a silver halide photographic material, various oil soluble photographically useful compounds are introduced into a hydrophilic colloid layer to constitute a photographic material in order to exhibit various photographic functions. In this case, a hydrophobic compound is used particularly in a multilayer type photographic material in order to fix an objective photographically useful material in a specific layer. These hydrophobic compounds are oil soluble materials in many cases and are emulsified with a high boiling point organic solvent and a surface active agent in order to introduce them into the hydrophilic colloid layer. They are applied via a coating process.

However, use of the high boiling point organic solvent is disadvantageous. For example, where a dye-forming coupler is used as the hydrophobic compound, a stain results on the surface of the photographic material due to the bleeding of the high boiling point organic solvent during storage of the photographic material. Also, there is degradation of coloring performance attributable to deterioration of reactivity due to crystal deposition of the coupler. In particular, where a dye is used as the hydrophobic compound, the problems discussed below result.

In a silver halide photographic material, a photographic emulsion layer and the other hydrophilic colloid layers are often colored for the purpose of absorbing light of a specific wavelength range.

When it is necessary to control the spectral composition of light incident to a photographic emulsion layer, a coloring layer is usually provided farther from a support than the photographic emulsion layer. Such a coloring layer is called a filter layer. Where plural photographic emulsion layers are present, the filter layer is provided at the middle thereof in some cases.

For the purpose of preventing blur of an image, that is, a halation caused by a light which is scattered in or after passing through a photographic emulsion layer and is reflected on an interface between the emulsion layer and support or a surface of a support side opposite to the emulsion layer to get once again in the photographic emulsion layer, a coloring layer which is called an anti-halation layer is provided between the photographic emulsion-layer and support or on a support side opposite to the photographic emulsion layer. Where plural photographic emulsion layers are present, the anti-halation layer is provided at the middle thereof in some cases.

The photographic emulsion layer is sometimes colored in order to prevent the deterioration of the sharpness of an image (in general, this phenomenon is called an irradiation) caused by scattering of light in the photographic emulsion layer.

Dyes are usually incorporated into these hydrophilic colloid layers to be colored. These dyes are required to satisfy the following conditions:

(1) having an appropriate spectral absorption according to a particular use;

(2) photochemically inactive, that is, exerting no adverse affects in a chemical sense, for example, reduction of a sensitivity, degradation of a latent image and fogging, to the characteristics of a silver halide photographic layer;

(3) bleached at the photographic processing steps or eluted in a processing solution or rinsing water to leave no harmful color on a processed photographic material;

(4) not diffused from a colored layer to the other layers; and (5) having an excellent aging stability in a solution or a photographic material and not discolored and faded.

In particular, where the coloring layer is a filter layer or an anti-halation layer provided on the same side of a support as a photographic emulsion layer, it is necessary in many cases that those layers are selectively colored and that the other layers are not substantially colored, because otherwise not only a harmful spectral effect is exerted to the other layers but also an effect as the filter layer or anti-halation layer is reduced. However, the layer containing a dye contacts the other hydrophilic layers in a wet condition and after permits a part of the dye to diffuse from the former to the latter. Many efforts have so far been made in order to prevent such dye diffusion.

For example, methods are disclosed in U.S. Pat. Nos. 2,548,564, 4,124,386 and 3,625,694, in which a hydrophilic polymer having a charge opposite to a dissociated anionic dye acts as a mordant in a layer to localize the dye in a specific layer by means of an interaction with a dye molecule.

However, such a fixing/decoloring method in which mordant is used requires a significant amount of the mordant for an anionic dye and therefore inevitably increases the thickness of a coloring layer. For example, when a mordant is used in a filter layer for a photographing material, the increase in the thickness of the layer causes deterioration of the sharpness of an image obtained. Further, when a mordant is used, decoloring of a sensitizing dye used for a silver halide emulsion as well as the fixing/decoloring of a coloring dye must be avoided. However, decoloring performance thereof does not always produce a high image quality of a photographic material and is not necessarily compatible with recent advances in film processing.

Further, methods in which a specific layer is colored with a water insoluble solid dye are disclosed in JP-A-56-12639 (the term "JP-A" as used herein means an unexamined published Japanese patent application), JP-A-55-155350, JP-A-55-155351, JP-A-63-27838, and JP-A-63-197943, European Patents 15,601, 274,723, 276,566 and 299,435, U.S. Pat. No. 4,803,150, and International Patent WO88/04794.

Further, methods in which a specific layer is colored with metal salt fine particles on which the dyes are adsorbed are disclosed in U.S. Pat. Nos. 2,719,088, 2,496,841 and 2,496,843, and JP-A-60-45237.

Such coloring methods have excellent fixing performances/decoloring performances but light absorption by layers manufactured by those methods are generally broad. For example, where they are used as a filter dye to the ray having some specific wavelength, problems have often been caused.

The means for dispersing an oil soluble dye together with a high boiling point organic solvent are disclosed in JP-A-61-204630, JP-A-61-205934, JP-A-62-32460, JP-A-62-56958, JP-A-62-92949, JP-A-62-222248, JP-A-63-40143, JP-A-63-184749, and JP-A-63-316852.

However, the use of such high boiling point organic solvents softens a coloring layer and deteriorates layer strength. Accordingly, more gelatin is required which results in increasing layer thickness.

Meanwhile, methods in which a solution of a hydrophobic compound, such as a dye dissolved in an organic solvent, is added and impregnated into an aqueous dispersion (a polymer latex) of a polymer and the polymer is charged therein with the hydrophobic compound, are disclosed in JP-B-51-39853 (the term "JP-B" as used herein means an unexamined Japanese patent publication), JP-A-51-59943, JP-A-53-137131, JP-A-54-32552, JP-A-54-107941, JP-A-56-126830, and JP-A-58-149038, and U.S. Pat. Nos. 4,199,363, 4,203,716, and 4,990,435. While the various problems attributable to the above high boiling point organic solvents are eliminated from these methods by the use of the polymers, the polymer latex particles lack stability during impregnating such that a flocculation is liable to take place. Moreover, a significant amount of the polymers are required for sufficiently impregnating the hydrophobic compound, and elimination of the water soluble auxiliary organic solvent used for impregnation requires a significant amount of labor and the process itself requires a long time and is complicated.

Various investigations made by the present inventors have resulted in finding that the selective coloring of a specific layer and decoloring as a processing step are possible by using a dispersion obtained by emulsifying and dispersing a mixed solution containing a water insoluble and organic solvent soluble polymer and an oil soluble dye without exerting an adverse effect on membrane strength. However, the compatibility of the organic solvent soluble polymer with the oil soluble dye is not necessarily sufficient. In particular, there have been problems with respect to the low solubility of the polymer in an organic solvent and the broadened absorption and lowered absorption strength in a maximum absorption wavelength of a dye having a high melting point.

Countermeasures against these problems are possible to some extent by increasing the proportion of the polymer used for a dispersion or using, in combination, a high boiling organic solvent in a dye dispersion. However, any of these countermeasures increases the layer thickness of a coloring layer and adversely impacts upon the requirement of making a membrane thinner for a higher image quality.

SUMMARY OF THE INVENTION

Accordingly, one object of the present invention is to provide a silver halide photographic material which is very suitable for manufacturing and, in which a photographically useful compound is selectively fixed in a specific layer without exerting an adverse influence on the reactivity of a hydrophobic compound in the layer and on the strength of a membrane containing the layer. The layer contains a dispersion of a novel photographically useful compound having an excellent reactivity or eluting performance during a processing step.

The above and other objects of the present invention have been achieved by a silver halide photographic material obtained by dispersing a lipophilic fine particle comprising a hydrophobic compound, wherein the fine particle comprises a water-insoluble and organic solvent-soluble polymer comprising a polymer having a repeating unit represented by the following formula (I):

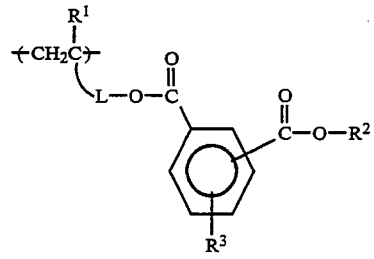

(I)

wherein $R^1$ represents a hydrogen atom, an alkyl group having from 1 to 4 carbon atoms, or a halogen atom;

$R^2$ represents an alkyl or aryl group;

$R^3$ represents a hydrogen atom or a substituent;

L represents a divalent linkage group.

Preferably, the hydrophobic compound is an oil soluble dye.

More preferably, the oil soluble dye is a compound represented by formula (II):

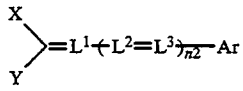

(II)

wherein

X and Y may be the same or different and each individually represents an electron attractive group or an acidic group formed by combining X with Y;

Ar represents a phenyl or heterocyclic group;

$L^1$, $L^2$ and $L^3$ each represents a methine group; and $n_2$ represents an integer of 0, 1 or 2; or a compound represented by formula (III):

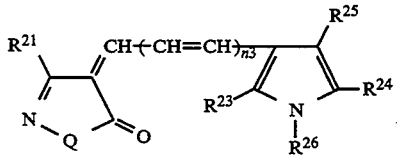

(III)

wherein $R^{21}$ represents a hydrogen atom, an alkyl group, an aryl group, $—COOR^{27}$, $—COR^{27}$, $—CONR^{27}R^{28}$, —CN , $—OR^{27}$, $—NR^{27}R^{28}$, or $—N(R^{27})COR^{28}$;

Q represents an oxygen atom or $—NR^{22}$—;

$R^{22}$ represents a hydrogen atom, an alkyl group, an aryl group, or a heterocyclic group;

$R^{23}$, $R^{24}$ and $R^{25}$ may be the same or different and each individually represents a hydrogen atom, an alkyl group, or an aryl group;

$R^{24}$ and $R^{25}$ may be combined to form a 6-membered ring;

$R^{26}$ represents a hydrogen atom, an alkyl group, an aryl group, or an amino group;

$R^{27}$ and $R^{28}$ may be the same or different and each individually represents a hydrogen atom, an alkyl group, or an aryl group; and $n_3$ represents an integer of 0 or 1.

DETAILED DESCRIPTION OF THE INVENTION

The present invention will be explained below in detail.

First, the water-insoluble and organic solvent-soluble polymer containing the repeating unit represented by formula (I) according to the present invention will be explained.

In formula (I), $R^1$ represents a hydrogen atom, an alkyl group having from 1 to 4 carbon atoms (for example, methyl, ethyl, n-butyl), or a halogen atom (for example, chlorine, bromine). Of them, a hydrogen atom and a methyl group are more preferred as $R^1$.

$R^2$ represents a substituted or unsubstituted alkyl group or a substituted or unsubstituted aryl group.

Examples of the unsubstituted alkyl group include methyl, ethyl, n-propyl, isopropyl, n-butyl, isobutyl, n-amyl, n-hexyl, n-heptyl, n-octyl, 2-ethylhexyl, n-nonyl, n-decyl, n-dodecyl, and n-octadecyl. Examples of the unsubstituted aryl group include phenyl and naphthyl.

Examples of the substituent of the above substituted alkyl and aryl groups include an aryl group (for example, phenyl), a nitro group, a hydroxyl group, a cyano group, a sulfo group, an alkoxy group (for example, methoxy), an aryloxy group (for example, phenoxy), an acyloxy group (for example, acetoxy), an acylamino group (for example, acetylamino), a sulfonamide group (for example, methanesulfonamide), a sulfamoyl group (for example, methylsulfamoyl), a halogen atom (for example, fluorine, chlorine, bromine), a carboxyl group, a carbamoyl group (for example, methylcarbamoyl), an alkoxycarbonyl group (for example, methoxycarbonyl), and a sulfonyl group (for example, methylsulfonyl). When two or more substituents are present, they are the same or different.

$R^3$ represents a hydrogen atom or a substituent. Examples of the substituent include a substituted or unsubstituted alkyl group (for example, methyl, ethyl, n-propyl, isopropyl, n-butyl, isobutyl, n-amyl, n-hexyl, n-heptyl, n-octyl, 2-ethylhexyl, n-nonyl, n-decyl, n-dodecyl, n-octadecyl), a substituted or unsubstituted aryl group (for example, phenyl, naphthyl) (examples of substituents of the above alkyl and aryl groups are the same as the examples of the substituents shown in above $R^2$), a halogen atom (for example, chlorine, bromine), a nitro group, a hydroxyl group, a cyano group, a sulfo group, an alkoxy group (for example, methoxy, ethoxy, butyloxy), an aryloxy group (for example, phenoxy, p-methoxyphenoxy), an acylamino group (for example, acetylamino, benzoylamino), a sulfonamide group (for example, methanesulfonamide, phenylsulfonamide), a carboxyl group, a carbamoyl group (for example, methylcarbamoyl, phenylcarbamoyl), an alkoxycarbonyl group (for example, methoxycarbonyl, n-butoxycarbonyl, phenoxycarbonyl), and a sulfonyl group (for example, methylsulfonyl, phenylsulfonyl).

L represents a divalent linkage group. To be concrete, it is represented by the following formula:

$$\text{-}(Z)_m\text{-}(X^1\text{-}(J^1\text{-}X^2)_p\text{-}(J^2\text{-}X^3)_q\text{-}(J^3)_r)_s\text{-}$$

wherein Z represents —CON($R^4$)— ($R^4$ represents a hydrogen atom, or a substituted or unsubstituted alkyl group having from 1 to 6 carbon atoms), —COO—, —NHCO—, —OCO—,

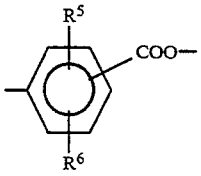

($R^5$ and $R^6$ in all locations herein each independently represents a hydrogen atom, a hydroxyl group, a halogen atom, or an alkyl group, an alkoxy group, an acyloxy group, or an aryloxy group, each of which may be substituted or unsubstituted), and

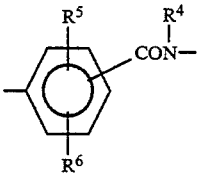

$J^1$, $J^2$, and $J^3$ may be the same or different and each independently represents —CO—, —$SO_2$—, —CON($R^7$)— ($R^7$ in all locations herein represents a hydrogen atom, a substituted or unsubstituted alkyl group having from 1 to 6 carbon atoms), —$SO_2$N($R^7$)—, —N($R^7$)$R^8$— ($R^8$ in all locations herein represents an alkylene group having 1 to 4 carbon atoms), —N($R^6$)—$R^7$—N—($R^8$)— ($R^8$ in all locations herein represents a hydrogen atom, a substituted or unsubstituted alkyl group having from 1 to 6 carbon atoms), —O—, —S—, —N($R^6$)—CO—N($R^8$)—, —N($R^6$)—, —$SO_2$N($R^8$)—, —COO—, —OCO—, or —N($R^7$)$CO_2$—.

$X^1$, $X^2$, and $X^3$ may be the same or different and each represent a substituted or unsubstituted alkylene group, a substituted or unsubstituted arylene group, or a substituted or unsubstituted aralkylene group.

Examples of the alkylene group include methylene, methylmethylene, dimethylmethylene, dimethylene, trimethylene, tetramethylene, pentamethylene, hexamethylene, and decylmethylene. Examples of the aralkylene group include benzylidene. Examples of the arylene group include p-phenylene, m-phenylene, and methylphenylene. m, p, q, r, and s each represents 0 or 1.

Preferred examples of the repeating unit represented by formula (I) are shown below in the form of a monomer but the present invention will not be limited thereby.

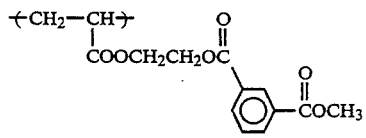

M-1

-continued
M-2
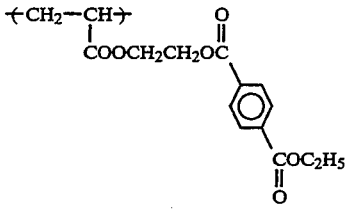
M-3
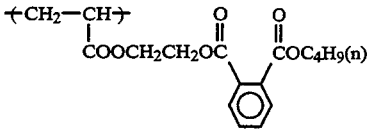
M-4
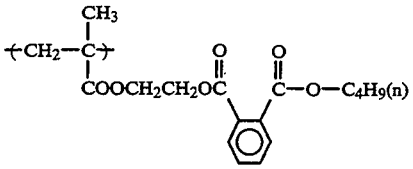
M-5
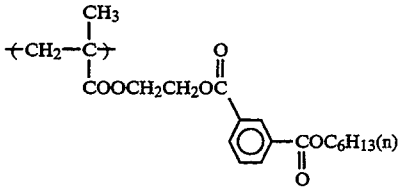
M-6
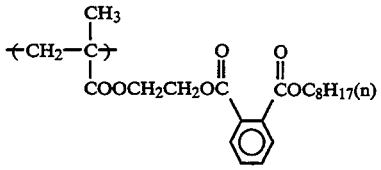
M-7
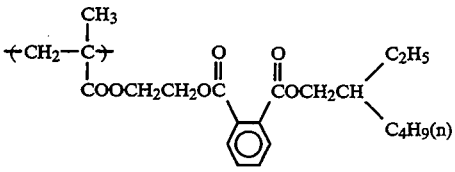
M-8
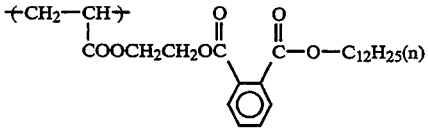
M-9
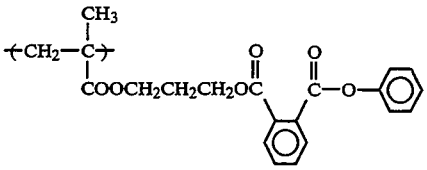
M-10
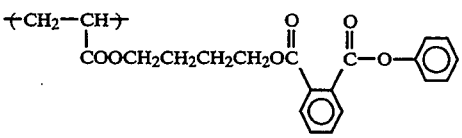
-continued
M-11
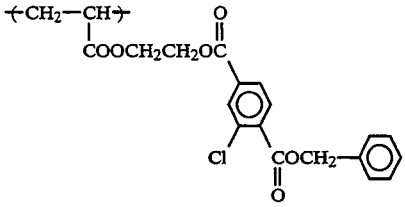
M-12
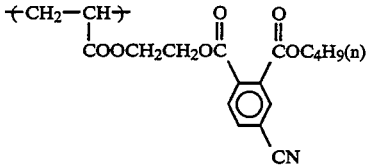
M-13
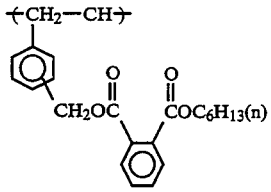
M-14
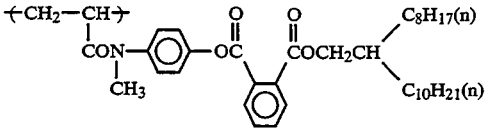
M-15
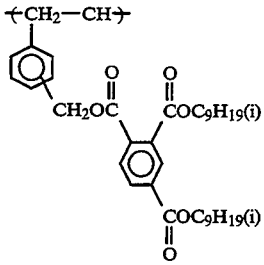
M-16
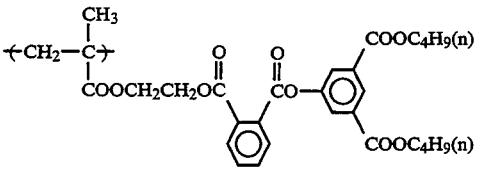
M-17
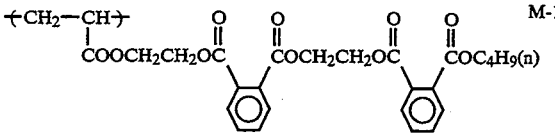
M-18
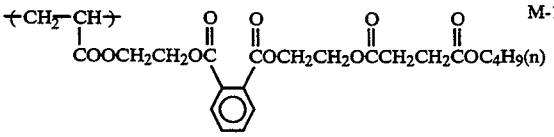
M-19
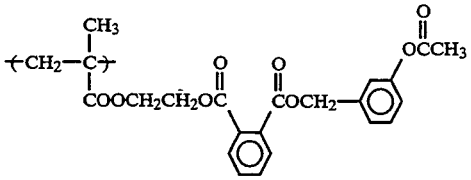

-continued

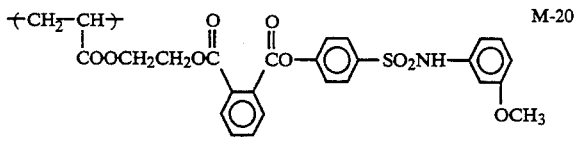

M-20

Polymers in the present invention may be prepared by any suitable method such as by: polymerization of a monomer according to formula (I); copolymerization of a monomer or two or more monomers of formula (I) with another ethylenically unsaturated monomers capable of addition-polymerizing with formula (I).

When these monomers are polymerized, the polymerization may be carried out after protecting a hydroxyl group, if present, on the compound represented by formula (I) with a conventional protecting group, such as an acetyl group, a methyl group or an ethoxycarbonyl group. In a hydroxyl group is protected, a deblocking reaction can be carried out after the polymerization.

Further, there may be used the synthetic method in which the repetitive unit of formula (I) is resultantly formed.

The above-mentioned methods are disclosed in, for example, U.S. Pat. Nos. 2,710,801, 2,816,028, and 2,816,208.

Any suitable ethylenically unsaturated monomer polymerizable at a polymerization temperature of 10° to 120° C. can be used as the ethylenically unsaturated monomers capable of addition-polymerizing with the monomer of formula (I) or a precursor thereof.

Examples of such monomers include acrylic esters such as methyl acrylate, ethyl acrylate, n-propyl acrylate, isopropyl acrylate, n-butyl acrylate, isobutyl acrylate, sec-butyl acrylate, tert-butyl acrylate, amyl acrylate, hexyl acrylate, 2-ethylhexyl acrylate, octyl acrylate, tert-octyl acrylate, 2-chloroethyl acrylate, 2-bromoethyl acrylate, 4-chlorobutyl acrylate, cyanoethyl acrylate, 2-acetoxyethyl acrylate, dimethylaminoethyl acrylate, benzyl acrylate, methoxybenzyl acrylate, 2-chlorocyclohexyl acrylate, cyclohexyl acrylate, furfuryl acrylate, tetrahydrofurfuryl acrylate, phenyl acrylate, 5-hydroxypentyl acrylate, 2,2-dimethyl-3-hydroxypropyl acrylate, 2-methyoxyethyl acrylate, 3-methyoxybutyl acrylate, 2-ethyoxyethyl acrylate, 2-isopropoxy acrylate, 2-butoxyethyl acrylate, 2-(2-methoxyethoxy)ethyl acrylate, 2-(2-butoxyethoxy)ethyl acrylate, ω-methoxypolyethylene glycol acrylate (addition mole number of ethylene glycol is 9), 1-bromo-2-methoxyethyl acrylate, and 1,1-dichloro-2-ethoxyethyl acrylate; methacrylic esters such as methyl methacrylate, ethyl methacrylate, n-propyl methacrylate, isopropyl methacrylate, n-butyl methacrylate, isobutyl methacrylate, sec-butyl methacrylate, tert-butyl methacrylate, amyl methacrylate, hexyl methacrylate, cyclohexyl methacrylate, benzyl methacrylate, chlorobenzyl methacrylate, octyl methacrylate, stearyl methacrylate, sulfopropyl methacrylate, N-ethyl-N-phenylaminoethyl methacrylate, 2-(3-phenylpropyloxy)ethyl methacrylate, dimethylaminophenoxyethyl methacrylate, furfuryl methacrylate, tetrahydrofurfuryl methacrylate, phenyl methacrylate, cresyl methacrylate, naphthyl methacrylate, 2-hydroxyethyl methacrylate, 4-hydroxybutyl methacrylate, methacrylate, triethylene glycol monomethacrylate, dipropylene glycol monomethacrylate, 2-methoxyethyl methacrylate, 3-methoxybutyl methacrylate, 2-acetoxyethyl methacrylate, 2-acetoacetoxyethyl methacrylate, 2-ethoxyethyl methacrylate, 2-iso-propoxyethyl methacrylate, 2-butoxyethyl methacrylate, 2-(2-methoxyethoxy)ethyl methacrylate, 2-(2-ethoxyethoxy) ethyl methacrylate, 2-(2-butoxyethoxy) ethyl methacrylate, ω-methoxypolyethylene glycol methacrylate (addition mole number of ethylene glycol is 6), allyl methacrylate, and dimethylaminoethyl methacrylate methyl chloride salt;

vinyl esters such as vinyl acetate, vinyl propionate, vinyl butylate, vinyl isobutylate, vinyl caproate, vinyl chloroacetate, vinyl methoxyacetate, vinyl phenylacetate, vinyl benzoate, and vinyl salicylate;

acrylamides such as acrylamide, methyl acrylamide, ethyl acrylamide, propyl acrylamide, butyl acrylamide, tertbutyl acrylamide, cyclohexyl acrylamide, benzyl acrylamide, hydroxymethyl acrylamide, methoxyethyl acrylamide, dimethylaminoethyl acrylamide, phenyl acrylamide, dimethyl acrylamide, diethyl acrylamide, β-cyanoethyl acrylamide, N-(2-acetoacetoxyethyl) acrylamide, and diacetone acrylamide;

methacrylamides such as methacrylamide, methyl methacrylamide, ethyl methacrylamide, propyl methacrylamide, butyl methacrylamide, tert-butyl methacrylamide, cyclohexyl methacrylamide, benzyl methacrylamide, hydroxymethyl methacrylamide, methoxyethyl methacrylamide, dimethylaminoethyl methacrylamide, phenyl methacrylamide, dimethyl methacrylamide, diethyl methacrylamide, β-cyanoethyl methacrylamide, and N-(2-acetoacetoxyethyl) methacrylamide;

olefins such as dicyclopentadiene, ethylene, propylene, 1-butene, 1-pentene, vinyl chloride, vinylidene chloride, isoprene, chloroprene, butadiene, and 2,3-dimethylbutadiene;

styrenes such as styrene, methylstyrene, dimethylstyrene, trimethylstyrene, ethylstyrene, isopropylstyrene, chloromethylstyrene, methoxystyrene, acetoxystyrene, chlorostyrene, dichlorostyrene, bromostyrene, and methyl vinylbenzoate;

vinyl ethers such as methyl vinyl ether, butyl vinyl ether, hexyl vinyl ether, methoxyethyl vinyl ether, and dimethylaminoethyl vinyl ether;

and other monomers such as butyl crotonate, hexyl crotonate, dimethyl itaconate, dibutyl itaconate, diethyl maleate, dimethyl maleate, dibutyl maleate, diethyl fumarate, dimethyl fumarate, dibutyl fumarate, methyl vinyl ketone, phenyl vinyl ketone, methoxyethyl vinyl ketone, glycidyl acrylate, glycidyl methacrylate, N-vinyloxazolidone, N-vinylpyrrolidone, acrylonitrile, methacrylonitrile, methylenemalononitrile, and vinylidene chloride.

Monomers having an acidic group can be copolymerized with the organic solvent soluble polymer according to the present invention in order to further accelerate the decoloring performance of the dye. Examples of such monomers include acrylic acid; methacrylic acid; itaconic acid; maleic acid; monoalkyl itaconate such as monomethyl itaconate and monoethyl itaconate; monoalkyl maleate such as monomethyl maleate and monoethyl maleate; citraconic acid; styrenesulfonic acid; vinylbenzylsulfonic acid; vinylsulfonic acid; acryloyloxyalkylsulfonic acid such as acryloyloxymethylsulfonic acid, acryloyloxyethylsulfonic acid, and acryloyloxypropylsulfonic acid; methacryloyloxyalkylsulfonic acid such as methacryloyloxymethylsulfonic acid, methacryloyloxyethylsulfonic acid, and methacryloyloxypropylsulfonic acid; acrylamidealkylsulfonic acid such as 2-acrylamide-2-methylethanesulfonic acid, 2-acrylamide-2-methylpropanesulfonic acid, and 2-acrylamide-2-methylbutanesulfonic acid; and methacrylamidealkylsulfonic acid such as 2-methacrylamide-2-methylethanesulfonic acid, 2-methaacrylamide-2-methylpropanesulfonic acid, and 2-methacrylamide-2-methylbutanesulfonic acid.

There is a possibility that copolymerization of a monomer having an acid group with a monomer having a repeating unit of formula (I) may cause widening of the hue and lowering of the maximum absorption wavelength depending on the types of the dyes used. As monomers which scarcely cause a change in hue and accelerate decolorizability, there are particularly preferred compounds which give homopolymers which are insoluble in water at a pH<6, but are soluble in water at a pH>10. Examples of such hydrophobic monomers having an acid group include the following compounds:

S-1

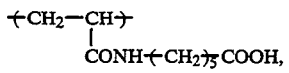

S-2

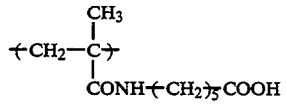

S-3

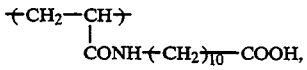

S-4

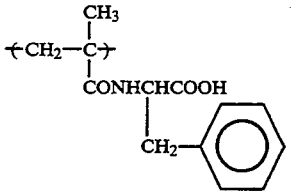

S-5

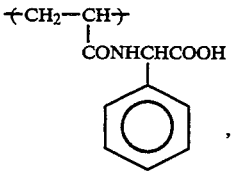

S-6

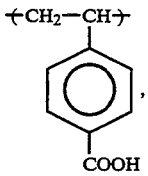

S-7

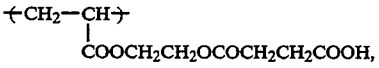

S-8

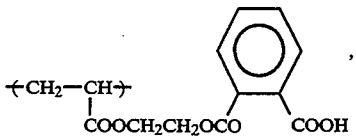

-continued

S-9

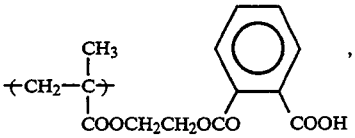

S-10

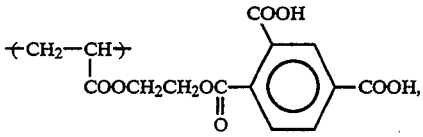

S-11

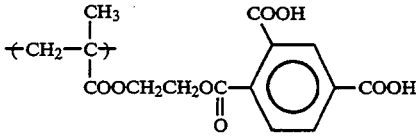

S-12

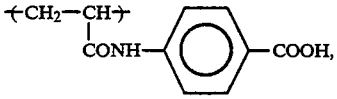

S-13

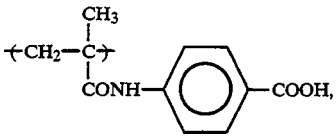

S-14

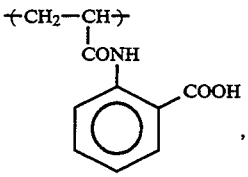

S-15

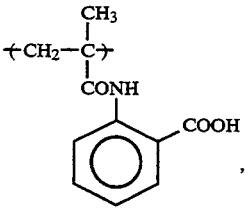

S-16

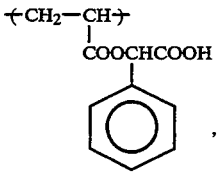

S-17

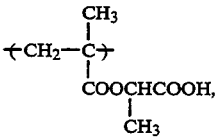

S-18

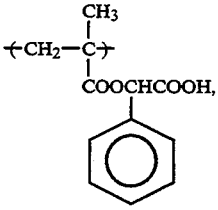

-continued

S-19

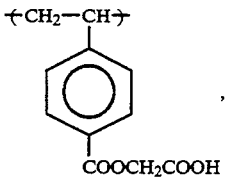

S-20

$$\text{+}H_{17}C_8OOCCH-CHCOOH\text{+},$$

S-21

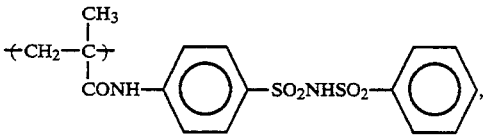

S-22

$$\text{+}CH_2-\underset{\underset{\underset{O}{\|}}{COOCH_2CH_2OCCH_2COCH_3}}{\underset{|}{CH}}\text{+},$$

S-23

$$\text{+}CH_2-\underset{\underset{\underset{CH_2COOH}{|}}{COOCH-C_5H_{11}(n)}}{\underset{|}{CH}}\text{+}$$

The acidic group-containing monomers described above may be the alkali metal (for example, Na and K) or ammonium salts of the monomers.

The proportion of the repeating unit represented by formula (I) in the water-insoluble and organic solvent-soluble polymer according to the present invention varies according to the hydrophobic compounds used and the mixing ratio of the hydrophobic compounds to the polymer. It is preferably 30 to 100 wt %, more preferably 50 to 100 wt %. When monomers other than those represented by formula (I) are used, the amount of the repeating unit represented by formula (I) may vary as long as the copolymers thereof do not become water soluble. Preferably, the amount of the repeating unit represented by the formula (I) is 0 to 70 wt %, more preferably 0 to 50%.

When an acidic group-containing monomer is used as a copolymer component in the polymer of the invention, the amount thereof will vary depending on the kind of dye used, the mixing ratio of the dye to the polymer and the polarity of the acidic group-containing monomer. When the acidic group-containing monomer is hydrophilic, the total amount thereof is preferably 0 to 30 wt %, more preferably 0 to 15 wt %, based on the amount of the total polymer. When the acidic group-containing monomer is hydrophobic, the total amount thereof is preferably 0 to 70 wt %, more preferably 0 to 50 wt %, based on the amount of the total polymer.

Examples of water-insoluble and organic solvent-soluble polymer containing repeating unit (I) of the present invention are shown below, but the present invention is not limited thereby. The weight percentage of each component is shown in parenthesis.

P-1 M-2 homopolymer (100) (weight average molecular weight: 18,600)

P-2 M-3 homopolymer (100) (weight average molecular weight: 21,200)

P-3 M-4 homopolymer (100) (weight average molecular weight: 44,500)

P-4 M-9 homopolymer (100) (weight average molecular weight: 68,000)

P-5 M-12 homopolymer (100) (weight average molecular weight: 19,000)

P-6 M-14 homopolymer (100) (weight average molecular weight: 72,100)

P-7 M-1/M-2 copolymer (50/50) (weight average molecular weight: 116,000)

P-8 to P-10 M-1/methyl methacrylate copolymer (x/y)

P-8 :x/y=90/10 (weight average molecular weight: 58,000)

P-9: x/y=70/30 (weight average molecular weight: 76,600)

P-10: x/y=50/50 (weight average molecular weight: 81,800)

P-11 M-2/methyl methacrylate copolymer (80/20) (weight average molecular weight: 24,600)

P-12 and P-13 M-1/acrylic acid copolymer (x/y)

P-12: x/y=95/5 (weight average molecular weight: 16,800)

P-13: x/y=90/10 (weight average molecular weight: 17,100)

P-14 M-2/methacrylic acid copolymer (95/5) (weight average molecular weight: 21,200)

P-15 M-1/S-14 copolymer (70/30) (weight average molecular weight: 39,600)

P-16 to P-18 M-1/S-15 copolymer (x/y)

P-16: x/y=90/10 (weight average molecular weight: 32,100)

P-17: x/y=70/30 (weight average molecular weight: 34,600)

P-18: x/y=50/50 (weight average molecular weight: 40,500)

P-19 M-2/S-15 copolymer (70/30) (weight average molecular weight: 38,800)

P-20 M-10/butyl acrylate/S-13 copolymer (60/20/20) (weight average molecular weight: 42,500)

P-21 M-11/methyl acrylate/sodium 2-acrylamide-2-methylpropanesulfonate copolymer (60/37/3) (weight average molecular weight: 21,500)

P-22 M-2/M-10/methyl methacrylate/dodecyl methacrylate copolymer (50/10/30/10) (weight average molecular weight: 69,700)

P-23 M-4/benzyl methacrylate/S-8 copolymer (60/30/10) (weight average molecular weight: 43,000)

P-24 M-3/cyclohexyl methacrylate/2-hydroxyethyl methacrylate copolymer (50/30/20) (weight average molecular weight: 51,000)

P-25 M-1/butyl acrylate copolymer (60/40) (weight average molecular weight: 10,600)

P-26 M-16/ethyl methacrylate copolymer (50/50) (weight average molecular weight: 9,900)

P-27 M-2/M-16/butyl methacrylate/S-18 copolymer (40/20/20/20) (weight average molecular weight: 23,400)

P-28 M-18/t-butylacrylamide/methyl acrylate copolymer (60/20/20) (weight average molecular weight: 43,100)

P-29 M-2/butyl acrylate/n-acryloyl morpholine copolymer (50/40/10) (weight average molecular weight: 50,700)

It will be appreciated that one or more of the polymers of the present invention may be used in combination.

The molecular weight and polymerization degree of the polymer of the present invention do not substantially exert a large influence in the present invention. However, as the molecular weight increases, it is liable to increase the time needed to dissolve the polymer in an auxiliary solvent and it becomes difficult to emulsify and disperse the polymer because of a higher solution viscosity such that coarse particles are generated, which result in deteriorating the adsorption characteristic of dye and causing an inferior coating performance. The use of large amounts of the auxiliary solvent to decrease the viscosity of the solution leads to causing other problems. From the above point of view, the viscosity of the polymer is preferably 5000 cps or less, more preferably 2000 cps or less in terms of the viscosity obtained when 30 g of the polymer is dissolved in 100 ml of the auxiliary solvent. The number average molecular weight of the polymer in the present invention is preferably from 2,000 to 300,000, more preferably from 3,000 to 100,000.

The auxiliary solvent means an organic solvent to decrease the viscosity of the solution and to solve the crystal compounds in emulsifying and dispersing the polymer of the present invention (e.g., ethyl acetate, methyl acetate, butyl acetate, methyl ethyl ketone, cyclohexanone, chloroform, methylene chloride, benzene, toluene, xylene).

The ratio of the amount of polymer of the present invention to the amount of auxiliary solvent varies according to the polymer used. This ratio also varies over a wide range according to the solubility of the polymer to the auxiliary solvent, polymerization degree of the polymer, and the solubility of dye. In general, an amount of the solvent is used which is necessary to allow a solution prepared by dissolving both the hydrophobic compound and the polymer in the auxiliary solvent to have a viscosity low enough to readily be dispersed in water or a hydrophilic colloid aqueous solution. The higher the polymerization degree of the polymer, the higher the viscosity of the solution, and accordingly it is difficult to uniformly determine the ratio of the polymer to the auxiliary solvent regardless of the kind of the polymer. Preferably the ratio of the polymer to the solvent is within the range of 1:1 to 1:50 (weight ratio). The ratio of the polymer of the present invention to the dye is preferably 1:20 to 20:1, more preferably 1:10 to 10:1.

The hydrophobic compound may be any organic compound, organic or inorganic dye, or organic or inorganic pigment which is useful for photographic applications. Preferably, the hydrophobic compound is an oil soluble, organic photographic material, wherein the term "oil soluble" means that at least 3 wt % of the material dissolves in an organic solvent at room temperature (20° C.). The phrase "organic solvent" as that phrase is used herein is defined as the organic solvents described in Syozo Asahara et al., *Solvent Handbook* (Kodansya, 1976). Examples of organic solvents include methanol, ethanol, isopropanol, butanol, ethyl acetate, isopropyl acetate, butyl acetate, acetone, methyl ethyl ketone, tetrahydrofuran, cyclohexanone, benzene, toluene, dioxane, acetonitrile, dichloromethane, and chloroform.

The hydrophobic compounds capable of being used for the lipophilic fine dispersion according to the present invention are a dye image-forming coupler, a dye image-providing redox compound, an anti-stain agent, an anti-fogging agent, a UV absorber, an anti-fading agent, an anti-color mixing agent, a nucleus-forming agent, a dye image stabilizer, a silver halide solvent, a bleaching accelerator, a dye for a filter and the precursor thereof, a dye, and an oil for a dispersion and polymer for a dispersion which are used as a medium for dispersing them. Examples of these compounds are disclosed in *Research Disclosures* No. 17643 (December, 1978), No. 18716 (November, 1979) and No. 307105 (November, 1989).

Suitable dye image-forming coupler for the invention will now be described.

In general, a compound coupling with the oxidation product of an aromatic primary amine developing agent to form a colored or colorless dye is called a coupler. Yellow, magenta, cyan and black couplers are useful as the dye image-forming coupler in the present invention.

With regard to a yellow coupler, an oil protect type acyl acetoamide coupler is preferred. Examples of suitable yellow couplers are described in U.S. Pat. Nos. 2,407,210, 2,875,057, and 3,265,506. The yellow coupler may also be a diequivalent yellow coupler, for example, the oxygen atom-separating type yellow couplers described in U.S. Pat. Nos. 3,408,194, 3,447,928, 3,933,501, and 4,022,620, and the nitrogen atom-separating type yellow couplers described in JP-B-58-10739, U.S. Pat. Nos. 4,401,752 and 4,326,024, *Research Disclosure* No. 18053 (April, 1979), U.S. Pat. No. 1,425,020, and German Patent Publication Nos. 2219917, 2261361, 2329587, and 2433812. α-Pivaloyl acetanilide coupler has excellent fastness, particularly light fastness for a developed dye. Also, α-benzoyl acetanilide coupler provides high developing density.

Among the dye image forming couplers, preferred are the compounds described in U.S. Pat. Nos. 3,933,501, 4,022,620, 4,326,024, 4,401,752, and 4,248,961, JP-B-58-10739, British Patents 1425020 and 1476760, U.S. Pat. Nos. 3,973,968, 4,314,023, and 4,511,649, and EP-A-249473.

Examples of the magenta couplers for use in the present invention include the indazolone or cyanoacetolyl (preferably a pyrazoloazole such as 5-pyrazolone series and pyrazolotriazoles) coupler of an oil protect type. It is preferred in terms of hue and developing density, that the 3-position on the 5-pyrazolone coupler be substituted with an arylamino group or an acylamino group. Examples of this type of coupler are described in U.S. Pat. Nos. 2,311,082, 2,343,703, 2,600,788, 2,908,573, 3,062,653, 3,152,896, and 3,936,015. Preferred as the separating group of the 2-equivalent 5-pyrazolone coupler are the nitrogen atom-separating groups described in U.S. Pat. No. 4,310,619 or the arylthio groups described in U.S. Pat. No. 4,351,897. In case of the 5-pyrazolone couplers having a ballast group described in European Patent 73636, a high developing density can be obtained.

Examples of the pyrazoloazole couplers for use in the present invention include the pyrazolobenzimidazoles described in U.S. Pat. No. 3,369,879, pyrazolo[5,1-c][1,2,4]triazoles described in U.S. Pat. No. 3,725,067, and pyrazoloazoles described in *Research Disclosure* No. 24220 (June, 1984). Preferred, in terms of small subsidiary absorption of yellow in a developed dye and light fastness are imidazo[1,2-b]pyrazoles described in European Patent 119741 and pyrazolo[1,5-b][1,2,4]triazole described in European Patent 119860.

Of the pyrazoloazole couplers, more preferred are the compounds described in U.S. Pat. Nos. 4,310,619 and 4,351,897, European Patent 73636, U.S. Pat. Nos. 3,061,432 and 3,725,067, *Research Disclosure* No. 24220 (June, 1984), JP-A-60-33552, *Research Disclosure* No. 24230 (June, 1984), JP-A-60-43659, JP-A-61-72238, JP-A- 60-35730, JP-A-55-118034, and JP-A-60-185951, U.S. Pat. Nos. 4,500,630, 4,540,654, and 4,556,630, and International Patent Publication WO88/04795.

The oil protect type naphthol and phenol couplers are preferred as the cyan coupler for use in the present invention. Examples of the cyan couplers include the naphthol couplers described in U.S. Pat. No. 2,474,293, preferably the oxygen atom-separating type 2-equivalent naphthol couplers described in U.S. Pat. Nos. 4,052,212, 4,146,396, 4,228,233, and 4,296,200. Examples of the phenol coupler are described in U.S. Pat. Nos. 2,369,929, 2,801,171, 2,772,162, and 2,895,826. The cyan couplers having fastness against humidity and temperature are preferably used in the present invention. Examples thereof include: the phenol cyan couplers having an alkyl group higher than ethyl at the meta position of the phenol nucleus, as described in U.S. Pat. No. 3,772,002; the 2,5-diacylamino-substituted phenol couplers described in U.S. Pat. Nos. 2,772,162, 3,758,308, 4,126,396, 4,334,011, and 4,327,173, German Patent Publication No. 3329729 and JP-A-59-166956; and the phenol couplers having a phenylureido group at a 2-position thereof and an acylamino group at a 5-position thereof, described in U.S. Pat. Nos. 3,446,622, 4,333,999, 4,451,559, and 4,427,767.

The naphthol couplers substituted with a sulfonamide group or an amide group at a 5-position thereof are described in JP-A-60-237448, JP-A-61-153640, and JP-A-61-14557, because they have particularly excellent fastness in a developed color image. The pyrazoloazole couplers described in JP-A-64-553, JP-A-64-554, JP-A-64-555, and JP-A-64-556, and the imidazole couplers described in U.S. Pat. No. 4,818,672 are also suitable.

Among them, more preferred are the compounds described in U.S. Pat. Nos. 4,052,212, 4,146,396, 4,228,233, 4,296,200, 2,369,929, 2,801,171, 2,772,162, 2,895,826, 3,772,002, 3,758,308, 4,334,011, and 4,327,173, German Patent Publication No. 3329729, EP-A-121365, EP-A-249453, U.S. Pat. Nos. 3,446,622, 4,333,999, 4,775,616, 4,451,559, 4,427,767, 4,690,889, 4,254,212, and 4,296,199, and JP-A-61-42658.

Further examples of polymerized dye-forming couplers are described in U.S. Pat. Nos. 3,451,820, 4,080,211, 4,367,282, 4,409,320, and 4,576,910, British Patent 2102173, and EP-A-341188.

Preferred as a coupler capable of forming a dye having an appropriate dispersing property are the compounds described in U.S. Pat. No. 4,366,237, British Patent 2125570, European Patent 96,570, and German Patent Publication No. 3234533.

Preferred as a colored coupler used for correcting unnecessary absorption by a developed dye are the compounds described in *Research Disclosure* No. 17643 (December, 1978) and No. 307105 (November, 1989), U.S. Pat. No. 4,163,670, JP-B-57-39413, U.S. Pat. Nos. 4,004,929 and 4,138,258, and British Patent 1146368. Preferably used are the couplers which correct unnecessary absorption by a developed dye with a fluorescent dye released in coupling, described in U.S. Pat. No. 4,774,181, and the couplers having as a releasing group a dye precursor group capable of reacting with a developing agent to form a dye, described in U.S. Pat. No. 4,777,120.

The compounds releasing a photographically useful residue upon coupling are also preferably used in the present invention. Preferred as a DIR coupler which release a development inhibitor are the compounds described in the patents abstracted in above *Research Disclosure* No. 17643 and No. 307105, JP-A-57-151944, JP-A-57-154234, JP-A-60-184248, JP-A-63-37346, and JP-A-63-37350, and U.S. Pat. Nos. 4,248,962 and 4,782,012.

The bleaching agent-releasing couplers described in *Research Disclosure* No. 11449 (October, 1973) and No. 24241 (June, 1984) and JP-A-61-201247 are effective for shortening the time of a bleaching processing step. Preferred as a coupler releasing imagewise a nucleus-forming agent or a development accelerator in developing are the compounds described in British Patents 2,097,140 and 2,131,188, and JP-A-59-157638 and JP-A-59-170840. Also preferred are the compounds releasing a fogging agent, a development accelerator and a silver halide solvent upon an oxidation-reduction reaction with an oxidation product of a developing agent, described in JP-A-60-107029, JP-A-60-252340, JP-A-1-44940, and JP-A-1-45687.

Examples of the compounds used in the photographic material of the present invention include the competitive couplers described in U.S. Pat. No. 4,130,427; the polyequivalent couplers described in U.S. Pat. Nos. 4,283,472, 4,338,393 and 4,310,618; the DIR redox compound-releasing couplers, DIR coupler-releasing couplers, DIR coupler-releasing redox compounds or DIR redox-releasing redox compounds described in JP-A-60-185950 and JP-A-62-24252; the couplers releasing a dye whose color is recovered after splitting off, described in EP-A-173302 and EP-A-313308; the ligand-releasing couplers described in U.S. Pat. No. 4,555,477; the couplers releasing a leuco dye, described in JP-A-63-75747; and the couplers releasing a fluorescent dye, described in U.S. Pat. No. 4,774,181.

Two or more kinds of the above couplers and others can be used in combination in the same layer in order to satisfy the particular characteristics of a photographic material.

The dye image-providing redox compound will now be described.

A dye image-providing redox compound used in a color diffusion transfer photographic material can be the hydrophobic compound of the present invention. As is conventionally known this compound may be a negative type or positive type. When it is processed in an alkaline processing composition, it is initially mobile or immobile in a photographic element.

A coupler reacting with an oxidized color developing agent to form or release a dye may be the negative type dye image-providing compound useful for the present invention, and examples thereof are described in U.S. Pat. No. 3,227,550 and Canadian Patent 602,207.

The negative type dye image-providing compound preferably used in the present invention is a dye-releasing redox compound which reacts with an oxidized developing agent or an electron transfer agent to release a dye. Examples thereof are described in JP-A-48-33826, JP-A-51-113624, JP-A-54-54021, and JP-A-56-71072. The immobile positive type dye image-providing compound capable of being used in the present invention may be the compounds which release a diffusible dye without receiving an electron (that is, without being reduced) or after receiving at least one electron (that is, being reduced) during photographic processing at alkaline conditions.

The positive type dye image-providing compound may be a dye developing agent which is mobile at an alkaline photographic processing conditions. Examples thereof are described in JP-B-48-32130 and JP-B-55-22780. Dye formed from the dye image-providing compound used in the present invention may be a completed dye or a dye precursor which can be converted to a dye during a photographic processing step or during an additional processing stage, and a finished image dye may be unmetallized. Representative dyes which are useful in the present invention include an azo dye, an azomethine dye, an anthraquinone dye, and a metallized or nonmetallized phthalocyanine dye. The azo type cyan, magenta and yellow dyes are most preferred.

A dye-releasing redox compound having a dye portion which temporarily shifts ray absorption in a light-sensitive element can be used as well in the present invention as one kind of a dye precursor.

Examples of dye-releasing redox compounds are described in above mentioned JP-A-48-33826, JP-A-51-113624, JP-A-54-54021, and JP-A-56-71072. The following compounds are examples of- the redox primary nucleus which may be subjected to a cross-oxidation to release a diffusible dye in an alkaline condition which are suitable for use in the invention:

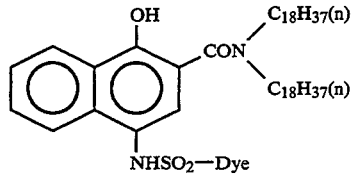

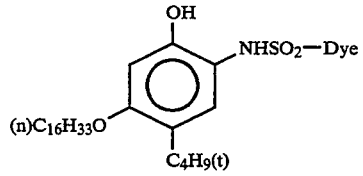

Compounds which are a positive type are particularly preferred dye image-providing compounds in accordance with the invention and they are described in JP-A-53-110827, JP-A-53-110828, and JP-A-56-164342. The following compounds are examples of the redox primary nucleus of this type:

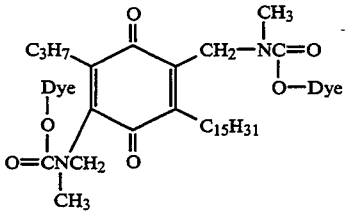

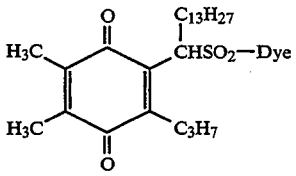

Further examples of dye-releasing redox compounds for use in the present invention include the compounds described in JP-A-61-251841 (DR-1 to DR-14 described at pages 23 to 25).

The use of a UV absorber as the hydrophobic compound will now be described.

UV absorbers used in the present invention are described in, for example, JP-B-42-21687, JP-B-48-5496, JP-A-47-1026, and British Patent 1293982. An oil soluble UV absorber is more preferred.

The use of an organic or inorganic dye as the hydrophobic compound will now be described.

The dye or pigment used in the present invention include organic dyes and pigments or inorganic dyes and pigments, such as azo dyes and pigments, azomethine dyes and pigments, oxonol dyes and pigments, cyanine dyes and pigments, phthalocyanine dyes and pigments, quinazolidone dyes and pigments, anthraquinone dyes and pigments, dioxazine dyes and pigments, indigo dyes and pigments, perinone/perylene dyes and pigments, titanium oxide dyes and pigments, cadmium dyes and pigments, iron oxide dyes and pigments, chromium oxide dyes and pigments, and carbon black. In addition to the above, there can be used any dye or mixtures thereof conventionally used as a coloring agent. In the present invention, the dyes and pigments can be used in any form such as an aqueous paste obtained immediately after dye or pigment preparation, or a powder. In particular, the present invention is useful for dispersing the oil soluble dyes described in U.S. Pat. No. 4,420,555, and JP-A-61-204630 and JP-A-61-205934.

Oil soluble dyes are particularly useful in the present invention as will be explained below.

The oil soluble dye used in the present invention may be any of various conventional dyes. These dyes include an allylidene compound, a heterocyclic allylidene compound, anthraquinones, triarylmethanes, an azomethine dye, an azo dye, a cyanine dye, a merocyanine dye, an oxonol dye, a styryl dye, a phthalocyanine dye, indigo, and others. The dyes used in the present invention are insoluble in water and preferably have a solubility of 10 g/liter or more (at 40° C.) in ethyl acetate. The structure of a chromophore is not important. These dyes are described below.

An allylidene compound is a compound in which an acidic nucleus and an aryl group are combined via one or plural methine groups.

The acidic group may be 2-pyrazoline-5-one, 2-isoxazoline-5-one, barbituric acid, 2-thiobarbituric acid, benzoylacetonitrile, cyanoacetoamide, cyanoacetanilide, cyanoacetic acid ester, malonic acid ester, malondianilide, dimedone, benzoylacetoanilide, pivaloylacetoanilide, malononitrile, 1,2-dihydro-6-hydroxypyridine-2-one, pyrazolidine-3,5-dione, pyrazolo[3,4-b]-pyridine-3,6-dione, indane-1,3-dione, hydantoin, thiohydantoin, and 2,5-dihydro-furan-2-one.

The aryl group may be phenyl and this is preferably substituted with an electron-providing group such as an alkoxy group, a hydroxy group, and an amino group.

A heterocyclic allylidene compound is a compound in which an acidic nucleus and a heteroaromatic ring are combined via one or plural methine groups.

The acidic group of the heterocyclic allylidene compound may be one of the acidic groups discussed above in connection with the allylidene compound.

The heteroaromatic ring may be pyrrole, indole, furan, thiophene, pyrazole, and coumarin.

Anthraquinones are compounds in which an electron-providing group or an electron attractive group is substituted to anthraquinone.

Triarylmethanes are compounds in which three substituted aryl groups (which may be the same or different) are bonded to one methine group. For example, the triarylmethane may be phenolphthalein.

Azomethine dye is a compound in which an acidic nucleus and an aryl group are combined via an unsaturated nitrogen linkage group (an azomethine group). The acidic nucleus may be an acidic group as described above in connection the allylidene compound and further includes those conventionally known as a photographic coupler. The azomethine dye may be indoanilines.

Azo dye is a compound in which an aryl group or a heteroaromatic ring is combined via an azo group.

Cyanine dye is a compound in which two base nuclei are combined via one or plural methine groups. The base nucleus may be quaternary salts of oxazole, benzoxazole, thiazole, benzothiazole, benzimidazole, quinoline, pyridine, indolenine, benzindolenine, benzoselenazole, imidazoquinoxaline and pyrylium.

Merocyanine dye is a compound in which an above described base nucleus and acidic nucleus are combined via a double bond or one or more methine groups.

Oxonol dye is a compound in which two of the above described acidic nuclei are combined via one or more odd methine groups.

Styryl dye is a compound in which the above described base nucleus and an aryl group are combined via two or four methine groups.

The phthalocyanine dye may or may not be coordinated with metal.

Indigo may be substituted or unsubstituted indigo and includes thioindigo.

The dyes used in the present invention must be decolored and/or eluted by photographic processing and this requires that the dyes have preferably a dissociative group. A carboxyl group and a hydroxyl group are preferred as the dissociation group and more preferred are a sulfonamide group, a sulfamoyl group, an acylsulfamoyl group, a sulfonylcarbamoyl group, and a sulfonimide group.

The dye used in the present invention is preferably a dye represented by formula (II) depicted above. Formula (II) will be explained in detail.

The electron attractive groups of X and Y each individually represents a cyano group, a nitro group, an alkoxycarbonyl group (for example, methoxycarbonyl, ethoxycarbonyl, hydroxyethoxycarbonyl, t-amyloxycarbonyl), an aryloxycarbonyl group (for example, phenoxycarbonyl, 4-methoxycarbonyl), an acyl group (for example, acetyl, pivaloyl, benzoyl, propionyl, 4-methanesulfonamidebenzoyl, 4-methoxy-3-methanesulfonamidebenzoyl, 1-methylcyclopropylcarbonyl), a carbamoyl group (for example, N-ethylcarbamoyl, N,N-dimethylcarbamoyl, piperidine-1-ylcarbonyl, N-(3-methanesulfonamidephenyl)carbamoyl), and a sulfonyl group (for example, benzenesulfonyl, p-toluenesulfonyl). A 5- or 6-membered ring is preferred as the acidic nucleus formed by combining X and Y. Preferred as the 5-membered ring are 2-pyrazoline-5-one, 2-isoxazoline-5-one, pyrazolidine-3,5-dione, 2,5-dihydrofuran-2-one, and indane-1,3-dione. Preferred as the 6-membered ring are 1,2-dihydro-6-hydroxypyridine-2-one, barbituric acid, and thiobarbituric acid.

The phenyl group of Ar is preferably a phenyl group substituted with an electron-providing group. Preferred as the electron-providing group are a dialkylamino group (for example, dimethylamino, di(ethoxycarbonylmethyl)amino, di(butoxycarbonylmethyl)amino, N-ethyl-N-ethoxycarbonylmethylamino, di(cyanoethyl-)amino, piperidinyl, pirrolidinyl, morpholino, N-ethyl-N-β-methanesulfonamidethylamino, N-ethyl-N-β-hydroxyethylamino), a hydroxyl group, and an alkoxy group (for example, methoxy, ethoxy, ethoxycarbonylmethoxy).

A 5-membered heterocyclic ring is preferred as the heterocyclic group represented by Ar and more preferred are pyrrole, indole, furan, and thiophene.

The methine group of $L^1$, $L^2$ and $L^3$ may be substituted but an unsubstituted methine group is preferred.

The dye represented by formula (III) is particularly preferred oil soluble dye used in the present invention. Formula (III) will be explained in detail.

The alkyl group of $R^{21}$ is preferably an alkyl group having from 1 to 8 carbon atoms such as methyl, ethyl, propyl, tert-butyl, normal-butyl, 1-methylcyclopropyl, chloromethyl, trifluoromethyl, and ethoxycarbonylmethyl.

The aryl group of $R^{21}$ is preferably an aryl group having from 6 to 13 carbon atoms such as phenyl, 4-methoxyphenyl, 4-acetylaminophenyl, 4-methanesulfonamidephenyl, and 4-benzenesulfonamidephenyl.

The alkyl group of $R^{22}$ is preferably an alkyl group having from 1 to 18 carbon atoms such as methyl, 2-cyanoethyl, 2-hydroxyethyl, and 2-acetoxyethyl.

The aryl group of $R^{22}$ is preferably an aryl group having from 6 to 22 carbon atoms such as phenyl, 2-methoxy-5-ethoxycarbonylphenyl, 3,5-di (ethoxycarbonyl)phenyl, 4-di(ethoxycarbonylmethyl)aminocarbonylphenyl, 4-normaloctyloxycarbonylphenyl, 4-butanesulfonamidecarbonylphenyl, 4-methanesulfonamidecarbonylphenyl, 3-sulfamoylphenyl, 4-methanesulfonamidephenyl, 4-methanesulfonamidesulfonylphenyl, 4-acetylsulfamoylphenyl, 4-propionylsulfamoylphenyl, and 4-N-ethylcarbamoylsulfamoylphenyl.

The heterocyclic group of $R^{22}$ is preferably pyridyl, 4-hydroxy-6-methylpyrimidine-2-yl, 4-hydroxy-6-tert-butylpyrimidine-2-yl and sulfolane-3-yl.

The alkyl group of $R^{23}$, $R^{24}$ and $R^{25}$ is preferably an alkyl group having from 1 to 6 carbon atoms such as methyl, ethyl and propyl. A methyl group is more preferred.

The aryl group of $R^{23}$, $R^{24}$ and $R^{25}$ is preferably an aryl group having from 6 to 13 carbon atoms. A phenyl group is more preferred.

The 6-membered ring formed by $R^{24}$ and $R^{25}$ may be any suitable saturated, unsaturated or heterocyclic rings. A benzene ring is more preferred.

The alkyl group of $R^{26}$ is preferably an alkyl group having from 1 to 18 carbon atoms. Preferred are methyl, ethyl, ethoxycarbonylmethyl, tert-butoxycarbonylmethyl, ethoxycarbonylethyl, dimethylaminomethyl, 2-cyanoethyl, 3-acetoamidepropyl, 3-propionylaminopropyl, 3-benzenesulfonamidepropyl and 3-propanesulfonamidepropyl.

The aryl group of $R^{26}$ is preferably an aryl group having from 6 to 22 carbon atoms such as phenyl, 2-methoxy-5-ethoxycarbonylphenyl, 4-di(ethoxycarbonylmethyl)aminocarbonylphenyl, 4-normal-octyloxycarbonylphenyl, 4-hydroxyethoxycarbonylphenyl, 4-propanesulfonamidephenyl, 4-butanesulfonamidecarbonylphenyl, 4-methanesulfonamidecarbonylphenyl, 4-acetylsulfamoylphenyl and 4-methanesulfonamidephenyl.

The amino group of $R^{26}$ is preferably a dialkylamino group such as dimethylamino and diethylamino.

The alkyl group of $R^{27}$ and $R^{28}$ is preferably an alkyl group having from 1 to 12 carbon atoms such as methyl, ethyl, octyl, dodecyl, cyclohexyl, ethoxycarbonylmethyl, ethoxycarbonylethyl, 2-hydroxyethyl, 2-ethoxyethyl, 2-methanesulfonamidethyl, cyanoethyl, 2,2,3,3-tetrafluoropropyl, chloroethyl, bromoethyl, acetoxyethyl and dimethylaminoethyl.

The aryl group of $R^{27}$ and $R^{28}$ is preferably an aryl group having from 6 to 12 carbon atoms such as phenyl, 4-methoxyphenyl and 3-methylphenyl.

Compounds represented by formula (III) preferably do not have a sulfo group, a salt of a sulfo group and a salt of a carboxyl group as a substituent.

Compounds represented by formula (III) preferably have a dissociative group other than the above groups which may be dissociative. The preferred additional dissociative groups are a sulfonamide group, a sulfamoyl group, an acylsulfamoyl group, a sulfonylcarbamoyl group, a sulfonimide group, a carbamoylsulfamoyl group and a carboxy group.

The following are examples of dyes which are suitable for use in the invention. It will be understood that other suitable dyes will be apparent to one skilled in the art. The dyes include:

D-1

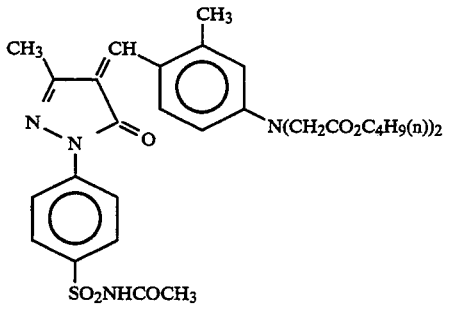

D-2

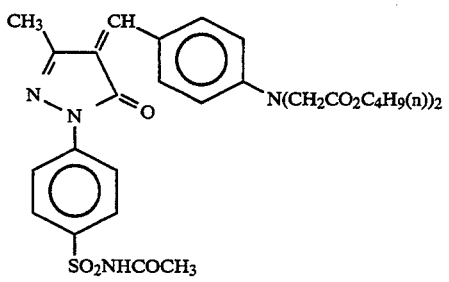

D-3

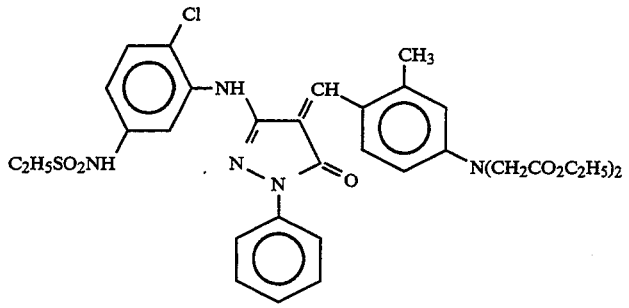

D-4

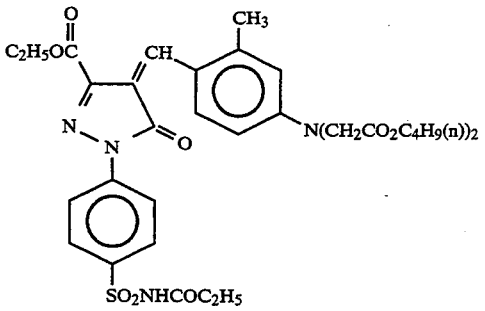

D-5

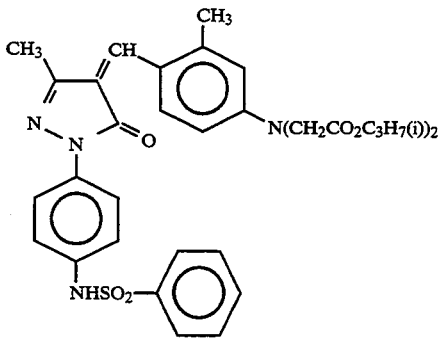

D-6

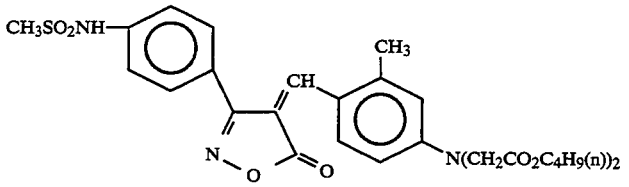

D-7

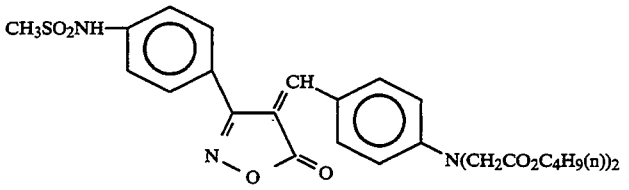

-continued
D-8
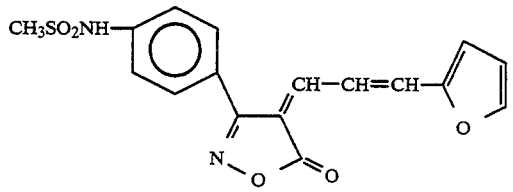
D-9
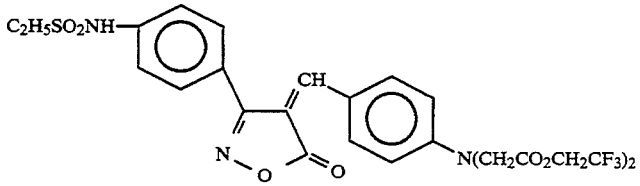
D-10
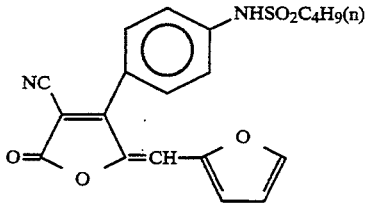
D-11
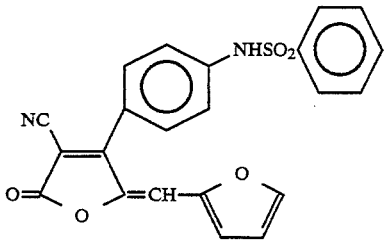
D-12
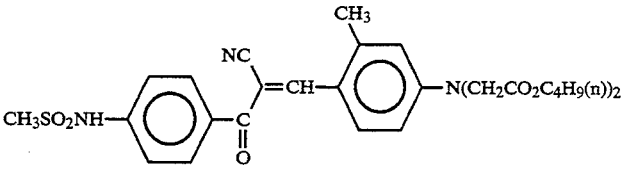
D-13
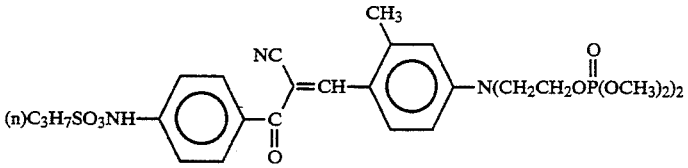
D-14
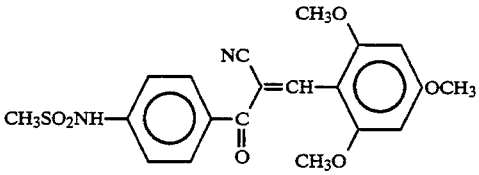
D-15
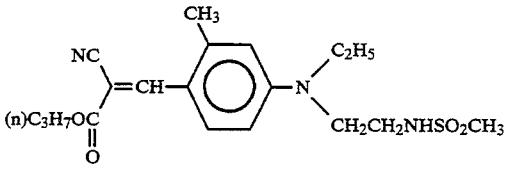
D-16
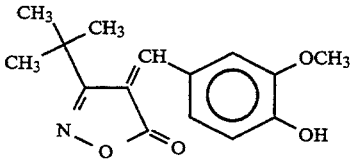
D-17
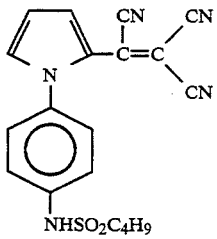

-continued
D-18
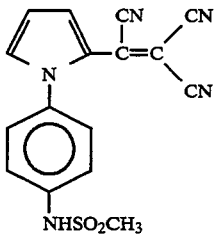
D-19
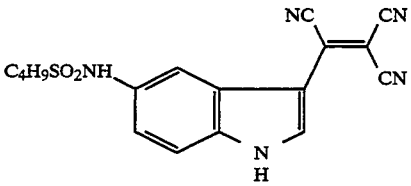
D-20
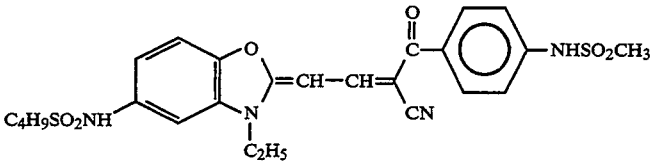
D-21
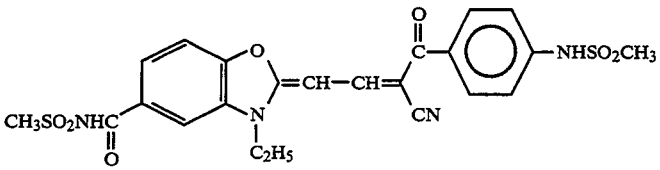
D-22
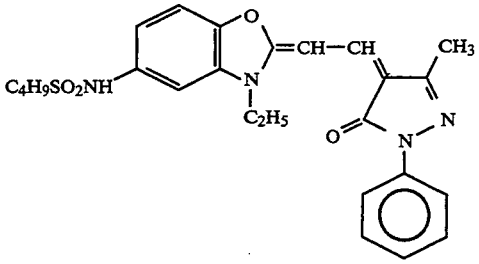
D-23
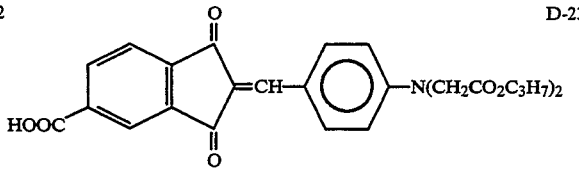
D-24
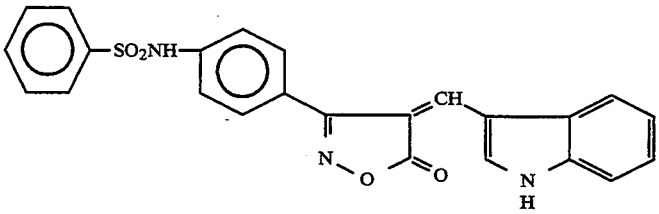
D-25
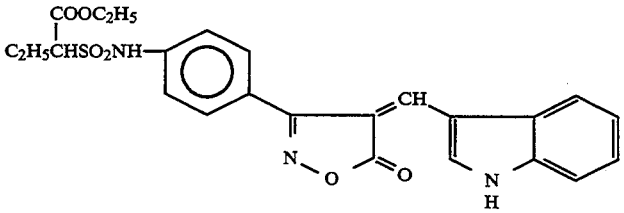
D-26
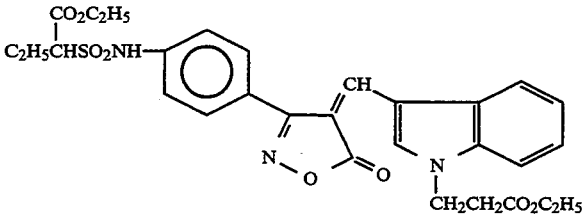

-continued
D-27
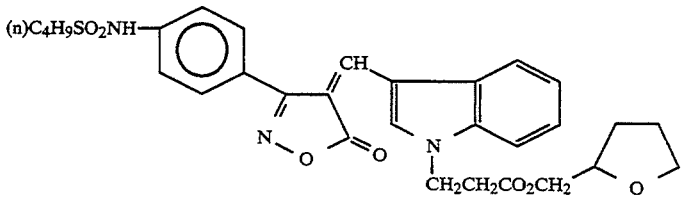
D-28
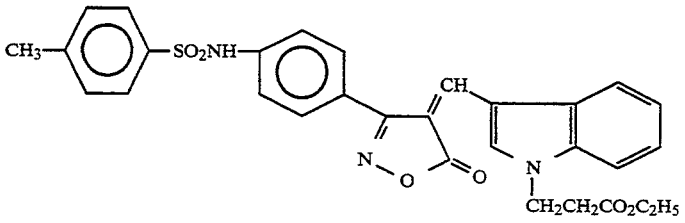
D-29
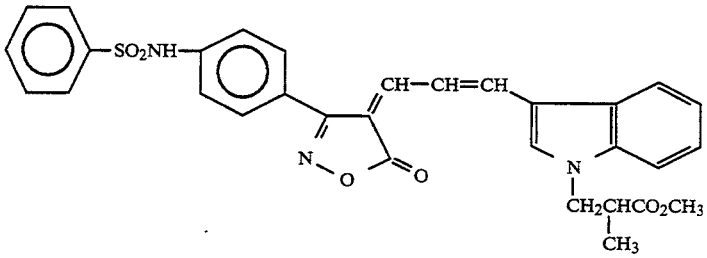
D-30
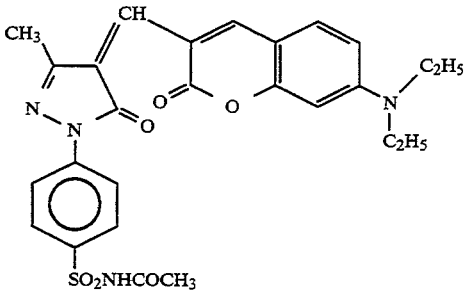
D-31
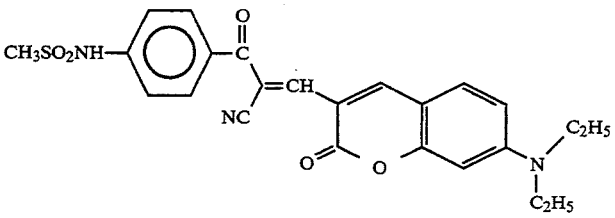
D-32
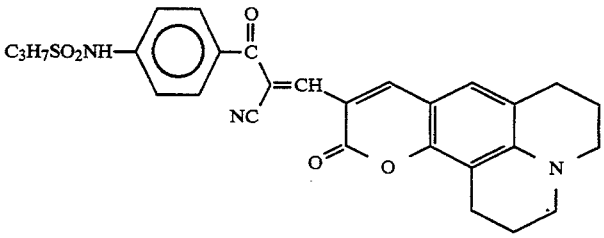

-continued

D-33

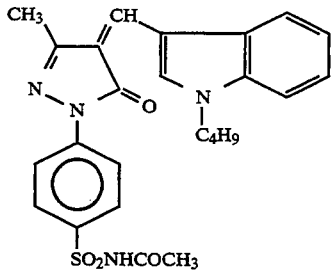

D-34

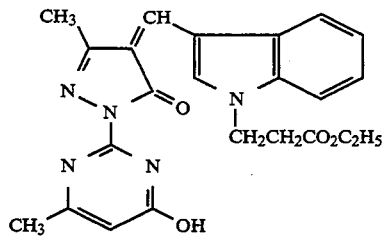

Other hydrophobic compounds may suitably be used in the present invention and include the electron-providing materials (hereinafter referred to as "ED") which can give at least one electron to an oxidation type dye-providing compound or the oxidation product of a color developing agent. Suitable ED are compounds having at least a partial structure according to Kendall-Pliz as described in *The Theory of the Photographic Process* written by T. H. James, the fourth edition, Chapter 11. Compounds belonging to this group include hydroquinones, catechols, o-aminophenols, and p-aminophenols. The ED used in the present invention preferably has low dispersibility when it is incorporated into a light-sensitive material layer. Hydroquinones and pyrogallols each having low dispersibility or non-dispersibility are widely used as an anti-color mixing agent, an anti-oxidation agent and an anti-fading agent and these may be used as the hydrophobic compound. Examples of these compounds include 2,5-di-n-octylhydroquinone, 2,5-di-t-pentadecylhydroquinone, n-dodecyl gallate, and p-laurylamidepyrogallol.

As an ED precursor compound suitable for use in combination with a positive type dye image-providing compound can be used in the present invention. Examples thereof include the saccharin compounds described in U.S. Pat. No. 4,263,393 and the active methine compounds described in U.S. Pat. No. 4,278,750.

Other suitable hydrophobic compounds which can be used in the present invention include: an anti-fogging agent; a development inhibitor such as mercaptotetrazoles, mercaptotriazoles, mercaptopyrimidines, mercaptobenzimidazoles, mercaptothidiazoles, benzotriazoles, and imidazoles; a developing agent such as p-phenylenediamines, hydroquinones, and p-aminophenols; an auxiliary developing agent such as pyrazolidones; a nucleus-forming agent such as hydrazines and hydrazides; a silver halide solvent such as hypo; a bleaching accelerator such as aminoalkylthiols; and dyes such as an azo dye and an azomethine dye. Precursors of the above hydrophobic compounds, hydrophobic compounds having a redox function in which the above hydrophobic compounds are released, for example, DIR- or DAR-hydroquinones, are also suitable hydrophobic compounds in accordance with the present invention. The hydrophobic compounds mentioned above may be bonded via a timing group. The timing group includes those groups releasing a photographically useful material by an intermolecular cyclization reaction, as described in JP-A-54-145135, those releasing a photographically useful material by an intermolecular electron transfer, as described in British Patent 2072363 and JP-A-57-154234, those releasing a photographically useful material accompanied with the desorption of carbon dioxide gas, as described in JP-A-57-179842, and those releasing a photographically useful material accompanied with the desorption of formalin, as described in JP-A-59-93442.

The oil component for dispersing the hydrophobic compound and the polymer will now be described.

A material which is substantially insoluble in water and has a boiling point of 190° C. or higher at a normal pressure is preferred as the high boiling point organic material (an oil component for dispersion) used for controlling a crystal deposition when the hydrophobic compound is finely dispersed in an aqueous medium. Examples of the organic material can be selected from carboxylic acid esters, phosphoric acid esters, carboxylic amides, ethers, phenols, anilines, substituted hydrocarbons, and surface-inactive hydrophobic organic polymers. Specific examples of the organic material include di-n-butyl phthalate, diisooctyl phthalate, dicyclohexyl phthalate, dimethoxyethyl phthalate, di-n-butyl adipate, diisooctyl azelate, tri-n-butyl citrate, butyl laurate, di-n-butyl sebacate, tricyclohexyl phosphate, tri-n-butyl phosphate, triisooctyl phosphate, N,N-diethylcaprylic amide, N,N-dimethylpalmitic amide, n-butyl-(m-pentadecyl)phenyl ether, ethyl-(2,4-di-tert-butyl)phenyl ether, 2,5-di-tert-amylphenol, 2-n-butoxy-5-tert-octylaniline, cholorinated paraffin, poly(-methyl methacrylate), poly(ethyl methacrylate), poly-(ethyl acrylate), poly(cyclohexyl methacrylate), poly(N-tertbutylacrylamide), and poly(N-tert-octylacrylamide).

A low boiling point organic solvent, i.e. having a boiling point of 130° C. or lower at one atmospheric pressure, which is not miscible with water, or a water miscible organic solvent may be used in addition to the high boiling point solvent in order to dissolve the hydrophobic compound. In order to increase the stability of the dispersion obtained, the water immiscible or water miscible organic solvent used for converting the photographically useful material to the form of a solution may be removed by distillation, more preferably distillation at a reduced pressure or ultrafiltration, and other conventionally known methods.

Examples of organic-solvents suitable for use in the present invention include propylene carbonate, methyl acetate, ethyl acetate, isopropyl acetate, butyl acetate, ethyl-propionic acid ester, secbutyl alcohol, methyl ethyl ketone, 2-pentanone, 3-pentanone, cyclohexanone, dimethylformamide, and dimethylsulfoxide. The organic solvent is preferably used at levels of 0.1 to 100 times the weight of the hydrophobic compound to be dispersed.

The hydrophobic compound in accordance with the invention is preferably dispersed in the form of lipophilic fine particles, which may be spherical or formless, the particles having an average particle size of from 1 μm to 20 nm. In particular, they are used preferably in the form of an aqueous dispersion.

The lipophilic fine particles according to the present invention can be prepared by mixing the hydrophobic compound in the form of a water solution or a hydrophilic colloid aqueous solution by any of the following methods in the presence of the polymer according to the present invention. A disperser which will be described later may be used in order to reduce the size of the dispersed particles, if necessary.

A high speed agitation type disperser having a large shearing force and a disperser providing high strength supersonic wave -energy may be employed as emulsifying equipment for the present invention. For example, the following may be utilized: a colloid mill, a homogenizer, capillary-type emulsifying equipment, a liquid siren, an electromagnetic distortion type supersonic wave generator, and emulsifying equipment having a Pallman's whistle. The high speed agitation type disperser preferably used in the present invention is a disperser in which an element having a dispersing action is rotated at a high speed (500 to 15,000 rpm, preferably 2,000 to 4,000 rpm) in a solution. These types of dispersers include: a dissolver, a politron, a homomixer, a homoblender, a kedimill and a jet agitator. The high speed agitation type disperser used in the present invention is called a dissolver or a high speed impeller disperser and is one preferred example in which an impeller prepared by alternately folding sawtooth blades in a vertical direction is located on an axis and is at a high speed, as described in JP-A-55-129136.

Various processes can be used to form the dispersion (hereinafter referred to as "an aqueous dispersion") of the lipophilic fine particles containing the hydrophobic compound according to the present invention. When the hydrophobic compound is dissolved in an organic solvent, it may be dissolved in a mixture of one or more of the above mentioned high boiling point organic materials and a water immiscible low boiling point organic solvent or water miscible organic solvent and then, the solution is dispersed in water or a hydrophilic colloid aqueous solution in the presence of the polymer represented by formula (I) according to the present invention. In this case, the polymer of the present invention coexists in the solution containing the hydrophobic compound or water and/or a hydrophilic colloid aqueous solution.

Either a so-called "regular mixing method", in which an oily liquid is added to an aqueous liquid under stirring, or a reverse mixing method, in which the aqueous liquid is added to the oily liquid, can be used for mixing the oily liquid containing the hydrophobic compound and the aqueous liquid containing the polymer. Preferably, a phase conversion method, which is one kind of the reverse mixing method is employed in order to obtain an aqueous dispersion containing fine particles.

The amount of the polymer used in the present invention varies according to the particular hydrophobic compound, high boiling point organic solvent, low boiling point organic solvent, water miscible organic solvent, and surface active agent (if used), and the amounts of the foregoing components. Preferably, the polymer is present in the dispersion in an amount within the range 0.1 to 500 wt %, preferably 50 to 300 wt %, based on the total weight of the dispersion, that is, the hydrophobic compound, high boiling point organic solvent and water immiscible organic solvent, if used.

In the present invention, the hydrophobic compound can be stably dispersed in either water or a hydrophilic colloid composition, and it is dispersed preferably in the hydrophilic colloid composition.

A binder or protective colloid usually used for a silver halide photographic material can be used as the hydrophilic colloid containing the hydrophilic colloid composition of the present invention.

Gelatin is preferably used as a binder or protective colloid for the photographic emulsion of the invention. In addition to gelatin, other hydrophilic colloids can be used as well. For example, the following may be employed proteins, such as a gelatin derivative, a graft polymer of gelatin and the other polymers, albumin, and casein; cellulose derivatives, such as hydroxyethyl cellulose, caboxymethyl cellulose and cellulose sulfuric acid esters; sucrose derivatives, such as sodium alginate and a starch derivative; and various synthetic hydrophilic polymers, such as homopolymers and copolymers-of vinyl alcohol, partially acetalized vinyl alcohol, N-vinylpyrrolidone, acrylic acid, methacrylic acid, acrylamide, vinylimidazole, and vinylpyrazole.

The gelatin may be lime-treated gelatin, acid-treated gelatin, a gelatin hydrolysis product or a gelatin enzyme-decomposed product. The gelatin derivative may be compounds obtained by reacting gelatin with various compounds, such as acid halide, acid anhydride, isocyanates, bromoacetic acid, alkane saltons, vinylsulfon amides, maleinimide compounds, polyalkylene oxides and epoxy compounds.

An oil soluble dye may be used as a filter dye or an anti-halation dye. Preferably an amount of the oil soluble dye is used so that an optical density is from 0.05 to 3.5. An addition timing of the filter dye or the anti-halation dye may be at any step before coating.

The amount of the dye varies according to the particular dye, polymer dispersed and dispersing method. In general, the preferred amount of dye is from $10^{-3}$ to 3.0 $g/m^2$, more preferably from $10^{-3}$ to 1.0 $g/m^2$.

The dispersion of the hydrophobic compound and polymer according to the present invention can be incorporated into any suitable layer of a photographic material. That is, it can be added to a subbing layer, an anti-halation layer present between a silver halide emulsion layer and a support, a silver halide emulsion layer, a color developing agent layer, an intermediate layer, a protective layer, a back layer present on the support side opposite to the silver halide emulsion layer, and hydrophilic colloid contained in any other auxiliary layers.

It may be added not only to a single layer but also to more than one layer of a layered photographic material, or more than one dispersion in accordance with the invention may be added to a single layer or more than one layer independently or in the form of a mixture.

The dispersion according to the present invention can be used in combination with other various photographically useful compounds (for example, a dye), a water soluble photographically useful compound adsorbed on a mordant, a solid —matter fine particle dispersion, or the dispersion of a hydrophobic compound which does not contain the polymer of the present invention, according to necessity.

The dispersion of the hydrophobic compound according to the present invention can be used for any type of photographic material. These materials include: black and white photographic material, such as black and white film, X-ray film, plate making film, black and white photographic paper, micro film color photographic material, such as color negative film, color reversal film, color positive film, color photographic paper, and color reversal photographic paper.

A silver halide emulsion usually used in this field may be applied to the silver halide photographic material of the present invention. The silver halide emulsions described in, for example, JP-A-3-13936 and JP-A-3-13937 may be used in the invention. Moreover, the silver halide emulsions, the layer structures of the photographic materials containing them, the additives, the support therefor, the processing method therefor, and the exposing method each described on the eighth line in the right lower column at page 8 to the ninth line in the left upper column at page 15 of JP-A-3-13936, may be utilized in the present invention.

The photographic material of the present invention may comprise a support with at least one of silver halide emulsion layer including a blue-sensitive layer, a green-sensitive layer and a red-sensitive layer and any suitable number and order of silver halide emulsion layers and non-light-sensitive layers may be utilized. For example, the material of the invention may include a support having at least one light-sensitive layer thereon, the layer including numerous silver halide emulsion layers having substantially the same spectral sensitivity but different light sensitivities, wherein each light-sensitive layer is a unit light-sensitive layer having spectral sensitivity to any of blue light, green light and red light. In a multilayer silver halide color photographic material, the unit light-sensitive layer is usually provided in the following order: a red-sensitive layer, a green-sensitive layer and a blue-sensitive layer, from the support side. However, if desired, the above order may be varied, or a layer having a different light sensitivity may be interposed between layers having the same spectral sensitivity.

Various non-light-sensitive layers, such as an intermediate layer, may be provided between the silver halide light-sensitive layers and on the uppermost layer or lowest layer.

The intermediate layer may contain the couplers and DIR compounds described in JP-A-61-43748, JP-A-59-113438, JP-A-59-113440, JP-A-61-20037, and JP-A-61-20038 and may further contain a conventional anti-color mixing agent.

Preferably a two layer structure including a high-sensitivity emulsion layer and a low-sensitivity emulsion layer, as described in German Patent 1121470 or British Patent 923045, is utilized in the present invention. These layers are preferably provided so that the sensitivities become lower as the layers become closer to the support. A non-light-sensitive layer may be provided between the respective silver halide emulsion layers. A low sensitive layer may be provided on the side farther from the support and a high sensitive layer may be provided on the side closer to the support, as described in JP-A-57-112751, JP-A-62-200350, JP-A-62-206541, and JP-A-62-206543.

Examples of suitable light sensitive layer arrangements include (arranged from the side farthest from the support): a low blue-sensitive layer (BL)/a high blue-sensitive layer (BH)/a high green-sensitive layer (GH)/a low green-sensitive layer (GL)/a high red-sensitive layer (RH)/a low red-sensitive layer (RL); BH/BL/GL/GH/RH/RL; or BH/BL/GH/GL/RL/RH.

Alternatively, the layers can be provided from the side farthest from the support in the order of: a blue-sensitive layer/GH/RH/GL/RL, as described in JP-B-55-34932; or the layers can also be provided from the side farthest from the support in the order of a blue-sensitive layer/GL/RL/GH/RH, as described in JP-A-56-25738 and JP-A-62-63936.

Three layers, each having different light sensitivities which decrease in a direction toward a support, may be included in the photographic material of the invention. If so, a highest light-sensitive silver halide emulsion layer is provided on the uppermost side, a middle light-sensitive silver halide emulsion layer having a lower light sensitivity than the layer on the uppermost side is provided as an intermediate, and a light-sensitive silver halide emulsion layer having a further lower light sensitivity than that of the intermediate layer is provided on a lower side, as described in JP-B-49-15495. Also, if layers having different light sensitivities are utilized in the invention, the layers may be arranged with a middle light-sensitive emulsion furthest away from a support, a middle high light-sensitive emulsion and a low light-sensitive layer closest to the support, as described in JP-A-59-202464.

Alternatively, the layers may be provided in the order of (from the farthest to the closest to the support): a high sensitive emulsion layer/a low sensitive emulsion layer/a middle sensitive emulsion layer; or a low sensitive emulsion layer/a middle sensitive emulsion layer/a high sensitive emulsion layer. However, with regard to all the layer arrangements discussed above, the order may be varied, if desired.

In order to improve color reproduction of the photographic materials of the invention, a donor layer (DL) having an interlayer effect, which has a different spectral sensitivity distribution from the primary light-sensitive layers, such as BL, GL and RL is preferably provided adjacently or closely to the primary light-sensitive layers, as described in U.S. Pat. Nos. 4,663,271, 4,705,744, and 4,707,436, JP-A-62-160448 and JP-A-63-89850.

Some possible layer structures are described above, but it will be appreciated that various layer structures and arrangements can be employed in the present invention according to the results desired.

Examples of silver halide emulsions used in the present invention include silver bromide, silver bromoiodide, silver bromochloroiodide, silver bromochloride, silver chloride and silver chloroiodide.

Preferred silver halide contained in the photographic material of the present invention is silver bromoiodide, silver chloroiodide or silver bromochloroiodide, each containing up to 30 mole % of silver iodide. Particularly preferred is silver bromoiodide or silver bromochloroiodide each containing up to 2 to 10 mole % of silver iodide.

The silver halide grains contained in a photographic emulsion utilized in the present invention may be a regular crystal such as cube, octahedron or tetradecahedron, an irregular crystal such as sphere and or plate, a defective crystal such as a twinning plane, or a combination thereof.

The silver halide may be fine grains, i.e., having a size up to about 0.2 μm, or large grains, i.e., having a diameter corresponding to the circle of the projected area of up to about 10 μm. The silver halide emulsion may be either polydispersed or monodispersed.

Silver halide photographic emulsion suitable for use in the present invention can be prepared by the methods described in, for example, *Research Disclosure* No. 17643 (December, 1978), pp. 22–23, "I. Emulsion Preparation and Types", No. 18716 (November, 1979), p. 648, and No. 307105 (November, 1989), pp. 863–865, *Chimie et Physique Photographique* written by P. Glafkides (published by Paul Montel Co., 1967), *Photographic Emulsion Chemistry* written by G. F. Duffin (published by Focal Press Co., 1966), and *Making and Coating Photographic Emulsion* written by V. L. Zelikman et al. (published by Focal Press Co., 1964).

Suitable monodispersed emulsions for use in the invention are described in U.S. Pat. Nos. 3,574,628 and 3,655,394, and British Patent 1,413,748.

Tabular silver halide grains having an aspect ratio of 3 or more are suitable for use in the present invention. Tabular silver halide grains can readily be prepared by the methods described in *Photographic Science and Engineering* written by Gutoff, vol. 14, pp. 248–257 (1970), U.S. Pat. Nos. 4,434,226, 4,414,310, 4,433,048, and 4,439,520, and British Patent 2,112,157.

The crystal structure of the silver halide of the material of the invention may be uniform or be different inside the emulsion versus at a surface of the emulsion, or the silver halide may have a stratum structure. Further, silver halides of different compositions may be conjugated in an epitaxial conjunction. Also, the silver halide may have a structure in which the silver halide is conjugated with compounds other than silver halide, for example, silver rhodanide and lead oxide. Further, mixtures of silver halide grains having the different crystal forms may be used.

The above-described emulsions may be: a surface latent image type emulsion in which a latent image is formed primarily on a surface; an inner latent image type in which a latent image is formed primarily inside of a grain; or a type in which latent images are formed either on a surface or inside of a grain. The emulsion must be a negative type emulsion. Of the inner latent image type emulsions, the emulsion may be a core/shell inner latent image type emulsion, as described in JP-A-63-264740. The preparation method of this core/shell inner latent image type emulsion is described in JP-A-59-133542. It will be appreciated that the thickness of the shell of this emulsion is changeable by development processing. Preferably, the thickness is 3 to 40 nm, more preferably 5 to 20 nm.

Silver halide emulsions in accordance with the invention are subjected to conventional physical ripening, chemical ripening and spectral sensitization before use. The additives used for such ripening and sensitization are described in *Research Disclosure*, No. 17643, No. 18716 and No. 307105.

The photographic-material of the present invention can include, in the same layer, emulsions of two or more kinds each having one or more different characteristics such as grain size, grain size distribution, halogen composition, grain form and sensitivity.

Preferably, silver halide grains are used in the present invention which have surfaces thereof that are fogged, as described in U.S. Pat. No. 4,082,553, or silver halide grains are used in the present invention in which the grain insides are fogged, as described in U.S. Pat. No. 4,626,498 and JP-A-59-214852, and colloidal silver for a light-sensitive silver halide emulsion and/or a substantially non-light-sensitive hydrophilic colloid layer. Silver halide grains in which the insides or surfaces thereof are fogged, include silver halide grains which can be uniformly (non-imagewise) developed regardless of an unexposed portion and an exposed portion. Methods for preparing silver halide grains in which the insides or surfaces thereof are fogged are described in U.S. Pat. No. 4,6262,498 and JP-A-59-214852.

Silver halide which is an inner nucleus of a core/shell type silver halide grain in which the inside thereof is fogged may be either of the same halogen composition or a different halogen composition with respect to the silver halide in the surface. Either silver chloride, silver bromochloride, silver bromoiodide or silver bromochloroiodide may be used for the silver halide grains located in the inner nucleus or surfaces of these types of grains. The grain size of these fogged silver halide grains may be any suitable size. The average grain size thereof is preferably 0.01 to 0.75 μm, more preferably 0.05 to 0.6 μm. The grain form of the fogged silver halide grains may be any suitable form, such as a regular grain. The emulsion of the fogged silver halide grains may be a polydispersed emulsion but is preferably monodispersed (i.e., at least 95% by weight or by number of the silver halide grains have a grain size falling within ±40% of an average grain size).

In the present invention, non-light-sensitive fine grain silver halide is preferably used. The non-light-sensitive fine grain silver halide is silver halide fine grains which are not sensitized in imagewise exposing for obtaining a dye image and substantially not developed in a development processing, and they are preferably not fogged in advance.

The fine grain silver halide has a silver bromide content of 0 to 100 mole %, and may contain silver chloride and/or silver iodide according to necessity. The silver halide preferably includes 0.5 to 10 mole % of silver iodide.

The preferred fine grain silver halide of the invention has an average grain size (the average value of the diameter of a circle corresponding to the projected area of a grain) of preferably 0.01 to 0.5 μm, more preferably 0.02 to 0.2 μm.

Fine grain silver halide suitable for the present invention can be prepared by conventional methods. Surfaces of the silver halide grains must be neither optically sensitized nor spectrally sensitized. Conventional stabilizers, such as any of the triazole, azaindene, benzothiazolium and mercapto compounds and a zinc compound, are preferably added to a silver halide emulsion utilized in the invention before adding the emulsion to a coating solution. Colloidal silver is preferably added to the layer containing the silver halide grains.

The amount of silver coated on the photographic material of the present invention is preferably up to 6.0 $g/m^2$, more preferably up to 4.5 $g/m^2$.

In the photographic material of the invention, conventional photographic additives can be used in the layer containing the dispersion according to the present invention or any other layer or layers not including the dispersion of the present invention. Conventional photographic additives are described in the below three *Research Disclosure* (RD) publications:

| Kind of additives | RD 17643 | RD 18716 | RD 307105 |
|---|---|---|---|
| 1. Chemical sensitizer | p. 23 | p. 648, right colm. | p. 866 |
| 2. Sensitivity improver | — | p. 648, right colm. | |
| 3. Spectral sensitizer, Super-sensitizer | pp. 23 to 24 | p. 648, right colm. to p. 649, right colm. | pp. 866 to 868 |
| 4. Whitening | p. 24 | p. 647, | p. 868 |

-continued

| Kind of additives | RD 17643 | RD 18716 | RD 307105 |
|---|---|---|---|
| agent | | right colm. | |
| 5. Anti-foggant & stabilizer | pp. 24 to 25 | p. 649, right colm. | pp. 868 to 870 |
| 6. Light absorber, filter, dye, & UV absorber | pp. 25 to 26 | p. 649, right colm. to p. 650, left colm. | p. 873 |
| 7. Anti-stain agent | p. 25 right colm | p. 650, left colm. to right colm. | p. 872 |
| 8. Dye image stabilizer | p. 25 | p. 650, left colm. | p. 872 |
| 9. Hardener | p. 26 | p. 651, left colm. | pp. 874 to 875 |
| 10. Binder | p. 26 | p. 651, left colm. | pp. 873 to 874 |
| 11. Plasticizer & lubricant | p. 27 | p. 650, right colm. | p. 876 |
| 12. Coating aid & surfactant | pp. 26 to 27 | p. 650, right colm. | pp. 875 to 876 |
| 13. Anti-static agent | p. 27 | p. 650, right colm. | pp. 876 to 877 |
| 14. Matting agent | — | — | pp. 878 to 879 |

Compounds capable of reacting with formaldehyde to fix it are preferably added to the photographic material of the invention to prevent deterioration of the photographic performance thereof. Such compounds include those described in U.S. Pat. Nos. 4,411,987 and 4,435,503.

Mercapto compounds are preferably incorporated into the photographic material of the present invention. The compounds are described in U.S. Pat. Nos. 4,740,454 and 4,788,132, JP-A-62-18539 and JP-A-1-283551.

Compound capable of releasing a fogging agent, a development accelerator, a silver halide solvent or the precursor thereof (regardless of the amount of a developed silver which is formed by a development processing) are all preferably incorporated into the photographic material of the present invention. These are described in JP-A-1-106052.

Conventional color couplers can be used in the present invention (not as the hydrophobic compound). Examples thereof are described in the patents abstracted in above *Research Disclosure* No. 17643, VII-C to G and No. 307105, VII-C to G.

For example, a high boiling point solvent may be used in an oil-in-water dispersion method, as described in U.S. Pat. No. 2,322,027. Examples of the high boiling point organic solvent, i.e., having a boiling point of 175° C. or higher at atmospheric pressure suitable for use in the oil-in-water dispersion method are: phthalic acid esters, such as dibutyl phthalate, dicyclohexyl phthalate, di-2-ethylhexyl phthalate, decyl phthalate, bis(2,4-di-t-amylphenyl) phthalate, bis(2,4-di-t-amylphenyl) isophthalate, and bis(1,1-diethylpropyl) phthalate; phosphoric acid or phosphonic acid esters, such as triphenyl phosphate, tricresyl phosphate, 2-ethylhexyldiphenyl phosphate, tricyclohexyl phosphate, tri-2-ethylhexyl phosphate, tridodecyl phosphate, tributoxyethyl phosphate, trichloropropyl phosphate, and di-2-ethylhexylphenyl phosphate; benzoic acid esters, such as 2-ethylhexyl benzoate, dodecyl benzoate, and 2-ethylhexyl-p-hydroxybenzoate; amides, such as N,N-diethyldodecanamide, N,N-diethyllaurylamide, and N-tetradecylpyrrolidone; alcohols or phenols, such as isostearyl alcohol and 2,4-di-tert-amylphenol; aliphatic carboxylic acid esters, such as bis(2-ethylhexyl) sebacate, dioctyl azelate, glycerol tributylate, isostearyl lactate, and trioctyl citrate; an aniline derivative, such as N,N-dibutyl-2-butoxy-5-tert-octylaniline; and hydrocarbons, such as, paraffin, dodecylbenzene, and diisopropylnaphthalene. Further, an auxiliary solvent can be used, such as organic solvents having a boiling point of about at least 30° C., preferably from 50° C. to 160° C. Examples thereof include ethyl acetate, butyl acetate, ethyl propionate, methyl ethyl ketone, cyclohexanone, 2-ethoxyethyl acetate, and dimethylformamide.

Examples of a latex dispersing method and the latexes for impregnation are described in U.S. Pat. No. 4,199,363, and German Patent Publications (OLS) Nos. 2541274 and 2541230.

Various preservatives and anti-mold agents are preferably incorporated into the photographic material. These compounds include phenethyl alcohol, and 1,2-benzisothiazoline-3-one, n-butyl p-hydroxybenzoate, phenol, 4-chloro-3,5-dimethylphenol, 2-phenoxyethanol, and 2-(4-thiazolyl) benzimidazole each described in JP-A-63-257747, JP-A-62-272248 and JP-A-1-80941.

An appropriate support which can be used in the present invention is described in above *RD* No. 17643, p. 28, No. 18716, p. 647 at a right column to p. 648 at a left column, and No. 307105, p. 879.

In the photographic material of the present invention, the total thicknesses of all the hydrophilic colloid layers provided on the support side having an emulsion layer is preferably up to 28 μm, more preferably up to 23 μm, more preferably up to 18 μm, and most preferably up to 16 μm.

Layer swelling speed ($T_{\frac{1}{2}}$) in the present invention is preferably up to 30 seconds, more preferably up to 20 seconds. Layer thickness in accordance with the invention means layer thickness measured after standing at 25° C. and a relative humidity of 55% for two days $T_{\frac{1}{2}}$ can be measured according to conventional methods. For example, it can be measured with a swellometer of the type described in *Photographic Science and Engineering*, written by A. Green et al, vol. 19, No. 2, pp. 124–129, and $T_{\frac{1}{2}}$ is defined by the time necessary to reach half of a saturated layer thickness, in which the saturated layer thickness corresponds to 90% of the maximum swelling layer thickness attained when the layer is processed in a color developing solution at 30° C. for 3 minutes and 15 seconds.

$T_{\frac{1}{2}}$ can be adjusted by adding a hardener which acts as a binder or by changing the aging conditions after coating. The swelling ratio of the materials in accordance with the invention is preferably 150 to 400%, wherein the swelling ratio can be calculated from the maximum swollen layer thickness attained at the above mentioned conditions according to the following equation:

(maximum swollen layer thickness − layer thickness) ÷ layer thickness.

A hydrophilic colloid layer (hereinafter referred to as a backing layer) having a total dry layer thicknesses of 2 to 20 μm is preferably provided on the support side opposite to an emulsion layer. Preferably incorporated into this back layer are the above-described light absorber, filter dye, UV absorber, anti-static agent, hardener, binder, plasticizer, lubricant, coating aid, and surface active agent. The swelling ratio of this back layer is preferably 150 to 500%.

The photographic material according to the present invention can be subjected to development processing according to conventional methods as described in the above mentioned *RD* No. 17643, pp. 28–29, No. 18716, p. 651, a left column to a right column, and No. 307105, pp. 880–881.

The color developing solution used for development processing of the photographic material of the present invention is preferably an alkaline aqueous solution containing an aromatic primary amine color developing agent as a primary component. An aminophenol compound is also useful as the color developing agent but a p-phenylenediamine compound is preferably used. Examples thereof include: 3-methyl-4-amino-N,N-diethylaniline, 3-methyl-4-amino-N-ethyl-N-β-hydroxyethylaniline, 3-methyl-4-amino-N-ethyl-N-β-methanesulfonamidethylaniline, 3-methyl-4-amino-N-ethyl-β-methoxyethylamiline, and the sulfates, chlorinates and p-toluenesulfonates thereof. Of the foregoing, particularly preferred is 3-methyl-4-amino-N-ethyl-N-β-hydroxyethylaniline sulfate. These compounds can also be used in combinations of two or more, if desired.

In general, the color developing solution contains a pH buffer agent, such as carbonates, borates and phosphates of alkali metals, and a development inhibitor or anti-fogging agent, such as chlorides, bromides, iodides, benzimidazoles, benzothiazoles, and mercapto compounds. The color developing solution may, if desired, include hydroxylamine, diethylhydroxylamine, sulfite, hydrazines, such as N,N-biscarboxymethylhydrazine, various preservatives, such as phenyl semicarbazides, triethanolamine and catechol-sulfonic acids, organic solvents, such as ethylene glycol and diethylene glycol, development accelerators, such as benzyl alcohol, polyethylene glycol, quaternary ammonium salts and amines, dye-forming couplers, competitive couplers, auxiliary developing agents, such as 1-phenyl-3-pyrazolidone, tackifiers, and various chelating agents represented by amino polycarboxylic acid, amino polyphosphonic acid, alkylphosphonic acid, and phosphonocarboxylic acid, for example, ethylenediaminetetracetic acid, nitrilotriactic acid, diethylenetriaminepentacetic acid, cyclohexanediaminetetracetic acid, hydroxyethyliminodiacetic acid, 1-hydroxyethylidene-1,1-diphosphonic acid, nitrilo-N,N,N-trimethylenephosphonic acid, ethylenediamine-N,N,N,N-tetramethylenephosphonic acid, ethylenediamine-di(o-hydroxyphenyl acetic acid), and the salts thereof.

For reversal processing of the photographic material of the invention, color development may be carried out after black/white development. Conventional black/white developing solutions may be used including agents such as dihydroxybenzenes including hydroquinone, 3-pyrazolidones including 1-phenyl-3-pyrazolidone, and aminophenols including N-methyl-p-aminophenol. In general, the pH of these color developing solutions and black/white developing solutions is from 9 to 12.

The replenishing amount of these developing solution depends on the color photographic material in accordance with the invention which is processed. In general, the replenishing amount is up to 3 liters per $m^2$ of photographic material, which may be reduced to 500 ml per $m^2$ of photographic-material by maintaining the bromide ion concentration in the replenishing solution reduced. In order to minimize the amount of replenishing amount required, the area of processing bath which contacts air is preferably reduced to thereby prevent evaporation and air oxidation of the processing solution.

The area of photographic processing solution contacted to air in a processing bath can be expressed by an aperture ratio defined as follows:

$$\text{Aperture ratio} = [\text{area } (cm^2) \text{ of solution contacted to air}] \div [\text{volume } (cm^3) \text{ of the processing solution}]$$

The aperture ratio when processing the photographic material of the invention is preferably up to 0.1, more preferably from 0.001 to 0.05. A shielding means, such as a floating lid may be placed on the surface of a photographic processing solution in a processing bath to reduce the amount of replenishing solution required. A method for reducing the aperture ratio is described in JP-A-1-82033 (a movable lid is used), and a slit development processing method is described in JP-A-63-216050. All these methods may be utilized to process photographic material according to the invention.

The reduction of the aperture ratio is preferably applied not only to both color development and black/white development, but also to the various steps following the development, for example, all the steps of bleaching, bleach/fixing, fixing, rinsing and stabilizing. Further, a device may be used for controlling the accumulation of bromide ion in the developing solution, so that the replenishing amount is minimized.

Color development processing for photographic material in accordance with the invention is usually within the range of 2 to 5 minutes. A high temperature and a high pH may be employed and a developing agent can be used in a high concentration to thereby further shorten the processing time.

A photographic material in accordance with the invention may be subjected to a bleaching processing after a color development processing. The bleaching processing may be carried out at the same time as a fixing processing (bleach-fixing processing) or may be independently carried out. A processing method may be utilized in which a bleach-fixing processing is carried out after the bleaching processing in order to accelerate the processing. Two successive bleach-fixing baths, fixing processing before bleaching processing, bleaching processing after bleach-fixing processing may be done, if desired. Bleaching agents suitable for the photographic material of the invention include the compounds of polyvalent metals such as iron (III), peracids, quinones, and a nitro compound. Suitable bleaching agents in accordance with the invention include: the organic complex salt of iron (III), for example, the iron (III) salts of aminopolycarboxylic acids such as ethylenediaminetetracetic acid, diethylenetriaminepentaacetic acid, cyclohexanediaminetetraacetic acid, methyliminodiacetic acid, 1,3-diaminopropanetetracetic acid, and glycol ether diaminetetracetic acid; and the complex salts of citric acid, tartaric acid and malic acid. Preferred (from the viewpoint of a rapid processing and an environmental pollution) are aminopolycarboxylic acid iron (III) complex salts, including ethylenediaminetetracetic acid iron (III) complex salt and a 1,3-diaminopropanetetraacetic acid iron (III) complex salt. Further, the aminopolycarboxylic acid iron (III) complex salts are particularly useful either for a bleaching solution or a bleach-fixing solution. A bleaching solution or bleach-fixing solution in which these aminopolycarboxylic acid iron (III) complex salts are used may have a pH of 4.0 to 8.0, and processing can be carried out at lower pH in order to accelerate processing.

A bleaching accelerator can be used in the bleaching bath, the bleach-fixing bath and the prebath, if desired. Examples of the useful bleaching accelerators are described in the following: compounds having a mercapto group or a disulfide group, as described in U.S. Pat. No. 3,893,858, German Patents 1290812 and 2059988, JP-A-53-32736, JP-A-53-57831, JP-A-53-37418, JP-A-53-72623, JP-A-53-95630, JP-A-53-95631, JP-A-53-104232, JP-A-53-124424, JP-A-53-141623, JP-A-53-28426, and *Research Disclosure* No. 17129 (July, 1978); the thiazolidine derivatives described in JP-A-50-140129; the thiourea derivatives described in JP-B-45-8506, JP-A-52-20832 and JP-A-53-32735, and U.S. Pat. No. 3,706,561; the iodides described in German Patent 1127715 and JP-A-58-16235; the polyoxyethylene compounds described in German Patents 966410 and 2748430; the polyamine compounds described in JP-B-45-8836; the compounds described in JP-A-49-40943, JP-A-49-59644, JP-A-53-94927, JP-A-54-35727, JP-A-55-26506, and JP-A-58-163940; and bromide ions. Of the foregoing, the compounds having a mercapto group or a disulfide group are preferred because they have a larger bleaching acceleration effect. The compounds described in U.S. Pat. No. 4,552,834 are also preferred. More preferred are the compounds described in U.S. Pat. No. 3,893,858, German Patent 1290812, and JP-A-53-95630. These bleaching accelerators may be incorporated into a photographic material in accordance with the invention. These bleaching accelerators are particularly useful when a color photographic material in accordance with the invention is bleached and fixed.

In addition to the above compounds, an organic acid is preferably incorporated into the bleaching solution and the bleach-fixing solution used to process the photographic materials of the invention for the purpose of preventing a bleaching stain. Preferred organic acids are acids having an acid dissociation constant (pKa) of 2 to 5. Acetic acid, propionic acid and hydroxyacetic acid are preferred organic acids for this purpose.

Fixing agents suitable for fixing solutions and bleach-fixing solutions, in accordance with the invention include thiosulfates, thiocyanates, thioethers, thioureas, and bromides. Ammonium thiosulfate may be used in the invention. These fixing agents may be used in combination. Sulfites, bisulfates, carbonyl bisulfurous acid adducts, or the sulfinic acid compounds are suitable for use as a preservative for fixing solutions and bleaching solutions for the photographic materials of the invention. These compounds are described in EP-A-294769. Various aminopolycarboxylic acids and organic phosphonic acids are preferably added to the fixing solution and bleach-fixing solution for the purpose of stabilizing the solutions when processing the photographic materials of the invention.

In processing the photographic materials of the present invention, compounds having a pKa of 6.0 to 9.0, preferably imidazoles such as imidazole, 1-methylimidazole, 1-ethylimidazole and 2-methylimidazole, are preferably included (in the amount of 0.1 to 10 mole/liter) in the fixing solution or bleach-fixing solution in order to adjust pH.

In general, shorter total time for desilvering is preferred so long as inferior desilvering does not occur. Desilvering in accordance with the invention is preferably from 1 to 3 minutes, more preferably from 1 to 2 minutes. The processing temperature is preferably from 25° to 50° C., preferably from 35° to 45° C., for the desilvering. In the preferred temperature range, desilvering speed is increased and, stain is effectively prevented from generating after processing.

When desilvering photographic materials of the invention, stirring is preferably strengthened as much as possible. Suitable methods for strengthening stirring include: the method described in JP-A-62-183460, in which a processing solution jet stream impinges upon an emulsion side of a photographic material; the method described in JP-A-62-183461, where stirring is increased by a rotator. Other methods may be employed such as the method in which a stirring effect is improved by moving a photographic material while contacting the emulsion layer side thereof with a wiper blade provided in the solution to cause a turbulent flow on an emulsion layer surface. Another method is to increase the circulating flow amount of the whole processing solution. These methods are also effective for improving stirring of a bleaching solution, a bleach-fixing solution and a fixing solution. Improved stirring accelerates the supply of the bleaching solution and fixing solution to an emulsion layer and hence results in increasing desilvering speed. The above methods for improving stirring are more effective when a bleaching accelerator is used and makes it possible to markedly increase the effect of the accelerator and prevent disturbing the fixing by the bleaching accelerator.

An automatic developing machine may be used for the photographic material of the present invention and is preferably equipped with a photographic material transporting device as described in JP-A-60-191257, JP-A-60-191258 and JP-A-60-191259. It will be appreciated that the transporting device as described in JP-A-60-91257 can advantageously reduce the amount of processing solution carried over from a front bath to a rear bath, thereby preventing deterioration of the processing solution. This advantageously shortens processing time at each step and reduces the replenishing amount of processing solution required.

The photographic material of the present invention may be subjected to rinsing and/or stabilizing after desilvering. The amount of rinsing water step will vary according to the various conditions, such as the characteristics of the photographic material (for example, depending on the materials used such as a coupler), the intended application thereof, the rinsing water temperature, the number of rinsing tanks (i.e., the number of stages), the replenishing manner, such as countercurrent, and various other conditions. The relationship of the number of the rinsing tanks to water quantity in a multi-stage countercurrent system is described in *Journal of the Society of Motion Picture and Television Engineers,* vol. 64, pp. 248–253 (May, 1955). The amount of rinsing water can be decreased to a large extent using a multi-stage countercurrent system, as described in the foregoing journal. However, it will be appreciated that prolongation of residence time of water in the tanks increases the likelihood of bacteria growth and the population of floating material in the water which may stick to the photographic material. In processing the photographic material of the present invention, calcium and magnesium ions, as described in JP-A-62-288838, can be used to solve this problem. Also, the following may also be used to reduce bacteria growth: isothiazolone compounds and cyabendazoles, as described in JP-A-57-8542; a chlorine bactericide, such as chlorinated sodium isocyanurate; benzotriazoles; and the bactericides described in: *Chemistry of Anti-bacteria and Anti-mold* written by H. Horiguchi (published by Sankyo Co., 1986); *Disinfection and Anti-mold Technology of Microbials* edited by Hygiene Technology Institute, (Industrial Technology Society, 1982); and *Bactericide and Fungicide Dictionary* edited by Nippon Anti-bacteria and Anti-mold Society (1986).

Rinsing water for the processing of the photographic material of the present invention preferably has a pH of 4 to 9, more preferably 5 to 8. Rinsing temperature and rinsing time are determined according to the characteristics and desired application or applications of the photographic material. In general, the rinsing water temperature may be from 15° to 45° C. and from 20 seconds to 10 minutes, preferably from 25° to 40° C. and from 30 seconds to 5 minutes. Further, the photographic material of the present invention may be directly processed in a stabilizing solution instead of rinsing water. In such a process conventional methods, such as described in JP-A-57-8543, JP-A-58-14834, and JP-A-60-220345 may be employed.

If desired, the photographic material of the invention may be stabilized following rinsing. A stabilizing bath (which may be a final bath) for a photographic material in accordance with the invention contains a dye stabilizer and a surface active agent. The dye stabilizer may be an aldehyde, such as formalin and glutaraldehyde, an N-methylol compound, hexamethylenetetramine, and an aldehyde sulfurous acid adduct. Various chelating agents and anti-mold agents may also be present in the stabilizing bath.

An overflow solution generated by replenishing of the rinsing and/or stabilizing solutions can be reused in other developing steps, such as a desilvering step, when processing the photographic materials of the invention.

The above processing solutions may become concentrated due to vaporization during processing of the photographic material of the invention with an automatic development machine. If so, water is preferably added where appropriate to correct the concentration of these solutions.

A color developing agent may be incorporated into the photographic material of the present invention for simplifying and accelerating processing. Various precursors of the color developing agents are preferably used for incorporating the color developing agent in the material. Examples of color developing agents include the indoaniline series compounds described in, for example, U.S. Pat. No. 3,342,597; the Schiff base type compounds described in U.S. Pat. No. 3,342,599, and *Research Disclosure* No. 14850 and No. 15159; the aldol compounds described in *Research Disclosure* No. 13924; the metal salt complexes described in U.S. Pat. No. 3,719,492; and the urethane series compounds described in JP-A-53-135628.

1-Phenyl-3-pyrazolidones may be incorporated into the photographic material of the present invention in order to accelerate color development if desired. Suitable compounds for this purpose are described in JP-A-56-64339, JP-A-57-144547, and JP-A-58-115438.

In developing the photographic materials of the present invention, various processing solutions are used at 10° to 50° C. The temperature of 33° to 38° C. is preferred. This temperature may be higher to accelerate processing, and conversely the temperature can be reduced to increase image quality and improve the stability of the processing solutions.

The photographic material of the present invention can be a heat developing photographic material, as described in U.S. Pat. No. 4,500,626, JP-A-60-133449, JP-A-59-218443, JP-A-61-238056, and EP-A-210660.

The present invention will be explained below in further detail with reference to the examples but the present invention will not be limited thereby.

EXAMPLES

Example 1

Preparation of Samples 101 to 107

The layers of the compositions shown below were applied on a subbed cellulose triacetate film support to prepare Samples 101 to 107.

The numerals corresponding to the respective components show the coated amounts in terms of g/m$^2$.

| | |
|---|---|
| First layer: | |
| Dye | amount shown in Table 3 below |
| High boiling organic solvent or polymer | amount shown in Table 3 below |
| Gelatin | 3.50 g/m$^2$ |
| Second layer: | |
| H-1 | 0.12 g/m$^2$ |
| B-1 (diameter: 1.7 μm) | 0.05 g/m$^2$ |
| B-2 (diameter: 1.7 μm) | 0.10 g/m$^2$ |
| Gelatin | 2.00 g/m$^2$ |

The dye contained in the first layer was coated in the form of an emulsified dispersion obtained in the following manner.

$2\times10^{-3}$ mole of dye and 2 g of the high boiling point organic solvent or polymer were dissolved in 20 ml of ethyl acetate and this solution was mixed with 50 ml of 10% gelatin solution containing 0.2 g of sodium dodecylbezenesulfonate followed by emulsification and dispersion with a high speed homogenizer.

H-1

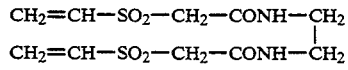

B-1

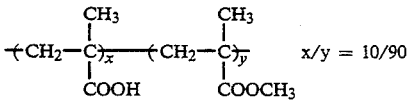

x/y = 10/90

B-2

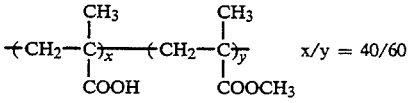

x/y = 40/60

HBS-1 Tricresyl phosphate
HBS-2 Di-n-butyl phthalate

Polymer-A

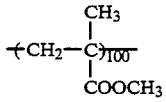

Polymer-B

-continued

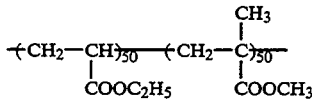

Hue was evaluated with the absorbance in the absorption spectrum of these samples and a half band width (a half width in the peak of λmax)÷absorbance. Decoloring performance (the ratio of a residual density after processing to a dye density before processing) was evaluated by measuring the absorptions of a non-processed sample and the same sample which was dipped in the processing solution A for 30 seconds and then dried.

Processing Solution A

To 3 g of sodium sulfite, 1 l of water was added. Then, the resulting solution was adjusted to pH 10 with potassium carbonate.

Further, the layer strength of the sample was evaluated by the following adhesion performance.

An adhesive tape having a strong adhering property was stuck on the sample and rubbed ten times. Then, the sample was left standing at room temperature for one day and the tape was peeled off to observe the adhesion strength of the sample. The results were classified as O (very good), Δ (average) and x (inferior). The results are shown in Table 1.

TABLE 1

| Sample No. | Dye | Dispersing medium | Absorbance | Half band width/ absorbance | Residual color rate | Adhesion |
|---|---|---|---|---|---|---|
| 101 (Comp.) | D-25 (0.20 g/m²) | HBS-1 (0.40 g/m²) | 0.88 | 110 | 7 | x |
| 102 (Comp.) | D-25 (0.20 g/m²) | HBS-2 (0.40 g/m²) | 0.78 | 120 | 6 | x |
| 103 (Comp.) | D-25 (0.20 g/m²) | Polymer A (0.40 g/m²) | 0.35 | 200 | 10 | ○ |
| 104 (Comp.) | D-25 (0.20 g/m²) | Polymer B (0.40 g/m²) | 0.31 | 180 | 12 | ○ |
| 105 (Inv.) | D-25 (0.20 g/m²) | P-1 (0.40 g/m²) | 0.92 | 110 | 6 | ○ |
| 106 (Inv.) | D-25 (0.20 g/m²) | P-2 (0.40 g/m²) | 0.95 | 110 | 5 | ○ |
| 107 (Inv.) | D-25 (0.20 g/m²) | P-17 (0.40 g/m²) | 0.89 | 110 | 4 | ○ |

It is apparent from the results shown in Table 1 that the samples in which the polymers of the present invention were used are excellent in terms of the absorption characteristic, decoloring performance and layer physical property.

Example 2

The respective layers of the compositions shown below were simultaneously coated on a subbed cellulose triacetate film support, whereby Sample 201 which was a multi-layer color photographic material was prepared.

Compositions of the photographic layers

The numerals corresponding to the respective components show the coated amounts expressed in terms of g/m² and those corresponding to the silver halides show the coated amounts converted to silver. Provided that the coated amounts of the sensitizing dyes are shown in terms of mole per mole of silver halide contained in the same layer.

| Sample 201 | |
|---|---|
| First layer (an anti-halation layer): | |
| Black colloidal silver | 0.18 as Ag |
| Gelatin | 1.40 |
| Second layer (an intermediate layer): | |
| 2,5-Di-t-pentadecyl hydroquinone | 0.18 |
| EX-1 | 0.18 |
| EX-3 | 0.020 |
| EX-12 | $2.0 \times 10^{-3}$ |
| U-1 | 0.060 |
| U-2 | 0.080 |
| U-3 | 0.10 |
| HBS-1 | 0.10 |
| HBS-2 | 0.020 |
| Gelatin | 1.04 |
| Third layer (first red-sensitive layer): | |
| Emulsion A | 0.20 as Ag |
| Emulsion B | 0.30 as Ag |
| Sensitizing dye I | $6.9 \times 10^{-5}$ |
| Sensitizing dye II | $1.8 \times 10^{-5}$ |
| Sensitizing dye III | $3.1 \times 10^{-4}$ |
| EX-2 | 0.17 |
| EX-10 | 0.020 |
| EX-14 | 0.17 |
| U-1 | 0.070 |
| U-2 | 0.050 |
| U-3 | 0.070 |
| HBS-1 | 0.060 |
| Gelatin | 0.87 |
| Fourth layer (second red-sensitive layer): | |
| Emulsion D | 0.85 as Ag |
| Sensitizing dye I | $3.5 \times 10^{-4}$ |
| Sensitizing dye II | $1.6 \times 10^{-5}$ |
| Sensitizing dye III | $5.1 \times 10^{-4}$ |
| EX-2 | 0.20 |
| EX-3 | 0.050 |
| EX-10 | 0.015 |
| EX-14 | 0.20 |
| EX-15 | 0.050 |
| U-1 | 0.070 |
| U-2 | 0.050 |
| U-3 | 0.070 |
| Gelatin | 1.30 |
| Fifth layer (third red-sensitive layer): | |
| Emulsion E | 1.55 as Ag |
| Sensitizing dye I | $2.4 \times 10^{-4}$ |
| Sensitizing dye II | $1.0 \times 10^{-4}$ |
| Sensitizing dye III | $3.4 \times 10^{-4}$ |
| EX-2 | 0.097 |
| EX-3 | 0.010 |
| EX-4 | 0.080 |
| HBS-1 | 0.22 |
| HBS-2 | 0.10 |
| Gelatin | 1.63 |
| Sixth layer (an intermediate layer): | |
| EX-5 | 0.040 |
| HBS-1 | 0.020 |
| Gelatin | 0.80 |
| Seventh layer (first green-sensitive layer): | |
| Emulsion C | 0.40 as Ag |
| Sensitizing dye IV | $2.6 \times 10^{-5}$ |

-continued

| Sample 201 | |
|---|---|
| Sensitizing dye V | $1.8 \times 10^{-4}$ |
| Sensitizing dye VI | $6.9 \times 10^{-4}$ |
| EX-1 | 0.015 |
| EX-6 | 0.13 |
| EX-7 | 0.020 |
| EX-8 | 0.025 |
| EX-16 | 0.015 |
| HBS-1 | 0.10 |
| HBS-3 | 0.010 |
| Gelatin | 0.63 |
| Eighth layer (second green-sensitive layer): | |
| Emulsion D | 0.55 as Ag |
| Sensitizing dye IV | $2.1 \times 10^{-5}$ |
| Sensitizing dye V | $1.5 \times 10^{-4}$ |
| Sensitizing dye VI | $5.8 \times 10^{-4}$ |
| EX-6 | 0.047 |
| EX-7 | 0.018 |
| EX-8 | 0.018 |
| EX-16 | 0.054 |
| HBS-1 | 0.16 |
| HBS-3 | $8.0 \times 10^{-3}$ |
| Gelatin | 0.50 |
| Ninth layer (third green-sensitive layer): | |
| Emulsion E | 1.10 as Ag |
| Sensitizing dye IV | $4.6 \times 10^{-5}$ |
| Sensitizing dye V | $1.0 \times 10^{-4}$ |
| Sensitizing dye VI | $4.0 \times 10^{-4}$ |
| EX-1 | 0.013 |
| EX-11 | 0.060 |
| EX-13 | 0.025 |
| HBS-1 | 0.15 |
| HBS-2 | 0.05 |
| Gelatin | 1.25 |
| Tenth layer (a yellow filter layer): | |
| Yellow colloidal silver | 0.05 as Ag |
| EX-5 | 0.12 |
| HBS-2 | 0.08 |
| Gelatin | 0.60 |
| Eleventh layer (first blue-sensitive layer): | |
| Emulsion C | 0.2 as Ag |
| Sensitizing dye VII | $8.6 \times 10^{-4}$ |

-continued

| Sample 201 | |
|---|---|
| EX-8 | 0.042 |
| EX-9 | 0.72 |
| HBS-1 | 0.28 |
| Gelatin | 1.10 |
| Twelfth layer (second blue-sensitive layer): | |
| Emulsion D | 0.4 as Ag |
| Sensitizing dye VII | $7.4 \times 10^{-4}$ |
| EX-9 | 0.15 |
| EX-10 | $7.0 \times 10^{-3}$ |
| HBS-1 | 0.050 |
| Gelatin | 0.78 |
| Thirteenth layer (third blue-sensitive layer): | |
| Emulsion F | 0.80 as Ag |
| Sensitizing dye VII | $2.8 \times 10^{-4}$ |
| EX-9 | 0.20 |
| HBS-1 | 0.070 |
| Gelatin | 0.69 |
| Fourteenth layer (first protective layer): | |
| Emulsion G | 0.20 as Ag |
| U-4 | 0.11 |
| U-5 | 0.17 |
| HBS-1 | $5.0 \times 10^{-2}$ |
| Gelatin | 1.00 |
| Fifteenth layer (second protective layer): | |
| H-1 | 0.40 |
| B-1 (diameter: 1.7 μm) | $5.0 \times 10^{-2}$ |
| B-2 (diameter: 1.7 μm) | 0.10 |
| B-3 | 0.10 |
| S-1 | 0.20 |
| Gelatin | 1.20 |

Further, W-1, W-2, W-3, B-4, B-5, B-6, F-1, F-2, F-3, F-4, F-5, F-6, F-7, F-8, F-9, F-10, F-11, F-12, F-13, F-14, F-15, F-16, an iron salt, a lead salt, a gold salt, a platinum salt, an iridium salt, and a rhodium salt were contained in all layers to preserve the samples, improve processing of the samples, relieve pressure in the samples, kill mold in the samples, act as a fungicide in the samples, reduce static in the samples and improve coating of the layers.

TABLE 2

| Emulsion | Average AgI content (%) | Average grain size (μm) | Fluctuation coefficient (%) | Diameter/ thickness ratio | Silver amount ratio core/middle/shell (AgI content) | Grain structure/form |
|---|---|---|---|---|---|---|
| A | 4.0 | 0.45 | 27 | 1 | [1/3] (13/1) | Double structure octahedron grain |
| B | 8.9 | 0.70 | 14 | 1 | [3/7] (25/2) | Double structure octahedron grain |
| C | 2.0 | 0.55 | 25 | 7 | — | Uniform structure tabular grain |
| D | 9.0 | 0.65 | 25 | 6 | [12/59/29] (0/11/8) | Triple structure tabular grain |
| E | 9.0 | 0.85 | 23 | 5 | [8/59/33] (0/11/8) | Triple structure tabular grain |
| F | 14.5 | 1.25 | 25 | 3 | [37/63] (34/3) | Double structure tabular grain |
| G | 1.0 | 0.07 | 15 | 1 | — | Uniform structure fine grain |

(1) Emulsions C, D, E and F were subjected to a reduction sensitization with thiourea dioxide and thiosulfonic acid in the preparation of the grains according to the examples of JP-A-2-191938.

(2) Emulsions C, D, E and F were subjected to a gold sensitization, a sulfur sensitization and a selenium sensitization in the presence of the spectral sensitizing dyes described in the respective sensitive-layers and sodium thiocyanate according to the examples of JP-A-3-237450.

(3) Low molecular weight gelatin was used in preparing the tabular grains according to the examples of JP-A-1-158426.

(4) In the tabular grains and the regular grains having a grain structure, the dislocation line described in JP-A-3-237450 was observed with a high voltage electron microscope.

EX-1

TABLE 2-continued
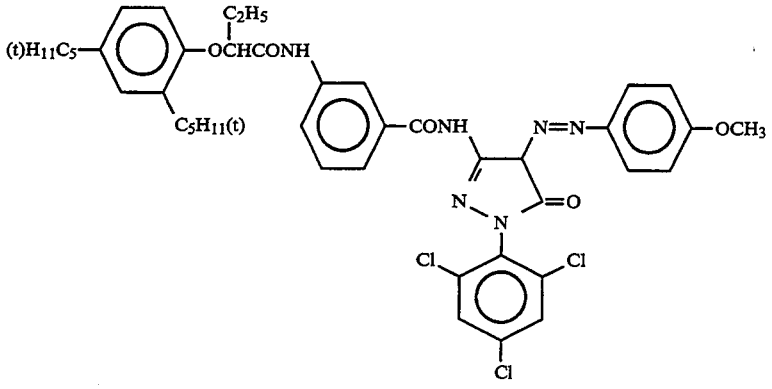
EX-2
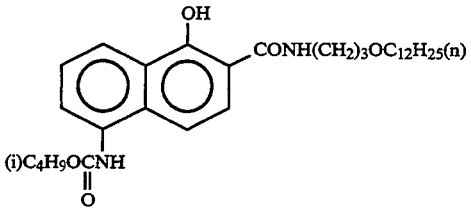
EX-3
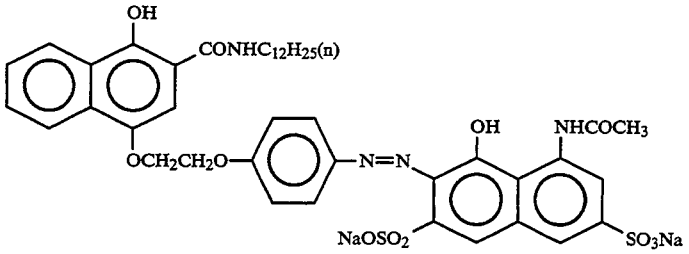
EX-4
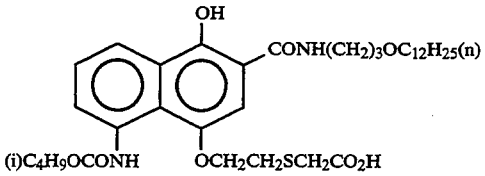
EX-5
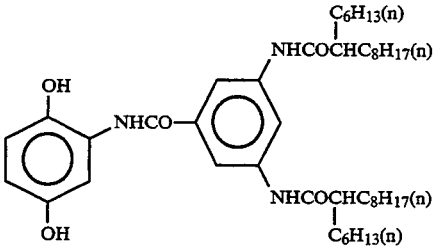
EX-6
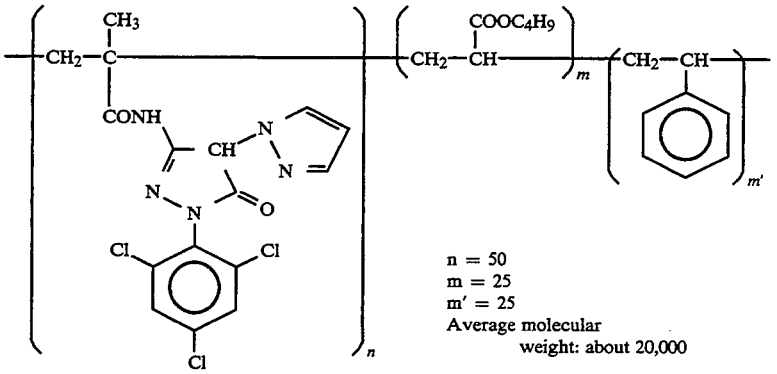
n = 50
m = 25
m' = 25
Average molecular weight: about 20,000
EX-7

TABLE 2-continued
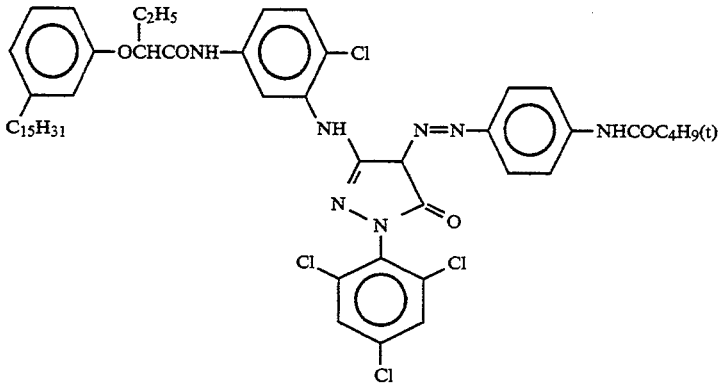
EX-8
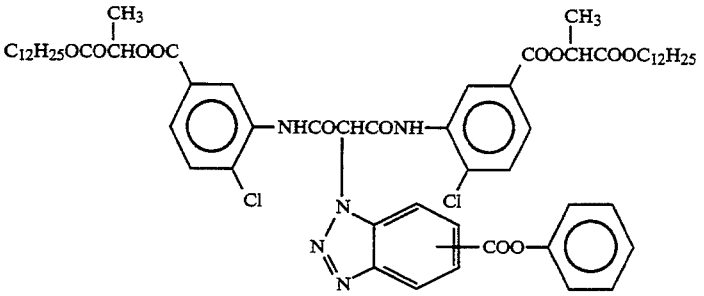
EX-9
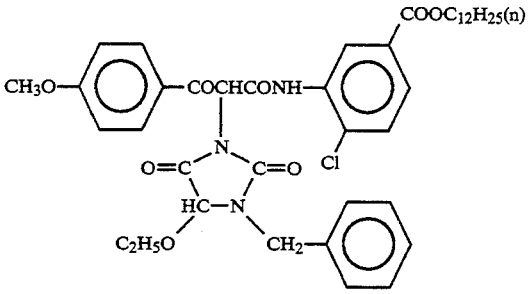
EX-10
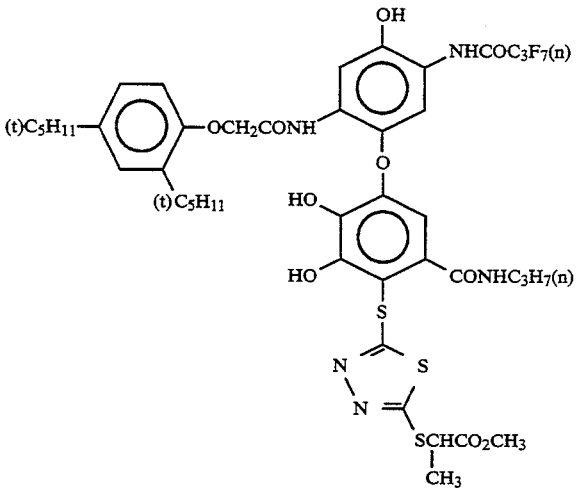
EX-11

TABLE 2-continued
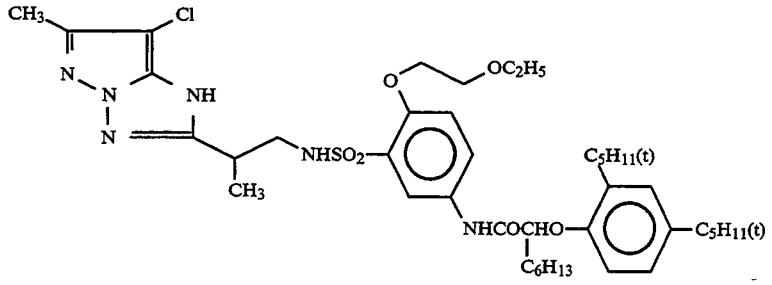
EX-12
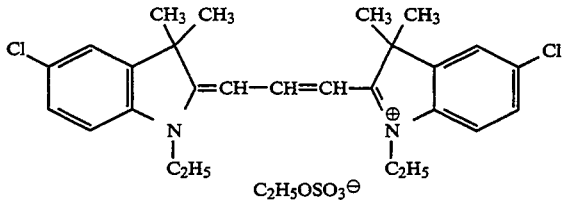
EX-13
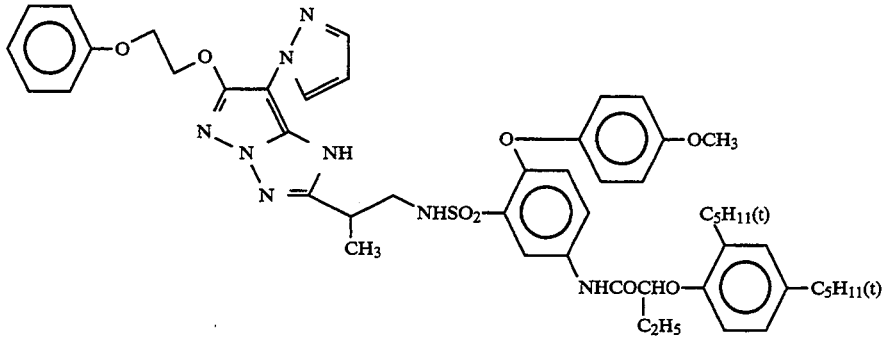
EX-14
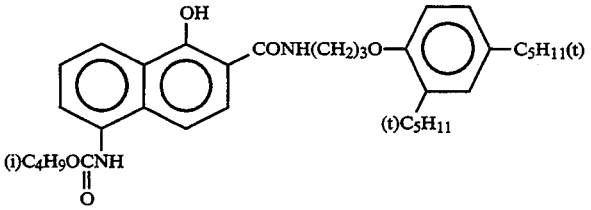
EX-15
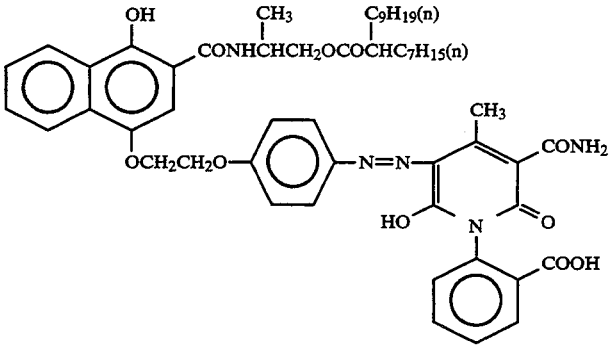
EX-16

TABLE 2-continued
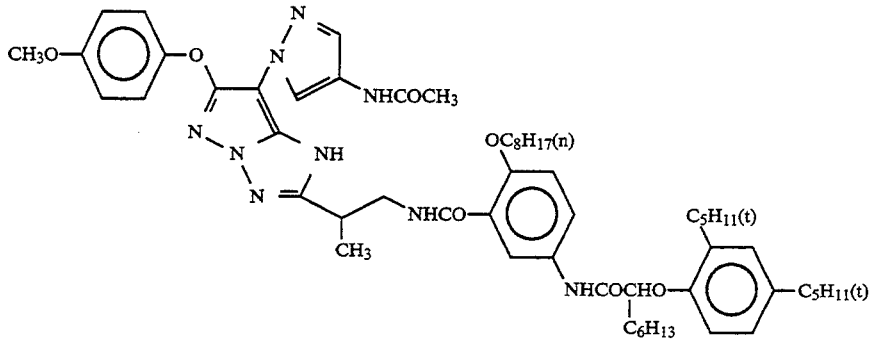
U-1
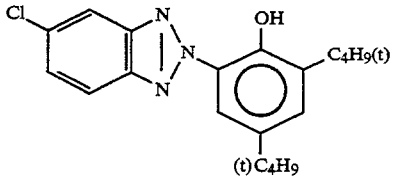
U-2
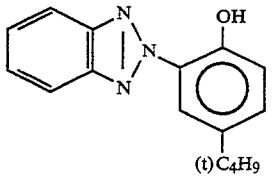
U-3
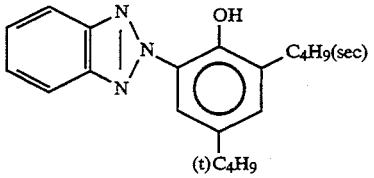
U-4
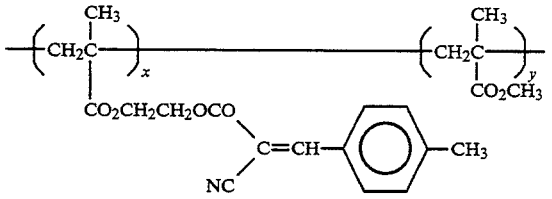
x:y = 70:30 (wt %)
U-5
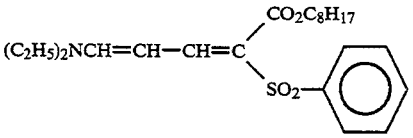
HBS-1
Tricresyl phosphate
HBS-2
Di-n-butyl phthalate
HBS-3
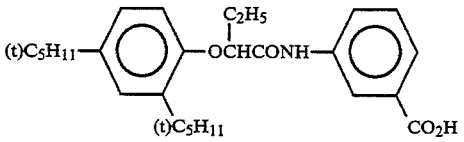
Sensitizing dye I
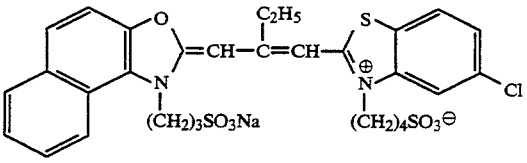
Sensitizing dye II
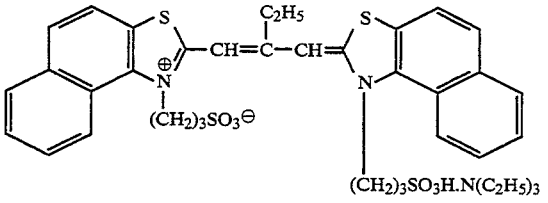
Sensitizing dye III
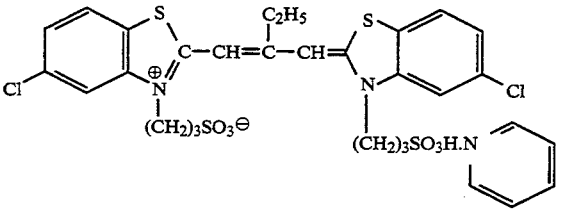

TABLE 2-continued
Sensitizing dye IV
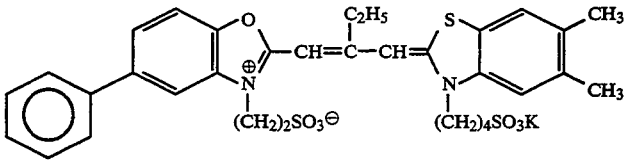
Sensitizing dye V
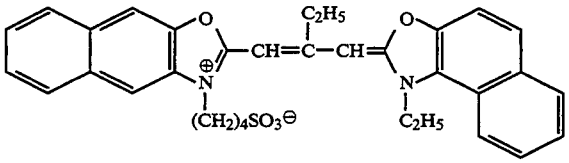
Sensitizing dye VI
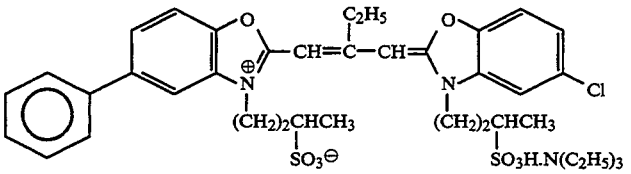
Sensitizing dye VII
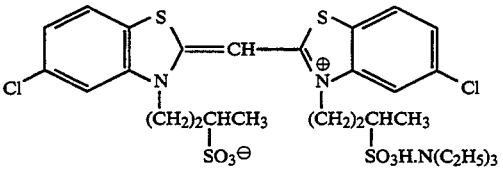
S-1
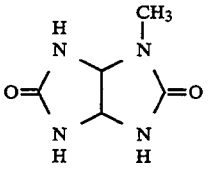
H-1
$CH_2{=}CH{-}SO_2{-}CH_2{-}CONH{-}CH_2$
$CH_2{=}CH{-}SO_2{-}CH_2{-}CONH{-}CH_2$
B-1
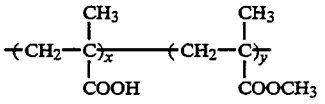
x/y = 10/90
B-2
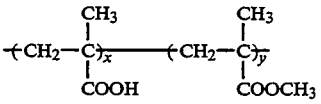
x/y = 40/60
B-3
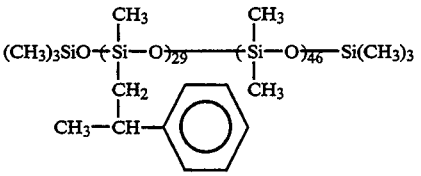
B-4
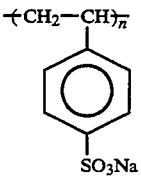
B-5
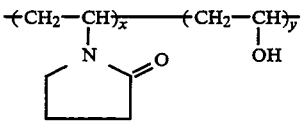
x/y = 70/30
B-6
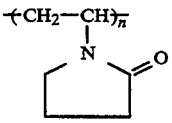
Average molecular weight: about 10,000
W-1
$C_8F_{17}SO_2NHCH_2CH_2CH_2OCH_2CH_2\overset{\oplus}{N}(CH_3)_3$
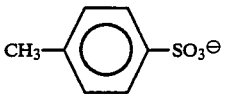
W-2
W-3

TABLE 2-continued
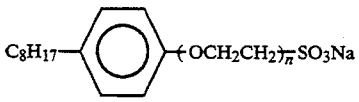
n represents 2, 3, or 4.
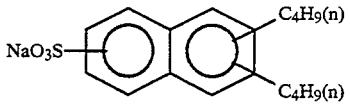
F-1
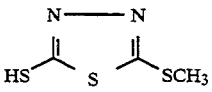
F-2
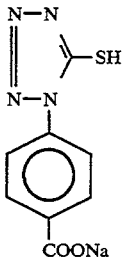
F-3
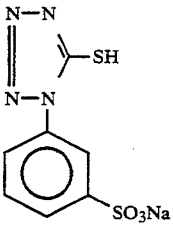
F-4
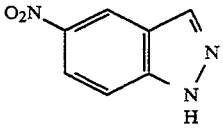
F-5
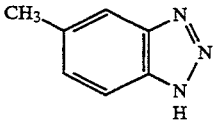
F-6
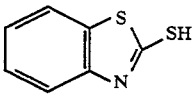
F-7
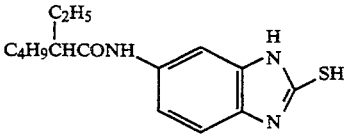
F-8
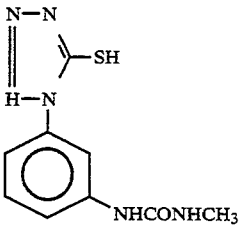
F-9
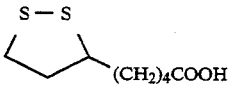
F-10
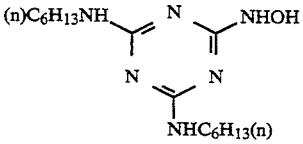
F-11
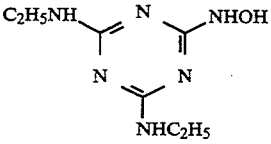
F-12
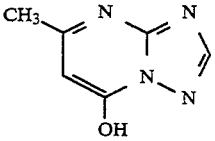
F-13
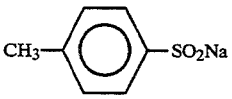
F-14
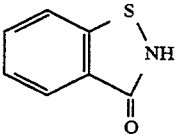
F-15
F-16

TABLE 2-continued

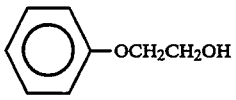

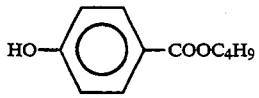

Preparation of Sample 202

Next, Sample 202 was prepared in the same manner as that in Sample 201 except that yellow colloidal silver contained in the tenth layer of Sample 201 was replaced with 0.20 g/m$^2$ of the dye D-2 of the present invention and that the amount of the high boiling point solvent HBS-2 was changed to 0.40 g/m$^2$.

Preparation of Samples 203 and 204

Next, Samples 203 and 204 were prepared in the same manner as that in Sample 202 except that the high boiling point solvent HBS-2 contained in the tenth layer of Sample 202 was replaced with the same weight of the comparative polymers Polymer-1 and Polymer-2.

Preparation of Samples 205 and 206

Next, Sample 205 and 206 were prepared in the same manner as that in Sample 202 except that the high boiling point solvent HBS-2 contained in the tenth layer of Sample 202 was replaced with the same weight of the polymers P-2 and P-16 of the present invention.

The samples thus obtained were exposed to a white light via an optical wedge and then were processed with an automatic developing machine in the following manner (the processing was carried out in advance until an accumulative replenishing amount reached three times as much as the tank capacity of a mother solution).

Processing method (A)

| Step | Processing time | Temperature (°C.) | Replenishing amount (ml) | Tank capacity (l) |
|---|---|---|---|---|
| Color developing | 3 minutes & 15 seconds | 38 | 33 | 20 |
| Bleaching | 6 minutes & 30 seconds | 38 | 25 | 40 |
| Rinsing | 2 minutes & 10 seconds | 24 | 1200 | 20 |
| Fixing | 4 minutes & 20 seconds | 38 | 25 | 30 |
| Rinsing (1) | 1 minute & 5 seconds | 24 | * | 10 |
| Rinsing (2) | 1 minute | 24 | 1200 | 10 |
| Stabilizing | 1 minute & 5 seconds | 38 | 25 | 10 |
| Drying | 4 minutes & 20 seconds | 55 | | |

*A counter current system from (2) to (1).

Replenishing amount is per meter of 35 mm width.

The compositions of the processing solutions are shown below:

| | M | R |
|---|---|---|
| Color developing solution | | |
| Diethylenetriaminepentacetic acid | 1.0 g | 1.1 g |
| 1-Hydroxyethylidene-1,1-diphosphonic acid | 3.0 g | 3.2 g |
| Sodium sulfite | 4.0 g | 4.4 g |
| Potassium carbonate | 30.0 g | 37.0 g |
| Potassium bromide | 1.4 g | 0.7 g |
| Potassium iodide | 1.5 mg | — |
| Hydroxylamine sulfate | 2.4 g | 2.8 g |
| 4-[N-ethyl-N-(β-hydroxyethylamino)]-2-methylaniline sulfate | 4.5 g | 5.5 g |

-continued

| | M | R |
|---|---|---|
| Water was added to make the total quantity | 1.0 l | 1.0 l |
| pH | 10.05 | 10.10 |
| Bleaching solution | | |
| Ferric sodium ethylenediaminetetracetate trihydrate | 100.0 g | 120.0 g |
| Disodium ethylenediaminetetracetate | 10.0 g | 10.0 g |
| Ammonium bromide | 140.0 g | 160.0 g |
| Ammonium nitrate | 30.0 g | 35.0 g |
| Ammonia water (27%) | 6.5 ml | 4.0 ml |
| Water was added to make the total quantity | 1.0 l | 1.0 l |
| pH | 6.0 | 5.7 |
| Fixing solution | | |
| Disodium ethylenediaminetetracetate | 0.5 g | 0.7 g |
| Sodium sulfite | 7.0 g | 8.0 g |
| Sodium bisulfite | 5.0 g | 5.5 g |
| Ammonium thiosulfate aqueous solution (70%) | 170.0 ml | 200.0 ml |
| Water was added to make the total quantity | 1.0 l | 1.0 l |
| pH | 6.7 | 6.6 |
| Stabilizing solution | | |
| Formalin (37%) | 2.0 ml | 3.0 ml |
| Polyoxyethylene-p-monononylphenyl ether (average polymerization degree: 10) | 0.3 g | 0.45 g |
| Disodium ethylenediaminetetracetate | 0.05 g | 0.08 g |
| Water was added to make the total quantity | 1.0 l | 1.0 l |
| pH | 5.0–8.0 | 5.0–8.0 |

Note:
M: mother solution
R: replenishing solution

After processing, the respective samples were subjected to measurement of density, wherein the fog density [$D_B$(min)] of a blue-sensitive layer was expressed in terms of a value relative to that of Sample 101 to evaluate the decoloring performance [$\Delta D_B$(min)] of a dye.

The sensitivity of a green-sensitive layer was shown by the value relative to that of Sample 201.

As apparent from the results shown in Table 3, the samples according to the present invention provide $D_B$(min) equivalent to that of Sample 201. That is, it is shown that the decoloring performance is excellent. In the samples of the present invention, the sensitivity in a green-sensitive layer can notably be raised. This is attributable to the excellent absorption of the dye according to the present invention. The function as a yellow filter was evaluated in the following manner: it was evaluated by the magenta density obtained by sensitizing the green-sensitive layer with a blue light absorbed with yellow colloidal silver (filter) contained in the tenth layer of Sample 201, which was transmitted to a lower layer when the yellow filter was removed (that is, the sensitization based on the intrinsic sensitivity of silver halide). That is, the respective samples were subjected to a blue color separation exposure and processed by the above processing method A, followed by measuring the magenta density. The level of the magenta density of the sample in which the yellow filter was removed was set at light leaking 100% and the level of the magenta density of Sample 201 was set at 0%, whereby the others were evaluated.

As can be seen from the results summarized in Table 3, the samples of the present invention show a sufficient yellow filter effect comparable to Sample 201 and prevent the transmission of a blue light to a lower layer.

TABLE 3

| Sample No. | Dye in the tenth layer | Dispersing medium in the tenth layer | Leakage of blue light through yellow filter (%) | Difference in Dmin of yellow density (ΔDmin) | Relative sensitivity* | Adhesion |
|---|---|---|---|---|---|---|
| 201 (Comp.) | — | — | 0 | ±0 | 100 | ○ |
| 202 (Comp.) | D-12 | HBS-2 | 10 | +0.01 | 119 | x |
| 203 (Comp.) | D-12 | Polymer-1 | 30 | +0.03 | 115 | ○ |
| 204 (Comp.) | D-12 | Polymer-2 | 35 | +0.02 | 115 | ○ |
| 205 (Inv.) | D-12 | P-2 | 0 | +0.01 | 120 | ○ |
| 206 (Inv.) | D-12 | P-16 | 0 | +0.01 | 120 | ○ |

*Relative sensitivity of the green-sensitive layer.

It is apparent from the results shown in Table 3 that the samples of the present invention exhibit an excellent decoloring performance and have layer physical property and can achieve high sensitization. Further, the samples of the present invention, which were subjected to processing by the following described processing method B, exhibited an excellent decoloring performance and improved green-sensitivity of a lower layer, as was the case with processing method A.

Processing method B

| Step | Processing time | Temperature (°C.) | Replenishing amount (ml) | Tank capacity (l) |
|---|---|---|---|---|
| Color developing | 3 minutes & 15 seconds | 37.8 | 25 | 10 |
| Bleaching | 45 seconds | 38 | 5 | 4 |
| Bleach-fixing (1) | 45 seconds | 38 | — | 4 |
| Bleach-fixing (2) | 45 seconds | 38 | 30 | 4 |
| Rinsing (1) | 20 seconds | 38 | — | 2 |
| Rinsing (2) | 20 seconds | 38 | 30 | 2 |
| Stabilizing | 20 seconds | 38 | 20 | 2 |
| Drying | 1 minute | 55 | | |

Replenishing amount is per meter of 35 mm width.

The bleach-fixing and rinsing steps were countercurrent from (2) to (1), and all of an overflow bleaching solution was introduced into the bleach-fixing solution (2).

The amount of bleach-fixing solution carried over to the rinsing bath in the above processing was 2 ml per meter of photographic material having a 35 mm width.

| | M | R |
|---|---|---|
| Color developing solution | | |
| Diethylenetriaminepentacetic acid | 5.0 g | 6.0 g |
| Sodium sulfite | 4.0 g | 5.0 g |
| Potassium carbonate | 30.0 g | 37.0 g |
| Potassium bromide | 1.3 g | 0.5 g |
| Potassium iodide | 1.2 mg | — |
| Hydroxylamine sulfate | 2.0 g | 3.6 g |
| 4-(N-Ethyl-N-β-hydroxyethylamino)-2-methylaniline sulfate | 4.7 g | 6.2 g |
| Water was added to make the total quantity | 1.0 l | 1.0 l |
| pH | 10.00 | 10.15 |
| Bleaching solution | | |
| Ferric ammonium 1,3-diaminopropanetetraacetate monohydrate | 144.0 g | 206.0 g |
| 1,3-Diaminopropanetetracetic acid | 2.8 g | 4.0 g |
| Ammonium bromide | 84.0 g | 120.0 g |
| Ammonium nitrate | 17.5 g | 25.0 g |
| Ammonia water (27%) | 10.0 g | 1.8 g |
| Acetic acid (98%) | 51.1 g | 73.0 g |
| Water was added to make the total quantity | 1.0 l | 1.0 l |
| pH | 4.3 | 3.4 |
| Bleach-fixing solution | | |
| Ferric ammonium ethylenediaminetetracetate dehydrate | 50.0 g | — |
| Disodium ethylenediaminetetracetate | 5.0 g | 25.0 g |
| Ammonium sulfite | 12.0 g | 20.0 g |
| Ammonium thiosulfate aqueous solution (700 g/liter) | 290.0 ml | 320.0 ml |
| Ammonia water (27%) | 6.0 ml | 15.0 ml |
| Water was added to make the total quantity | 1.0 l | 1.0 l |
| pH | 6.8 | 8.0 |

Note:
M: mother solution
R: replenishing solution

Tap water was introduced into a mixed bed type column filled with a hydrogen type strong acidic cation exchange resin (Amberlite IR-120B manufactured by Rohm & Haas Co.) and a hydroxyl type strong base anion exchange resin (Amberlite IRA-400 manufactured by Rohm & Haas Co.) to reduce the calcium and magnesium ion concentrations to 3 mg/liter or less, and subsequently 20 mg/l of sodium dichloroisocyanurate and 150 mg/l of sodium sulfate were added. pH of this solution was from 6.5 to 7.5.

| Stabilizing solution (common to both of the mother solution and replenishing solution) | |
|---|---|
| Formalin (37%) | 1.2 ml |
| Surface active agent $C_{10}H_{21}—O—(CH_2CH_2O)_{10}—H$ | 0.4 g |

Example 3

Preparation of Sample 301

The respective layers having the following compositions were provided on a 127 μm thick cellulose triacetate film support having thereon a subbing layer to thereby prepare multi-layer color photographic material Sample 301. The numerals show the addition amounts per $m^2$. The effects of the compounds added are not limited to the applications described.

| | |
|---|---|
| First layer: an anti-halation layer | |
| Black colloidal silver | 0.20 g |
| Gelatin | 1.9 g |
| UV absorber U-1 | 0.1 g |
| UV absorber U-3 | 0.04 g |
| UV absorber U-4 | 0.1 g |
| High boiling point solvent Oil-1 | 0.1 g |
| Second layer: an intermediate layer | |
| Gelatin | 0.40 g |
| Compound Cpd-C | 5 mg |
| Compound Cpd-J | 5 mg |
| Compound Cpd-K | 3 mg |
| High boiling point solvent Oil-3 | 0.1 g |
| Dye D-4 | 0.4 mg |
| Third layer: an intermediate layer | |
| Silver bromoiodide fine grains in which the surface and inside were fogged (average grain size: 0.06 μm, a fluctuation coefficient: 18%, AgI content: 1 mole%) | 0.05 g as Ag |
| Gelatin | 0.4 g |
| Fourth layer: a low red-sensitive layer | |
| Emulsion A | 0.1 g as Ag |
| Emulsion B | 0.4 g as Ag |
| Gelatin | 0.8 g |
| Coupler C-1 | 0.15 g |
| Coupler C-2 | 0.05 g |
| Coupler C-3 | 0.05 g |
| Coupler C-9 | 0.05 g |
| Compound Cpd-C | 10 mg |
| High boiling point solvent Oil-2 | 0.1 g |
| Additive P-1 | 0.1 g |
| Fifth layer: a medium red-sensitive layer | |
| Emulsion B | 0.2 g as Ag |
| Emulsion C | 0.3 g as Ag |
| Gelatin | 0.8 g |
| Coupler C-1 | 0.2 g |
| Coupler C-2 | 0.05 g |
| Coupler C-3 | 0.2 g |
| High boiling point solvent Oil-2 | 0.1 g |
| Additive P-1 | 0.1 g |
| Sixth layer: a high red-sensitive layer | |
| Emulsion D | 0.4 g as Ag |
| Gelatin | 1.1 g |
| Coupler C-1 | 0.3 g |
| Coupler C-2 | 0.1 g |
| Coupler C-3 | 0.7 g |
| Additive P-1 | 0.1 g |
| Seventh layer: an intermediate layer | |
| Gelatin | 0.6 g |
| Additive M-1 | 0.3 g |
| Anti-color mixing agent Cpd-1 | 2.6 mg |
| UV absorber U-1 | 0.01 g |
| UV absorber U-2 | 0.002 g |
| UV absorber U-5 | 0.01 g |
| Dye D-1 | 0.02 g |
| Compound Cpd-C | 5 mg |
| Compound Cpd-J | 5 mg |
| Compound Cpd-K | 5 mg |
| High boiling point solvent Oil-1 | 0.02 g |
| Eighth layer: an intermediate layer | |
| Silver bromoiodide emulsion in which the surface and inside were fogged (average grain size: 0.06 μm, a fluctuation coefficient: 16%, AgI content: 0.3 mole %) | 0.02 g as Ag |
| Gelatin | 1.0 g |
| Additive P-1 | 0.2 g |
| Anti-color mixing agent Cpd-A | 0.1 g |
| Ninth layer: a low green-sensitive layer | |
| Emulsion E | 0.1 g as Ag |
| Emulsion F | 0.2 g as Ag |
| Emulsion G | 0.2 g as Ag |
| Gelatin | 0.5 g |
| Coupler C-4 | 0.1 g |
| Coupler C-7 | 0.05 g |
| Coupler C-8 | 0.20 g |
| Compound Cpd-B | 0.03 g |

-continued

| | |
|---|---|
| Compound Cpd-C | 10 mg |
| Compound Cpd-D | 0.02 g |
| Compound Cpd-E | 0.02 g |
| Compound Cpd-F | 0.02 g |
| Compound Cpd-G | 0.02 g |
| High boiling point solvent Oil-1 | 0.1 g |
| High boiling point solvent Oil-2 | 0.1 g |
| Tenth layer: a medium green-sensitive layer | |
| Emulsion G | 0.3 g as Ag |
| Emulsion H | 0.1 g as Ag |
| Gelatin | 0.6 g |
| Coupler C-4 | 0.1 g |
| Coupler C-7 | 0.2 g |
| Coupler C-8 | 0.1 g |
| Compound Cpd-B | 0.03 g |
| Compound Cpd-D | 0.02 g |
| Compound Cpd-E | 0.02 g |
| Compound Cpd-F | 0.05 g |
| Compound Cpd-G | 0.05 g |
| High boiling point solvent Oil-2 | 0.01 g |
| Eleventh layer: a high green-sensitive layer | |
| Emulsion I | 0.5 g as Ag |
| Gelatin | 1.0 g |
| Coupler C-4 | 0.3 g |
| Coupler C-7 | 0.1 g |
| Coupler C-8 | 0.1 g |
| Compound Cpd-B | 0.08 g |
| Compound Cpd-C | 5 mg |
| Compound Cpd-D | 0.02 g |
| Compound Cpd-E | 0.02 g |
| Compound Cpd-F | 0.02 g |
| Compound Cpd-G | 0.02 g |
| Compound Cpd-J | 5 mg |
| Compound Cpd-K | 5 mg |
| High boiling point solvent Oil-1 | 0.02 g |
| High boiling point solvent Oil-2 | 0.02 g |
| Twelfth layer: an intermediate layer | 0.6 g |
| Gelatin | |
| Thirteenth layer: a yellow filter layer | |
| Yellow colloidal silver | 0.07 g as Ag |
| Gelatin | 1.1 g |
| Anti-color mixing agent Cpd-A | 0.01 g |
| High boiling point solvent Oil-1 | 0.01 g |
| Fourteenth layer: an intermediate layer | 0.6 g |
| Gelatin | |
| Fifteenth layer: a low blue-sensitive layer | |
| Emulsion J | 0.2 g as Ag |
| Emulsion K | 0.3 g as Ag |
| Emulsion L | 0.1 g as Ag |
| Gelatin | 0.8 g |
| Coupler C-5 | 0.2 g |
| Coupler C-6 | 0.1 g |
| Coupler C-10 | 0.4 g |
| Sixteenth layer: a medium blue-sensitive layer | |
| Emulsion L | 0.1 g as Ag |
| Emulsion M | 0.4 g as Ag |
| Gelatin | 0.9 g |
| Coupler C-5 | 0.3 g |
| Coupler C-6 | 0.1 g |
| Coupler C-10 | 0.1 g |
| Seventeenth layer: a high blue-sensitive layer | |
| Emulsion N | 0.4 g as Ag |
| Gelatin | 1.2 g |
| Coupler C-5 | 0.3 g |
| Coupler C-6 | 0.6 g |
| Coupler C-10 | 0.1 g |
| Eighteenth layer: first protective layer | |
| Gelatin | 0.7 g |
| UV absorber U-1 | 0.2 g |
| UV absorber U-2 | 0.05 g |
| UV absorber U-5 | 0.3 g |
| Formalin scavenger Cpd-H | 0.4 g |
| Dye D-1 | 0.1 g |
| Dye D-2 | 0.05 g |
| Dye D-3 | 0.1 g |
| Nineteenth layer: second protective layer | |
| Colloidal silver | 0.1 g as Ag |
| Silver bromoiodide fine grains (average grain size: 0.06 μm, AgI content: 1 mole %) | 0.1 g as Ag |

-continued

| | |
|---|---|
| Gelatin | 0.4 g |
| Twentieth layer: third protective layer | |
| Gelatin | 0.4 g |
| Polymethyl methacrylate (average grain size: 1.5 μm) | 0.1 g |
| Copolymer of methyl methacrylate and acrylic acid (4:6) (average grain size: 1.5 μm) | 0.1 g |
| Silicon oil | 0.03 g |
| Surface active agent W-1 | 3.0 mg |
| Surface active agent W-2 | 0.03 g |

In addition to the above components, additives F-1 to F-8 were added to all of the layers. Further, in addition to the above components, gelatin hardener H-1 and the surface active agents W-3, W-4, W-5 and W-6 for coating and emulsifying were added to each of the layers.

Further, phenol, 1,2-benzisothiazline-3-one, 2-phenoxyethanol, phenethyl alcohol, and butyl p-benzoate were added as a fungicide and an anti-mold agent.

TABLE 4

The silver bromoiodide emulsions used for Sample 301 are shown below:

| Emulsion | Sphere-corresponding average grain size (μm) | Fluctuation coefficient (%) | AgI content (mole %) |
|---|---|---|---|
| A. Monodispersed tetradecahedral grains | 0.28 | 16 | 3.7 |
| B. Monodispersed cubic internal latent image type grains | 0.30 | 10 | 3.3 |
| C. Monodispersed tabular grains, average aspect ratio: 4.0 | 0.38 | 18 | 5.0 |
| D. Tabular grains, average aspect ratio: 8.0 | 0.68 | 25 | 2.0 |
| E. Monodispersed cubic grains | 0.20 | 17 | 4.0 |
| F. Monodispersed cubic grains | 0.23 | 16 | 4.0 |
| G. Monodispersed cubic, internal latent image type grains | 0.28 | 11 | 3.5 |
| H. Monodispersed cubic, internal latent image type grains | 0.32 | 9 | 3.5 |
| I. Tabular grains, average aspect ratio: 9.0 | 0.80 | 28 | 1.5 |
| J. Monodispersed tetradecahedral grains | 0.30 | 18 | 4.0 |
| K. Monodispersed tabular grains, average aspect ratio: 7.0 | 0.45 | 17 | 4.0 |
| L .Monodispersed cubic internal latent image type grains | 0.46 | 14 | 3.5 |
| M. Monodispersed tabular grains, average aspect ratio: 10.0 | 0.55 | 13 | 4.0 |
| N. Tabular grains, average aspect ratio: 12.0 | 1.00 | 33 | 1.3 |

TABLE 5

Spectral sensitization of Emulsions A to N

| Emulsion | Added Sensitizing dye | Added amount per mol of silver halide (g) |
|---|---|---|
| A | S-1 | 0.025 |
| | S-2 | 0.25 |
| | S-7 | 0.01 |
| B | S-1 | 0.01 |
| | S-2 | 0.25 |
| | S-7 | 0.01 |
| C | S-1 | 0.02 |
| | S-2 | 0.25 |
| | S-7 | 0.01 |
| D | S-1 | 0.01 |
| | S-2 | 0.10 |
| | S-7 | 0.01 |
| E | S-3 | 0.5 |
| | S-4 | 0.1 |
| F | S-3 | 0.3 |
| | S-4 | 0.1 |
| G | S-3 | 0.25 |
| | S-4 | 0.08 |
| | S-8 | 0.05 |
| H | S-3 | 0.2 |
| | S-4 | 0.06 |
| | S-8 | 0.05 |
| I | S-3 | 0.3 |
| | S-4 | 0.07 |
| | S-8 | 0.1 |
| J | S-6 | 0.2 |
| | S-5 | 0.05 |
| K | S-6 | 0.2 |
| | S-5 | 0.05 |
| | S-5 | 0.05 |
| L | S-6 | 0.22 |
| | S-5 | 0.06 |
| M | S-6 | 0.15 |
| | S-5 | 0.04 |
| N | S-6 | 0.22 |
| | S-5 | 0.06 |

C-1

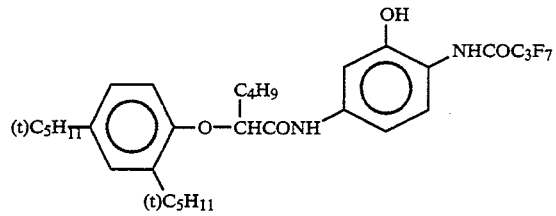

C-2

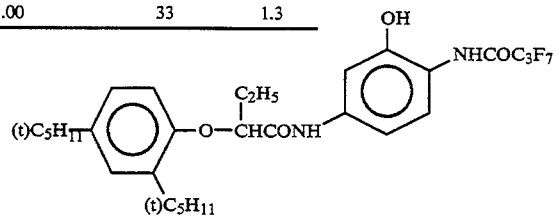

C-3

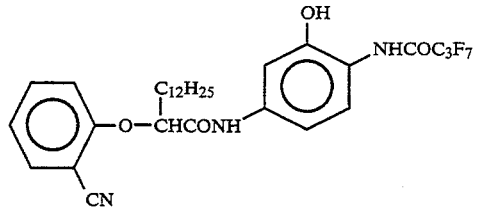

C-4

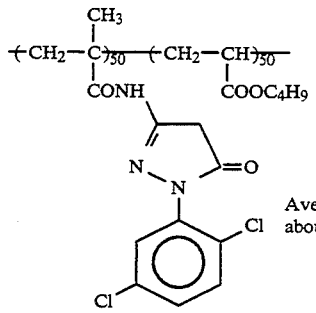

(by weight %)

Average molecular weight: about 25,000.

TABLE 5-continued
C-5
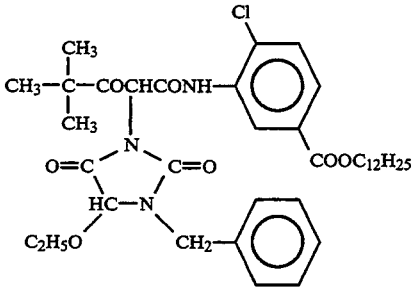
C-6
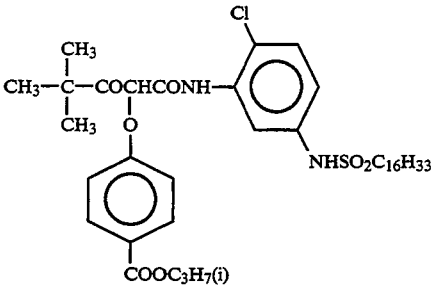
C-7
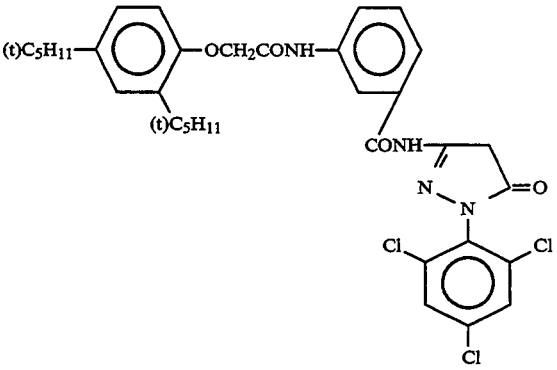
C-8
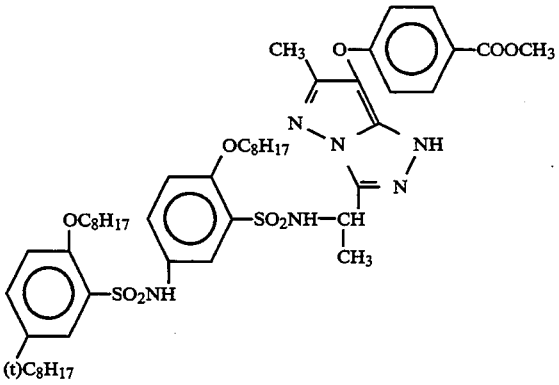
C-9
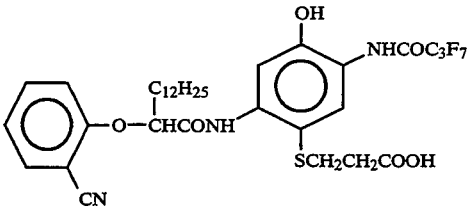
TABLE 5-continued
C-10
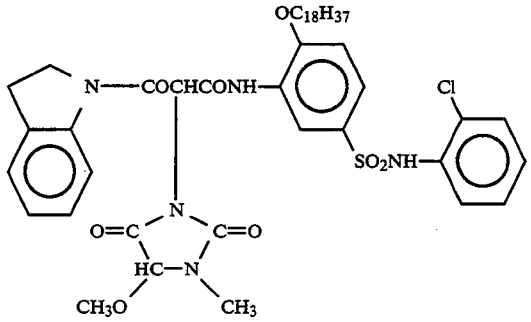
Oil-1
Dibutyl phthalate
Oil-2
Tricresyl phosphate
Oil-3
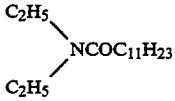
Cpd-A
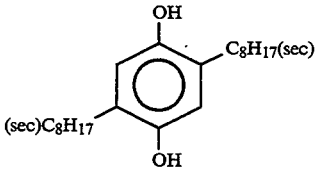
Cpd-B
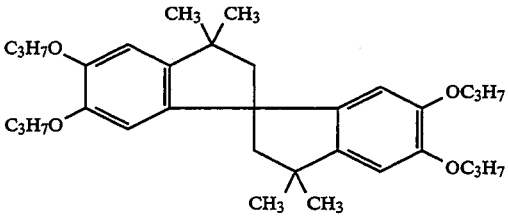
Cpd-C
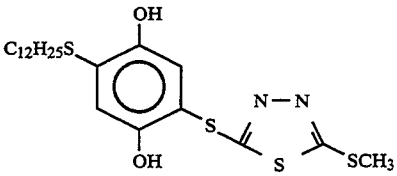
Cpd-D
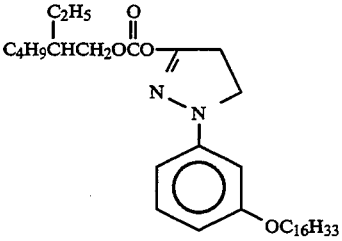
Cpd-E TABLE 5-continued
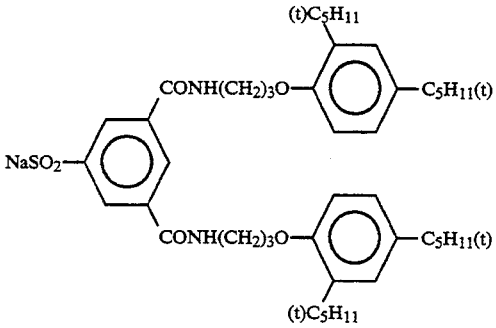
Cpd-F
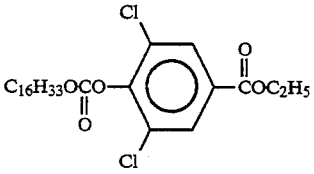
Cpd-G
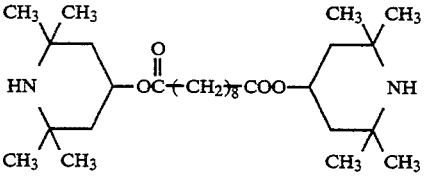
Cpd-H
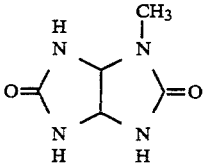
Cpd-I
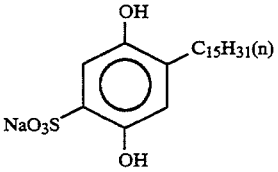
Cpd-J
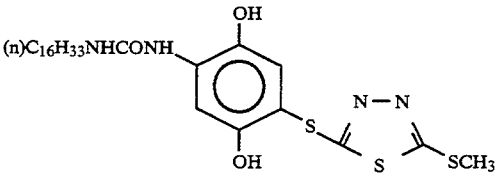
Cpd-K
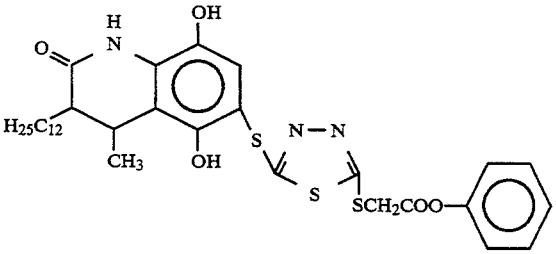
U-1
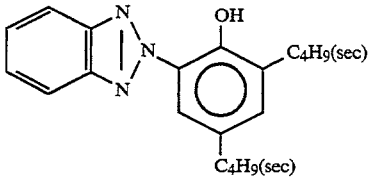
U-2
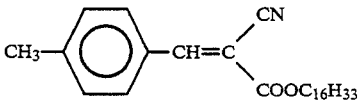
U-3
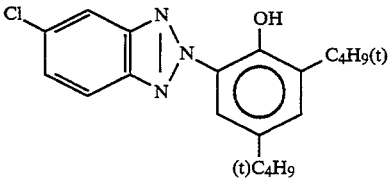
U-4
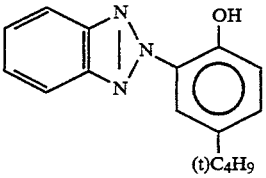
U-5
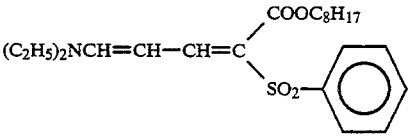
S-1
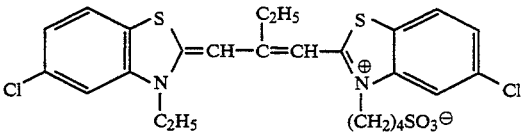
S-2
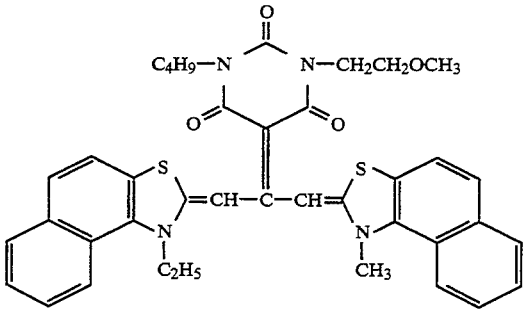
S-3
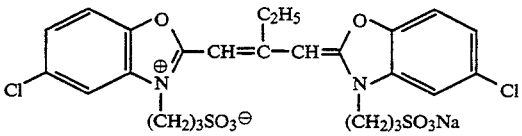
S-4

TABLE 5-continued
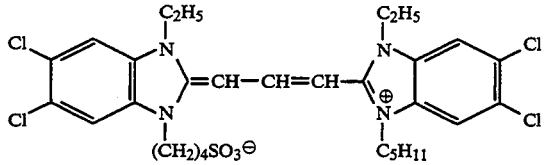
S-5
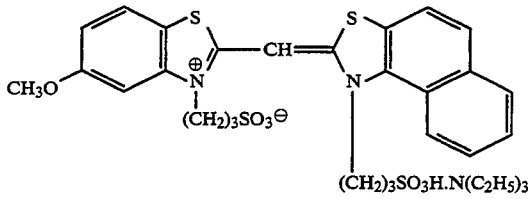
S-6
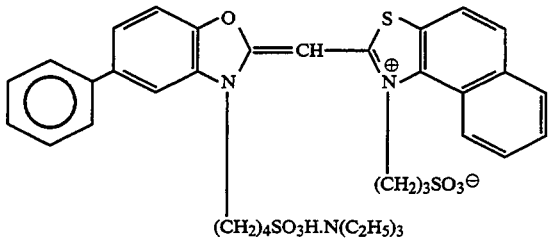
S-7
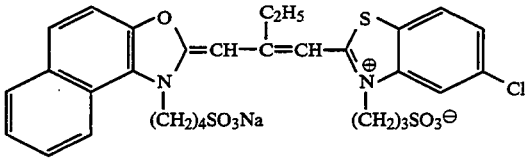
S-8
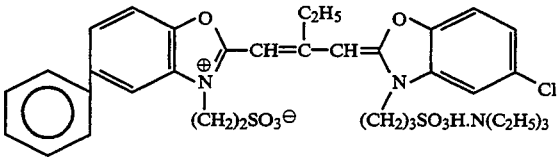
D-1
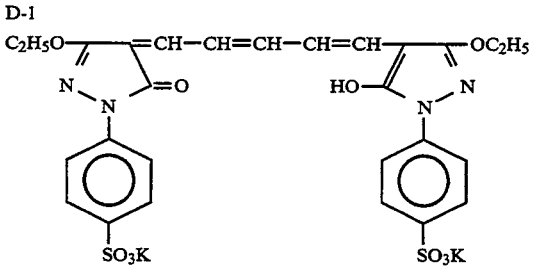
D-2
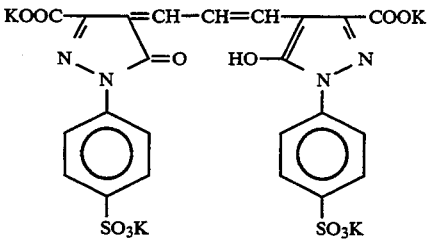
D-3
TABLE 5-continued
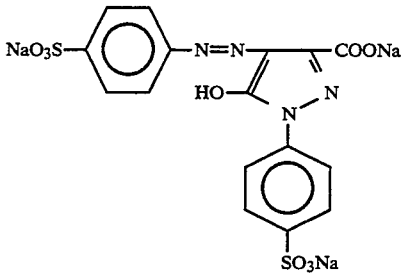
D-4
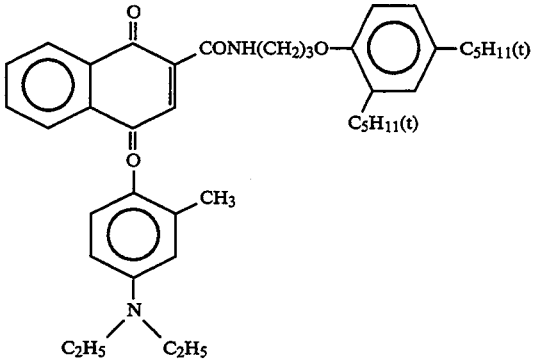
H-1
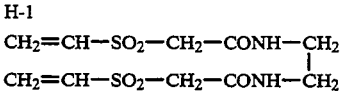
W-1
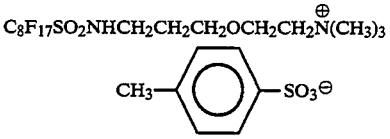
W-2
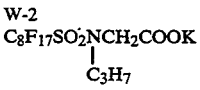
W-3
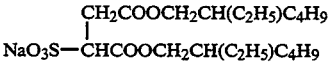
W-4
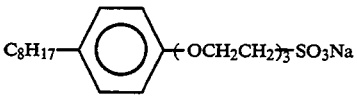
W-5
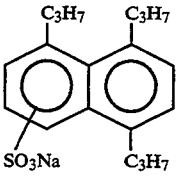
W-6
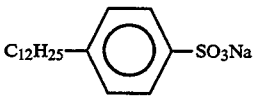

TABLE 5-continued

P-1

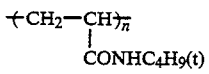

M-1

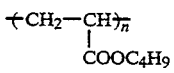

F-1

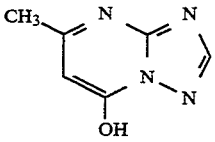

F-2

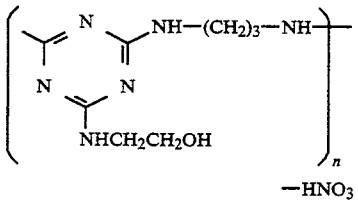

F-3

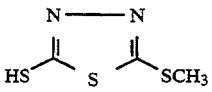

F-4

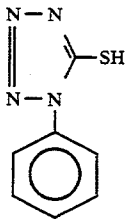

F-5

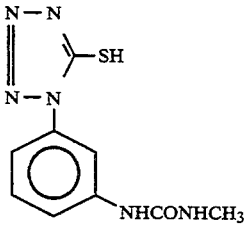

F-6

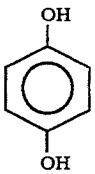

F-7

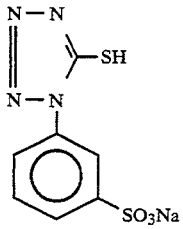

F-8

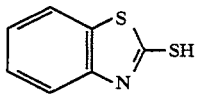

Preparation of Sample 302

Sample 302 was prepared in the same manner as that in Sample 301 except that yellow colloidal silver contained in the thirteenth layer of Sample 301 was replaced with 0.25 g/m$^2$ of dye D-25 which was used for Sample 202 in Example 2 and that the amount of HBS-2 was coated so that the amount thereof became 0.50 g/m$^2$.

Preparation of Samples 303 to 306

Samples 303 to 306 were prepared in the same manner as that in Sample 302 except that the dispersing medium HBS-2 contained in the thirteenth layer of Sample 302 was replaced with the comparative polymers Polymer-1 and Polymer-2 and the polymers P-2 and P-16 of the present invention in the same weight.

The samples thus obtained were exposed to a white light via an optical wedge and then processed with an automatic developing machine by the following processing methods C and D.

The results showed that the same results as those in Example 2 could be obtained in either processing. That is, the samples of the present invention had high sensitivity in the green-sensitive layer while maintaining a sufficient yellow filter function compared with the comparative samples, and the samples of the invention had values equivalent to or smaller than that of Comparative Sample 301 in Dmin of yellow. Further, the samples of the present invention had very small reductions in sensitivities and maximum densities when they were stored in a high humid condition.

Processing method (C):

| Processing step | Processing time (minute) | Temperature (°C.) | Tank capacity (l) | Replenishing amount (ml/m$^2$) |
|---|---|---|---|---|
| 1st developing | 6 | 38 | 12 | 2200 |
| 1st rinsing | 2 | 38 | 4 | 7500 |
| Reversal | 2 | 38 | 4 | 1100 |
| Color developing | 6 | 38 | 12 | 2200 |
| Controlling | 2 | 38 | 4 | 1100 |
| Bleaching | 6 | 38 | 12 | 220 |
| Fixing | 4 | 38 | 8 | 1100 |
| 2nd rinsing | 4 | 38 | 8 | 7500 |
| Stabilizing | 1 | 25 | 2 | 1100 |

The compositions of the respective processing solutions are shown below:

| First developing solution | T | R |
|---|---|---|
| Pentasodium nitrilo-N,N,N- | 1.5 g | 1.5 g |

-continued

| First developing solution | T | R |
|---|---|---|
| trimethylenephosphonate | | |
| Pentasodium diethylene-triaminepentaacetate | 2.0 g | 2.0 g |
| Sodium sulfite | 30 g | 30 g |
| Hydroquinone-potassium monosulfonate | 20 g | 20 g |
| Potassium carbonate | 15 g | 20 g |
| Sodium bicarbonate | 12 g | 15 g |
| 1-Phenyl-4-methyl-4-hydroxy-methyl-3-pyrazolidone | 1.5 g | 2.0 g |
| Potassium bromide | 2.5 g | 1.4 g |
| Potassium thiocyanate | 1.2 g | 1.2 g |
| Potassium iodide | 2.0 mg | — |
| Diethylene glycol | 13 g | 15 g |
| Water was added to make | 1000 ml | 1000 ml |
| pH | 9.60 | 9.60 |

pH was adjusted with hydrochloric acid or potassium hydroxide.

Note: T: tank solution

R: replenishing solution

| Reversal solution | T | R |
|---|---|---|
| Pentasodium nitrilo-N,N,N-tri-methylenephosphonate | 3.0 g | 3.0 g |
| Stannous chloride dihydrate | 1.0 g | 1.0 g |
| p-Aminophenol | 0.1 g | 0.1 g |
| Sodium hydroxide | 8 g | 8 g |
| Glacial acetic acid | 15 ml | 15 ml |
| Water was added to make | 1000 ml | 1000 ml |
| pH | 6.00 | 6.00 |

pH was adjusted with hydrochloric acid or potassium hydroxide.

| Color developing solution | T | R |
|---|---|---|
| Pentasodium nitrilo-N,N,N-trimethylenephosphonate | 2.0 g | 2.0 g |
| Sodium sulfite | 7.0 g | 7.0 g |
| Trisodium phosphate 12 hydrate | 36 g | 36 g |
| Potassium bromide | 1.0 g | — |
| Potassium iodide | 90 mg | — |
| Sodium hydroxide | 3.0 g | 3.0 g |
| Citrazinic acid | 1.5 g | 1.5 g |
| N-Ethyl-(β-methanesulfonamid-ethyl)3-methyl-4-aminoanline 3/2 sulfate monohydrate | 11 g | 11 g |
| 3,6-Dithiaoctane-1,8-diol | 1.0 g | 1.0 g |
| Water was added to make | 1000 ml | 1000 ml |
| pH | 11.80 | 12.00 |

pH was adjusted with hydrochloric acid or potassium hydroxide.

| Controlling solution | T | R |
|---|---|---|
| Disodium ethylenediamine tetracetate dihydrate | 8.0 g | 8.0 g |
| Sodium sulfite | 12 g | 12 g |
| 1-Thioglycerol | 0.4 g | 0.4 g |
| Formaldehyde/sodium bisulfite adduct | 30 g | 35 g |
| Water was added to | 1000 ml | 1000 ml |
| pH | 6.30 | 6.10 |

pH was adjusted with hydrochloric acid or sodium hydroxide.

| Bleaching solution | T | R |
|---|---|---|
| Disodium ethylenediamine-tetraacetate dihydrate | 2.0 g | 4.0 g |
| Fe(III) ammonium ethylene-diaminetetraacetate dihydrate | 120 g | 240 g |
| Potassium bromide | 100 g | 200 g |
| Ammonium nitrate | 10 g | 20 g |
| Water was added to make | 1000 ml | 1000 ml |
| pH | 5.70 | 5.50 |

pH was adjusted with hydrochloric acid or sodium hydroxide.

| Fixing solution | T | R |
|---|---|---|
| Ammonium thiosulfate | 80 g | 80 g |
| Sodium sulfite | 5.0 g | 5.0 g |
| Sodium bisulfite | 5.0 g | 5.0 g |
| Water was added to make | 1000 ml | 1000 ml |
| pH | 6.60 | 6.60 |

pH was adjusted with hydrochloric acid or ammonia water.

| Stabilizing solution | T | R |
|---|---|---|
| Benzoisothiazoline-3-one | 0.02 g | 0.03 g |
| Polyoxyethylene-p-monononyl-phenyl ether (average poly-merization degree: 10) | 0.3 g | 0.3 g |
| Water was added to make | 1000 ml | 1000 ml |
| pH | 7.0 | 7.0 |

Processing method (D):

| Processing step | Processing time | Temper-ature (°C.) | Tank capacity (l) | Replen-ishing amount (ml/m²) |
|---|---|---|---|---|
| 1st developing | 6 minutes | 38 | 12 | 2200 |
| 1st rinsing | 45 seconds | 38 | 2 | 2200 |
| Reversal | 45 seconds | 38 | 2 | 1100 |
| Color developing | 6 minutes | 38 | 12 | 2200 |
| Bleaching | 2 minutes | 38 | 4 | 860 |
| Bleach/fixing | 4 minutes | 38 | 8 | 1100 |
| 2nd rinsing (1) | 1 minute | 38 | 2 | — |
| 2nd rinsing (2) | 1 minute | 38 | 2 | 1100 |
| Stabilizing | 1 minute | 25 | 2 | 1100 |
| Drying | 1 minute | 65 | — | — |

Replenishing of the second rinsing solution was by a countercurrent replenishing system, in which a replenishing solution was introduced into the second rinsing (2) and the overflow solution of the second rinsing (2) was introduced into the second rinsing (1).

The compositions of the respective processing solutions are shown below:

| First developing solution | T | R |
|---|---|---|
| Pentasodium nitrilo-N,N,N-trimethylenephosphonate | 2.0 g | 2.0 g |
| Sodium sulfite | 30 g | 30 g |
| Hydroquinone-potassium monosulfonate | 20 g | 20 g |
| Potassium carbonate | 33 g | 33 g |
| 1-Phenyl-4-methyl-4-hydroxy-methyl-3-pyrazolidone | 2.0 g | 2.0 g |
| Potassium bromide | 2.5 g | 1.4 g |
| Potassium thiocyanate | 1.2 g | 1.2 g |
| Potassium iodide | 2.0 mg | — |
| Water was added to make | 1000 ml | 1000 ml |
| pH | 9.60 | 9.60 |

pH was adjusted with hydrochloric acid or potassium hydroxide.

Note: T: tank solution
R: replenishing solution

| First rinsing solution | T | R |
|---|---|---|
| Ethylenediaminetetramethylene-phosphonic acid | 2.0 g | 2.0 g |
| Disodium phosphate | 5.0 g | 5.0 g |
| Water was added to make | 1000 ml | 1000 ml |
| pH | 7.00 | 7.00 |

pH was adjusted with hydrochloric acid or potassium hydroxide.

| Reversal solution | T | R |
|---|---|---|
| Pentasodium nitrilo-N,N,N-trimethylenephosphonate | 3.0 g | 3.0 g |
| Stannous chloride dihydrate | 1.0 g | 1.0 g |
| p-Aminophenol | 0.1 g | 0.1 g |
| Sodium hydroxide | 8 g | 8 g |
| Glacial acetic acid | 15 ml | 15 ml |
| Water was added to make | 1000 ml | 1000 ml |
| pH | 6.00 | 6.00 |

pH was adjusted with hydrochloric acid or sodium hydroxide.

| Color developing solution | T | R |
|---|---|---|
| Pentasodium nitrilo-N,N,N-trimethylenephosphonate | 2.0 g | 2.0 g |
| Sodium sulfite | 7.0 g | 7.0 g |
| Tripotassium phosphate 12 hydrate | 36 g | 36 g |
| Potassium bromide | 1.0 g | — |
| Potassium iodide | 90 mg | — |
| Sodium hydroxide | 3.0 g | 3.0 g |
| Citrazinic acid | 1.5 g | 1.5 g |
| N-Ethyl-(β-methanesulfonamidethyl)-3-methyl-4-aminoanline 3/2 sulfate monohydrate | 11 g | 11 g |
| 3,6-Dithiaoctane-1,8-diol | 1.0 g | 1.0 g |
| Water was added to make | 1000 ml | 1000 ml |
| pH | 11.80 | 12.00 |

pH was adjusted with hydrochloric acid or potassium hydroxide.

| Bleaching solution | T | R |
|---|---|---|
| Disodium ethylenediaminetetraacetate dihydrate | 10.0 g | 10.0 g |
| Fe(III) ammonium ethylenediaminetetraacetate dihydrate | 120 g | 120 g |
| Potassium bromide | 100 g | 100 g |
| Ammonium nitrate | 10 g | 10 g |
| Bleaching accelerator $(CH_3)_2N—CH_2—CH_2—S—S—CH_2—CH_2—N(CH_3)_2.2HCl$ | 0.005 mol | 0.005 mol |
| Water was added to make | 1000 ml | 1000 ml |
| pH | 6.30 | 6.30 |

pH was adjusted with hydrochloric acid or ammonia water.

| Bleach/fixing solution | T | R |
|---|---|---|
| Disodium ethylenediaminetetracetate dihydrate | 5.0 g | 5.0 g |
| Fe(III) ammonium ethylenediaminetetraacetate dihydrate | 50 g | 50 g |
| Ammonium thiosulfate | 80 g | 80 g |
| Sodium sulfite | 12.0 g | 12.0 g |

-continued

| Bleach/fixing solution | T | R |
|---|---|---|
| Water was added to make | 1000 ml | 1000 ml |
| pH | 6.60 | 6.60 |

pH was adjusted with hydrochloric acid or ammonia water.

2nd rinsing solution (the composition of tank solution and that of replenishing solution are the same)

Tap water was introduced into a mixed-bed type column filled with hydrogen type strong acidic cation exchange resins (Amberlite IR-120B manufactured by Rohm & Haas Co., Ltd.) and hydroxyl type strong base anion exchange resins (Amberlite IRA-400) to reduce the calcium and magnesium ion concentrations to 3 mg/liter or less, and subsequently 20 mg/l of sodium dichloroisocyanurate and 1.5 g/l of sodium sulfate were added. The pH of this solution was from 6.5 to 7.5.

| Stabilizing solution | T | R |
|---|---|---|
| Formalin (37%) | 0.5 ml | 0.5 ml |
| Polyoxyethylene-p-monononylphenyl ether (average polymerization degree: 10) | 0.3 g | 0.3 g |
| Triazole | 1.7 g | 1.7 g |
| Piperazine 6 hydrate | 0.6 g | 0.6 g |
| Water was added to make | 1000 ml | 1000 ml |
| pH | not adjusted | |

Example 4

The respective layers of the compositions shown below were simultaneously coated on a subbed cellulose triacetate film support, whereby Sample 401 which was a multi-layer color light-sensitive material was prepared.

Compositions of the light-sensitive layers

The numerals corresponding to the respective components show the coated amounts expressed in terms of $g/m^2$ and those corresponding to the silver halides show the coated amounts converted to silver. Provided that the coated amounts of the sensitizing dyes are shown in terms of moles per mole of silver halide contained in the same layer.

| Sample 401 | |
|---|---|
| First layer (an anti-halation layer) | |
| Black colloidal silver | 0.18 as Ag |
| Gelatin | 1.40 |
| Second layer (an intermediate layer) | |
| 2,5-Di-t-pentadecyl hydroquinone | 0.18 |
| EX-1 | 0.18 |
| EX-3 | 0.020 |
| EX-12 | $2.0 \times 10^{-3}$ |
| U-1 | 0.060 |
| U-2 | 0.080 |
| U-3 | 0.10 |
| HBS-1 | 0.10 |
| HBS-2 | 0.020 |
| Gelatin | 1.04 |
| Third layer (first red-sensitive layer) | |
| Emulsion A | 0.20 as Ag |
| Emulsion B | 0.30 as Ag |
| Sensitizing dye I | $6.9 \times 10^{-5}$ |
| Sensitizing dye II | $1.8 \times 10^{-5}$ |
| Sensitizing dye III | $3.1 \times 10^{-4}$ |
| EX-2 | 0.17 |
| EX-10 | 0.020 |
| EX-14 | 0.17 |
| U-1 | 0.070 |

-continued

| Sample 401 | |
|---|---|
| U-2 | 0.050 |
| U-3 | 0.070 |
| HBS-1 | 0.060 |
| Gelatin | 0.87 |
| Fourth layer (second red-sensitive layer) | |
| Emulsion D | 0.85 as Ag |
| Sensitizing dye I | $3.5 \times 10^{-4}$ |
| Sensitizing dye II | $1.6 \times 10^{-5}$ |
| Sensitizing dye III | $5.1 \times 10^{-4}$ |
| EX-2 | 0.20 |
| EX-3 | 0.050 |
| EX-10 | 0.015 |
| EX-14 | 0.20 |
| EX-15 | 0.050 |
| U-1 | 0.070 |
| U-2 | 0.050 |
| U-3 | 0.070 |
| Gelatin | 1.30 |
| Fifth layer (third red-sensitive layer) | |
| Emulsion E | 1.55 as Ag |
| Sensitizing dye I | $2.4 \times 10^{-4}$ |
| Sensitizing dye II | $1.0 \times 10^{-4}$ |
| Sensitizing dye III | $3.4 \times 10^{-4}$ |
| EX-2 | 0.097 |
| EX-3 | 0.010 |
| EX-4 | 0.080 |
| HBS-1 | 0.22 |
| HBS-2 | 0.10 |
| Gelatin | 1.63 |
| Sixth layer (an intermediate layer) | |
| EX-5 | 0.040 |
| HBS-1 | 0.020 |
| Gelatin | 0.80 |
| Seventh layer (first protective layer) | |
| Emulsion G | 0.20 as Ag |
| U-4 | 0.11 |
| U-5 | 0.17 |
| HBS-1 | $5.0 \times 10^{-2}$ |
| Gelatin | 1.00 |
| Eighth layer (second protective layer) | |
| H-1 | 0.40 |
| B-1 (diameter: 1.7 μm) | $5.0 \times 10^{-2}$ |
| B-2 (diameter: 1.7 μm) | 0.10 |
| B-3 | 0.10 |
| S-1 | 0.20 |
| Gelatin | 1.20 |

Further, W-1, W-2, W-3, B-4, B-5, B-6, F-1, F-2, F-3, F-4, F-5, F-6, F-7, F-8, F-9, F-10, F-11, F-12, F-13, F-14, F-15, F-16, an iron salt, a lead salt, a gold salt, a platinum salt, an iridium salt, and a rhodium salt were added to all layers to preserve the samples, improve processing of the samples, relieve presure in the samples, kill mold in the samples, act as a fungicide in the samples, reduce static in the samples and improve coating of the layers.

EX-1 to EX-15, U-1 to U-5, HBS-1 to HBS-2, Emulsion A to Emulsion G, Sensitizing dye I to Sensitizing dye III, B-1 to B-6,S-1, W-1 to W-3, and F-1 to F-16 are the same as used for preparing Sample 201 in Example 2.

Preparation of Samples 402 to 406

Samples 402 to 406 were prepared in the same manner as that in Sample 401 except that HBS-1 and HBS-2 contained in the third layer and fifth layer of Sample 401 were replaced with the high molecular compounds according to the present invention shown in Table 7.

Preparation of Samples 407 and 408

Samples 407 and 408 were prepared in the same manner as that in Sample 401 except that HBS-1 and HBS-2 contained in the third layer and fifth layer of Sample 401 were replaced with the comparative high molecular compounds shown in Table 6.

The samples thus obtained were exposed to white light via an optical wedge and then were processed with an automatic developing machine in the following manner (the processing was carried out in advance until an accumulative replenishing amount reached three times as much as the tank capacity of a mother solution.

Processing method (A):

| Processing step | Processing time | Temperature (°C.) | Replenishing amount (ml) | Tank capacity (l) |
|---|---|---|---|---|
| Color developing | 3 minutes & 15 seconds | 38 | 33 | 20 |
| Bleaching | 6 minutes & 30 seconds | 38 | 25 | 40 |
| Rinsing | 2 minutes & 10 seconds | 24 | 1200 | 20 |
| Fixing | 4 minutes & 20 seconds | 38 | 25 | 30 |
| Rinsing (1) | 1 minute & 5 seconds | 24 | * | 10 |
| Rinsing (2) | 1 minute | 24 | 1200 | 10 |
| Stabilizing | 1 minute & 5 seconds | 38 | 25 | 10 |
| Drying | 4 minutes & 20 seconds | 55 | | |

*A countercurrent system from (2) to (1).

Replenishing amount is per meter of support of 35 mm width.

The compositions of the processing solutions are shown below:

| Color developing solution | A | B |
|---|---|---|
| Diethylenetriaminepentacetic acid | 1.0 g | 1.1 g |
| 1-Hydroxyethylidene-1,1-diphosphonic acid | 3.0 g | 3.2 g |
| Sodium sulfite | 4.0 g | 4.4 g |
| Potassium carbonate | 30.0 g | 37.0 g |
| Potassium bromide | 1.4 g | 0.7 g |
| Potassium iodide | 1.5 mg | — |
| Hydroxylamine sulfate | 2.5 g | 2.8 g |
| 4-[N-ethyl-N-(β-hydroxyethyl amino)]-2-methylaniline sulfate | 4.5 g | 5.5 g |
| Water was added to make the total quantity | 1.0 l | 1.0 l |
| pH | 10.05 | 10.10 |

| Bleaching solution | A | B |
|---|---|---|
| Ferric sodium ethylenediamine-tetracetate trihydrate | 100.0 g | 120.0 g |
| Disodium ethylenediamine-tetracetate | 10.0 g | 10.0 g |
| Ammonium bromide | 140.0 g | 160.0 g |
| Ammonium nitrate | 30.0 g | 35.0 g |
| Ammonia water (27%) | 6.5 ml | 4.0 ml |
| Water was added to make the total quantity | 1.0 l | 1.0 l |
| pH | 6.0. | 5.7 |

| Fixing solution | A | B |
|---|---|---|
| Disodium ethylenediamine tetracetate | 0.5 g | 0.7 g |
| Sodium sulfite | 7.0 g | 8.0 g |
| Sodium bisulfite | 5.0 g | 5.5 g |
| Ammonium thiosulfate aqueous solution (70%) | 170.0 ml | 200.0 ml |
| Water was added to make the total quantity | 1.0 l | 1.0 l |
| pH | 6.7 | 6.6 |

| Stabilizing solution | A | B |
|---|---|---|
| Formalin (37%) | 2.0 ml | 3.0 ml |
| Polyoxyethylene-p-monononylphenyl ether (average polymerization | 0.3 g | 0.45 g |

-continued

| | | |
|---|---|---|
| degree: 10) | | |
| Disodium ethylenediamine tetracetate | 0.05 g | 0.08 g |
| Water was added to make the total quantity | 1.0 l | 1.0 l |
| pH | 5.0–8.0 | 5.0–8.0 |

Note:
A: mother solution
B: replenishing solution

After processing, the respective samples were subjected to measurement of density, wherein the maximum density (Dmax) of a red-sensitive layer was expressed in terms of a value relative to that of Sample 401 to evaluate the color developing performance of a dye-forming coupler.

Further, before processing the samples were stored at 50° C. and a relative humidity of 70% for 3 days and then the surface condition was visually observed to evaluate oil drop trouble. Further, before processing two sheets of the samples were stored with the emulsion layer sides thereof superposed at 50° C. and a relative humidity of 70% for one day and then they were peeled off to evaluate adhesion.

The results are shown in Table 6.

TABLE 6

| Sample No. | Dispersing medium in the third layer (amount g/m²) | | Dispersing medium in the fifth layer (amount g/m²) | | Maximum color density relative value (Dmax) | Oil drop trouble | Adhesion |
|---|---|---|---|---|---|---|---|
| 401 (Comp.) | HBS-1 | (0.06) | HBS-1 | (0.22) | 1.00 | xx* | xx |
| | | | HBS-2 | (0.10) | | | |
| 402 (Inv.) | P-3 | (0.06) | P-3 | (0.32) | 0.96 | ○ | ○ |
| 403 (Inv.) | P-7 | (0.06) | P-7 | (0.32) | 0.98 | ○ | ○ |
| 404 (Inv.) | P-8 | (0.06) | P-8 | (0.32) | 0.95 | ○ | ○ |
| 405 (Inv.) | P-14 | (0.06) | P-14 | (0.32) | 1.02 | ○ | ○ |
| 406 (Inv.) | P-23 | (0.06) | P-23 | (0.32) | 1.04 | ○ | ○ |
| 407 (Comp.) | Polymer-1 | (0.06) | Polymer-1 | (0.22) | 0.66 | ○ | ○ |
| 408 (Comp.) | Polymer-2 | (0.06) | Polymer-2 | (0.22) | 0.49 | ○ | ○ |

*deposited on the surface.
Polymer-1 and Polymer-2 are the same as used in above Example 2.

As apparent from the results summarized in Table 6, oil drop trouble and reduced adhesion, each present in Sample 401 were not present in Samples 402 to 408 which were prepared in accordance with the present invention. The dispersion of the present invention prevents deterioration of layer quality. The samples according to the present invention had excellent maximum color density (Dmax) comparable to Dmax of comparative Sample 401. The Dmax was notably lowered in comparative Samples 407 and 408. It has been found that the present invention provides a material capable of overcoming the antipodal problem, that is, layer quality is not degraded without lowering the maximum color density (without deteriorating the reactivity of a coupler).

While the invention has been described in detail and with reference to specific embodiments thereof, it will be apparent to one skilled in the art that various changes and modifications can be made therein without departing from the spirit and scope thereof.

What is claimed is:

1. A silver halide photographic material containing a dispersion of lipophilic fine particles comprising a hydrophobic compound, and a water-insoluble, organic solvent-soluble polymer comprising a repeating unit represented by formula (I):

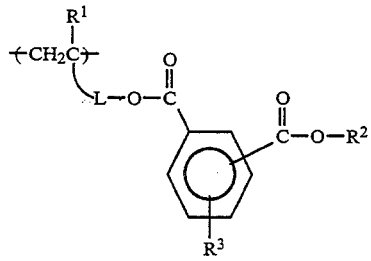

(I)

wherein $R^1$ represents a hydrogen atom, an alkyl group having from 1 to 4 carbon atoms, or a halogen atom;

$R^2$ represents a substituted alkyl group or a substituted aryl group, the substituent for either the substituent alkyl group or the substituted aryl group being selected from the group consisting of an aryl group, a nitro group, a hydroxyl group, a cyano group, a sulfo group, an alkoxyl group, an aryloxyl group, an acyloxyl group, an acylamino group, a sulfonamide group, a sulfamoyl group, a halogen atom, a carboxyl group, a carbamoyl group, an alkoxy carbonyl group and a sulfonyl group;

$R^3$ represents a hydrogen atom or a substituent; and

L represents a divalent linkage group.

2. The silver halide photographic material as in claim 1, wherein the hydrophobic compound is an oil soluble dye.

3. The silver halide photographic material as in claim 2, wherein the oil soluble dye is represented by formula (II):

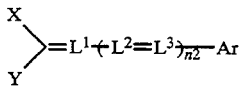

(II)

wherein x and Y may be the same or different and each individually represents an electron attractive group or X and Y may be combined to form an acidic group;

Ar represents a substituted or unsubstituted phenyl group or a substituted or unsubstituted heterocyclic group;

$L^1$, $L^2$ and $L^3$ each represents a substituted or unsubstituted methine group; and $n_2$ represents an integer of 0, 1 or 2.

4. The silver halide photographic material as in claim 2, wherein the oil soluble dye is represented by formula (III):

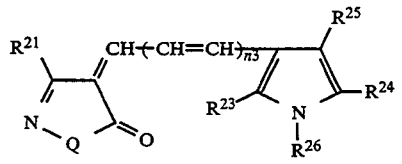

(III)

wherein $R^{21}$ represents a hydrogen atom, a substituted or unsubstituted alkyl group, a substituted or unsubstituted aryl group, —$COOR^{27}$, —$COR^{27}$, —$CONR^{27}R^{28}$, —CN, —$OR^{27}$, —$NR^{27}R^{28}$, or —$N(R^{27})COR^{28}$;

Q represents an oxygen atom or —$NR^{22}$—;

$R^{22}$ represents a hydrogen atom, a substituted or unsubstituted alkyl group, a substituted or unsubstituted aryl group, or a substituted or unsubstituted heterocyclic group;

$R^{23}$, $R^{24}$ and $R^{25}$ may be the same or different and each individually represents a hydrogen atom, a substituted or unsubstituted alkyl group, or a substituted or unsubstituted aryl group;

$R^{24}$ and $R^{25}$ may be combined to form a 6-membered ring;

$R^{26}$ represents a hydrogen atom, a substituted or unsubstituted alkyl group, a substituted or unsubstituted aryl group, or a substituted or unsubstituted amino group;

$R^{27}$ and $R^{28}$ may be the same or different and each individually represents a hydrogen atom, a substituted or unsubstituted alkyl group, or a substituted or unsubstituted aryl group; and $n_3$ represents an integer of 0 or 1.

5. The silver halide photographic material as in claim 1, wherein the substituent represented by $R^3$ is a hydrogen atom, a substituted or unsubstituted alkyl group, a substituted or unsubstituted aryl group, a nitro group, a hydroxyl group, a cyano group, a sulfo group, an alkoxy group, an aryloxy group, an acyloxy group, an acylamino group, a sulfonamide group, a sulfamoyl group, a halogen atom, a carboxyl group, a carbamoyl group, an alkoxycarbonyl group, or a sulfonyl group.

6. The silver halide photographic material as in claim 1, wherein the water-insoluble, organic solvent-soluble polymer has a number average molecular weight of from 2,000 to 300,000.

7. The silver halide photographic material as in claim 6, wherein the water-insoluble, organic solvent-soluble polymer has a number average molecular weight of from 3,000 to 100,000.

8. The silver halide photographic material as in claim 1, wherein the polymer is present in the dispersion in an amount of 0.1 to 500 wt % based on the total weight of the dispersion.

9. The silver halide photographic material as in claim 8, wherein the polymer is present in the dispersion in an amount of 50 to 300 wt % based on the total weight of the dispersion.

10. The silver halide photographic material as in claim 2, wherein the oil-soluble dye is present in an amount of $10^{-3}$ to 3.0 g/$m^2$ of the photographic material.

11. The silver halide photographic material as in claim 10, wherein the oil-soluble dye is present in an amount of $10^{-3}$ to 1.0 g/$m^2$ of the photographic material.

12. The silver halide photographic material as in claim 1, wherein $R^1$ represents an alkyl group containing 1 to 4 carbon atoms.

13. The silver halide photographic material as in claim 1, wherein $R^2$ represents a substituted or unsubstituted alkyl group selected from the group consisting of a methyl group, an ethyl group, an n-propyl group, an isopropyl group, an n-butyl group, an isobutyl group, an n-amyl group, an n-hexyl group, an n-heptyl group, an n-octyl group, a 2 -ethylhexyl group, an n-nonyl group, an n-decyl group, an n-dodecyl group and an n-octadecyl group.

14. The silver halide photographic material as in claim 1, wherein $R^2$ represents a substituted or unsubstituted aryl group selected from the group consisting of a phenyl group and a naphthyl group.

15. The silver halide photographic material as in claim 1, wherein L represents a group having the formula:

$$\text{—}(Z)_m[X^1(J^1\text{—}X^2)_p(J^2\text{—}X^3)_q(J^3)_r]_s\text{—}$$

wherein

Z represents —$CON(R^4)$—, —COO—, —NHCO—, —OCO—,

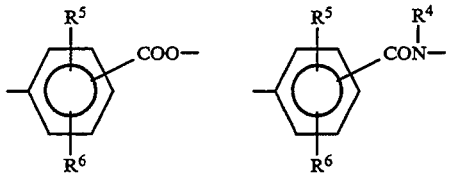

$J^1$, $J^2$ and $J^3$ may be the same or different and each independently represents —CO—, —$SO_2$—, —$CON(R^7)$—, —$SO_2N(R^7)$ —, —O—, —S—, —$N(R^6)$—, —COO—, —OCO— and —$N(R^7)CO_2$—; where:

$R^4$ and $R^7$ each independently represents a hydrogen atom or a substituted or unsubstituted alkyl group containing from 1 to 6 carbon atoms;

$R^5$ and $R^6$ each independently represents a hydrogen atom, a hydroxyl group, a halogen atom, a substituted or unsubstituted alkyl group, a substituted or unsubstituted alkoxy group, a substituted or unsubstituted acyloxy group or a substituted or unsubstituted aryloxy group;

$X^1$, $X^2$ and $X^3$ may be the same or different and each individually represents a substituted or unsubstituted alkylene group, a substituted or unsubstituted arylene group or a substituted or unsubstituted aralkylene group; and m, p, q, r and s each represents 0 or 1.

* * * * *